US009275572B2

(12) United States Patent
Izawa et al.

(10) Patent No.: US 9,275,572 B2
(45) Date of Patent: Mar. 1, 2016

(54) DISPLAY DEVICE AND DISPLAY DEVICE DRIVING METHOD FOR CAUSING REDUCTION IN POWER CONSUMPTION

(75) Inventors: Yosuke Izawa, Osaka (JP); Toshiyuki Kato, Osaka (JP); Kouhei Ebisuno, Kyoto (JP); Shinya Ono, Osaka (JP); Tetsurou Nakamura, Kyoto (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 13/467,462

(22) Filed: May 9, 2012

(65) Prior Publication Data

US 2012/0327063 A1 Dec. 27, 2012

Related U.S. Application Data

(63) Continuation of application No. PCT/JP2011/003609, filed on Jun. 23, 2011.

(51) Int. Cl.

*G09G 3/30* (2006.01)
*G09G 5/00* (2006.01)
*G09G 3/32* (2006.01)

(52) U.S. Cl.

CPC ..... *G09G 3/3208* (2013.01); *G09G 2320/029* (2013.01); *G09G 2320/0223* (2013.01);
(Continued)

(58) Field of Classification Search

CPC ..... G09G 5/00; G09G 3/30; G09G 2330/021; G09G 3/3233; G09G 2300/0842
USPC ..... 345/211–213, 76–83, 39, 44–46; 316/169.1–169.4
See application file for complete search history.

(56) References Cited

U.S. PATENT DOCUMENTS 6,518,962 B2 2/2003 Kimura et al.
7,362,322 B2 4/2008 Kimura et al.
(Continued)

FOREIGN PATENT DOCUMENTS

CN 101515435 8/2009
CN 101273398 B 6/2011
(Continued)

OTHER PUBLICATIONS

Search report from PCT/JP2010/000149, mail date is Feb. 9, 2010.
(Continued)

*Primary Examiner* — Temesgh Ghebretinsae
*Assistant Examiner* — Lisa Landis
(74) *Attorney, Agent, or Firm* — Greenblum & Bernstein, P.L.C.

(57) ABSTRACT

Display device includes: a power supplying unit which outputs at least a high-side or low-side output potential; an organic EL display unit which includes pixels and receives power supply from the power supplying unit; two or more detecting lines for transmitting a high-side or low-side applied potential applied to two or more pixels; a relay unit which outputs the high-side or low-side applied potentials transmitted by the detecting lines, to output lines fewer in number than the detecting lines; and a regulating unit which regulates at least the high-side or low-side output potential to be outputted by the power supplying unit, such that any one of potential difference between a reference potential and the high-side applied potential from the relay unit, potential difference between the reference potential and the low-side applied potential, and potential difference between the high-side applied potential and the low-side applied potential reaches a predetermined potential difference.

17 Claims, 32 Drawing Sheets

(52) U.S. Cl.
CPC ..... *G09G2320/0233* (2013.01); *G09G 2320/0242* (2013.01); *G09G 2320/0285* (2013.01); *G09G 2320/043* (2013.01); *G09G 2330/02* (2013.01); *G09G 2330/021* (2013.01); *G09G 2360/16* (2013.01)

(56) References Cited

U.S. PATENT DOCUMENTS

| | | | | |
|---|---|---|---|---|
| 7,864,172 | B2 | 1/2011 | Miyake et al. | |
| 7,973,745 | B2 | 7/2011 | Mizukoshi et al. | |
| 8,089,428 | B2 | 1/2012 | Yaguchi et al. | |
| 8,159,421 | B2 | 4/2012 | Hwang et al. | |
| 8,194,013 | B2 | 6/2012 | Choi | |
| 8,547,307 | B2 | 10/2013 | Shirouzu et al. | |
| 8,803,869 | B2 | 8/2014 | Kato et al. | |
| 8,941,638 | B2 | 1/2015 | Ebisuno et al. | |
| 8,952,952 | B2 | 2/2015 | Ebisuno et al. | |
| 8,952,953 | B2 | 2/2015 | Ebisuno et al. | |
| 2001/0043168 | A1 | 11/2001 | Koyama et al. | |
| 2002/0180721 | A1 | 12/2002 | Kimura et al. | |
| 2003/0063081 | A1* | 4/2003 | Kimura et al. | 345/211 |
| 2004/0070331 | A1* | 4/2004 | Kuno et al. | 313/495 |
| 2006/0038501 | A1 | 2/2006 | Koyama et al. | |
| 2006/0077137 | A1* | 4/2006 | Kwon | 345/76 |
| 2006/0176253 | A1 | 8/2006 | Yazawa et al. | |
| 2007/0080905 | A1* | 4/2007 | Takahara | 345/76 |
| 2007/0145902 | A1 | 6/2007 | Yaguchi et al. | |
| 2008/0180365 | A1 | 7/2008 | Ozaki | |
| 2008/0186297 | A1 | 8/2008 | Morita | |
| 2008/0266216 | A1* | 10/2008 | Choi | 345/77 |
| 2008/0291135 | A1 | 11/2008 | Kim et al. | |
| 2008/0297055 | A1 | 12/2008 | Miyake et al. | |
| 2009/0026969 | A1* | 1/2009 | Joo | 315/169.3 |
| 2009/0207105 | A1 | 8/2009 | Hwang et al. | |
| 2009/0207106 | A1 | 8/2009 | Mizukoshi et al. | |
| 2009/0303162 | A1 | 12/2009 | Kohno et al. | |
| 2010/0103203 | A1 | 4/2010 | Choi | |
| 2010/0110059 | A1 | 5/2010 | Kang et al. | |
| 2010/0214273 | A1 | 8/2010 | Shirouzu et al. | |
| 2010/0259528 | A1 | 10/2010 | Smith et al. | |
| 2011/0025586 | A1 | 2/2011 | Lee | |
| 2011/0157134 | A1* | 6/2011 | Ogura | 345/211 |
| 2011/0169798 | A1 | 7/2011 | Lee et al. | |
| 2011/0242087 | A1 | 10/2011 | Ebisuno et al. | |
| 2012/0113237 | A1 | 5/2012 | Izawa | |
| 2012/0188221 | A1 | 7/2012 | Izawa et al. | |
| 2012/0327063 | A1 | 12/2012 | Izawa et al. | |
| 2013/0285889 | A1 | 10/2013 | Shirouzu et al. | |

FOREIGN PATENT DOCUMENTS

| | | |
|---|---|---|
| EP | 2284825 | 2/2011 |
| JP | 2003-280590 | 10/2003 |
| JP | 2004-246250 | 9/2004 |
| JP | 2006-065148 | 3/2006 |
| JP | 2006-251602 | 9/2006 |
| JP | 2007-121430 | 5/2007 |
| JP | 2008-268914 | 11/2008 |
| JP | 2008-299019 | 12/2008 |
| JP | 2009-198691 | 9/2009 |
| JP | 2009-294376 | 12/2009 |
| JP | 2010-199501 | 9/2010 |
| KR | 10-2010-0045055 | 5/2010 |
| WO | 98/40871 | 9/1998 |
| WO | 2010/001590 | 1/2010 |
| WO | 2011-086597 | 7/2011 |

OTHER PUBLICATIONS

Search report from PCT/ JP2011/003424, mail date is Sep. 27, 2011.
Search report from PCT/JP2011/003432, mail date is Sep. 27, 2011.
Search report from PCT/JP2011/003979, mail date is Aug. 16, 2011.
Search report from PCT/JP2011/003609, mail date is Sep. 20, 2011.
Search report from PCT/JP2011/003989, mail date is Aug. 9, 2011.
U.S.A. (U.S. Appl. No. 13/157,577) Office action, mail date is Sep. 11, 2013.
Japan Office action, mail date is Nov. 26, 2013.
Extended European Search Report, mailed Jun. 17, 2014, from the European Patent Office (EPO) for the related European Patent Application No. 11846054.2.
Extended European Search Report from the European Patent Office, mailed Oct. 9, 2014, in related European Patent Application No. 11867592.5.
Extended European Search Report from the European Patent Office, mailed Oct. 29, 2014, in related European Patent Application No. 11869299.5.
Office Action, mailed Apr. 1, 2015, in related U.S. Appl. No. 13/768,217.
China Office Action with Search Report (including English language translation of Search Report), mailed Feb. 10, 2015, for related Chinese Patent Application No. 201180004566.6.
Japan Office Action, mailed Mar. 24, 2015, in related Japanese Patent Application No. 2012-502383.
Chinese Office Action, mailed May 28, 2015, in corresponding Chinese Patent Application No. 201180032663.6 (including English language translation of Search Report).
Korean Office Action, mailed Sep. 10, 2015, in related Korean Patent Application No. 10-2010-7016548.

* cited by examiner

| Video data (Gradation) | Required voltage (Red) | Required voltage (Green) | Required voltage (Blue) |
|---|---|---|---|
| 255 | 11.2 | 12.2 | 8.4 |

FIG. 7

| Potential difference value [V] | Voltage drop margin |
|---|---|
| 0.0 | 0.0 |
| 0.2 | 0.2 |
| 0.4 | 0.4 |
| 0.6 | 0.6 |
| ⋮ | ⋮ |
| 3.4 | 3.4 |
| 3.6 | 3.6 |
| ⋮ | ⋮ |
| 5.6 | 5.6 |
| 5.8 | 5.8 |
| 6.0 | 6.0 |

FIG. 13

| Video data (Gradation) | Required voltage (Red) | Required voltage (Green) | Required voltage (Blue) |
|---|---|---|---|
| 0 | 4 | 4.2 | 3.5 |
| 1 | 4.1 | 4.3 | 3.5 |
| 2 | 4.1 | 4.4 | 3.6 |
| 3 | 4.2 | 4.5 | 3.6 |
| ⋮ | ⋮ | ⋮ | ⋮ |
| 176 | 8.3 | 9.6 | 6.7 |
| 177 | 8.5 | 9.9 | 6.9 |
| ⋮ | ⋮ | ⋮ | ⋮ |
| 253 | 10.5 | 11.4 | 8.2 |
| 254 | 10.8 | 11.8 | 8.3 |
| 255 | 11.2 | 12.2 | 8.4 |

DISPLAY DEVICE AND DISPLAY DEVICE DRIVING METHOD FOR CAUSING REDUCTION IN POWER CONSUMPTION

CROSS REFERENCE TO RELATED APPLICATION

This is a continuation application of PCT Patent Application No. PCT/JP2011/003609 filed on Jun. 23, 2011, designating the United States of America. The entire disclosure of the above-identified application, including the specification, drawings and claims are incorporated herein by reference in its entirety.

TECHNICAL FIELD

Devices and methods consistent with one or more exemplary embodiments relate to active-matrix display devices which use current-driven luminescence elements represented by organic electroluminescence (EL) elements and to driving methods thereof, and more particularly to a display device having excellent power consumption reducing effect and to a driving method thereof.

BACKGROUND ART

In general, the luminance of an organic electroluminescence (EL) element is dependent upon the drive current supplied to the element, and the luminance of the luminescence of the element increases in proportion to the drive current. Therefore, the power consumption of displays made up of organic EL elements is determined by the average of display luminance. Specifically, unlike liquid crystal displays, the power consumption of organic EL displays varies significantly depending on the displayed image.

For example, in an organic EL display, the highest power consumption is required when displaying an all-white image, whereas, in the case of a typical natural image, power consumption which is approximately 20 to 40% that for all-white is considered to be sufficient.

However, because power source circuit design and battery capacity entail designing which assumes the case where the power consumption of a display becomes highest, it is necessary to consider power consumption that is 3 to 4 times that for the typical natural image, and thus becoming a hindrance to the lowering of power consumption and the miniaturization of devices.

Consequently, there is conventionally proposed a technique which suppresses power consumption with practically no drop in display luminance, by detecting the peak value of video data and regulating the cathode voltage of the organic EL elements based on such detected data so as to reduce power source voltage (for example, see Patent Literature (PTL) 1).

CITATION LIST

Patent Literature

[PTL 1] Japanese Unexamined Patent Application Publication No. 2006-065148

SUMMARY OF INVENTION

Technical Problem

Now, since an organic EL element is a current-driven element, current flows through a power source wire and a voltage drop which is proportionate to the wire resistance occurs. As such, the power supply voltage to be supplied to the display is set by adding a margin for the amount of voltage rise following a voltage drop.

In the same manner as the previously described power source circuit design and battery capacity, since the margin for the voltage rise is set assuming the case where the power consumption of the display becomes highest, unnecessary power is consumed for typical natural images.

In a small-sized display intended for mobile device use, panel current is small and thus, compared to the voltage to be consumed by luminescence pixels, the margin for the voltage rise is negligibly small. However, when current increases with the enlargement of panels, the voltage drop occurring in the power source wire no longer becomes negligible.

However, in the conventional technique in the above-mentioned PTL 1, although power consumption in each of the pixels can be reduced, the margin for the voltage rise following a voltage drop cannot be reduced. In other words, it is insufficient as a power consumption reducing effect for household large-sized display devices of 30-inches and above.

One or more exemplary embodiments of the present disclosure provide a display device having excellent power consumption reducing effect and a driving method thereof.

Solution to Problem

According to an exemplary embodiment of the present disclosure, a display device includes: a power supplying unit configured to output at least one of a high-side output potential and a low-side output potential; a display unit in which a plurality of pixels are arranged and which receives power supply from the power supplying unit; two or more detecting lines each of which has one end connected to a corresponding one of two or more pixels inside the display unit, and is for transmitting a high-side applied potential or a low-side applied potential that is applied to the corresponding one of the two or more pixels; a relay unit connected to the other end of each of the two or more detecting lines and to one end of one or more output lines which are fewer in number than the two or more detecting lines, and configured to output, to the one or more output lines, at least one applied potential out of the two or more high-side applied potentials or at least one applied potential out of the two or more low-side applied potentials, the high-side and low-side applied potentials being transmitted by the two or more detecting lines; and a regulating unit connected to the relay unit via the one or more output lines and configured to regulate at least one of the high-side output potential and the low-side output potential to be outputted by the power supplying unit, such that any one of the following potential differences reaches a predetermined potential difference: a potential difference between a reference potential and the high-side applied potential outputted by the relay unit; a potential difference between the reference potential and the low-side applied potential outputted by the relay unit; and a potential difference between the high-side applied potential and the low-side applied potential, wherein the display unit and the relay unit are provided on the same substrate.

Advantageous Effects of Invention

According to various exemplary embodiments of the present disclosure, it is possible to realize a display device having excellent power consumption reducing effect and a driving method thereof.

BRIEF DESCRIPTION OF DRAWINGS

These and other objects, advantages and features of the present disclosure will become apparent from the following description thereof taken in conjunction with the accompanying drawings that illustrate general and specific embodiments of the present disclosure. In the Drawings:

FIG. 7 is a chart showing an example of a voltage margin conversion table that is referenced by the voltage margin setting unit;

FIG. 13 is a chart showing an example of a required voltage conversion table provided in a signal processing circuit;

DESCRIPTION OF EMBODIMENT(S)

Figure 1:
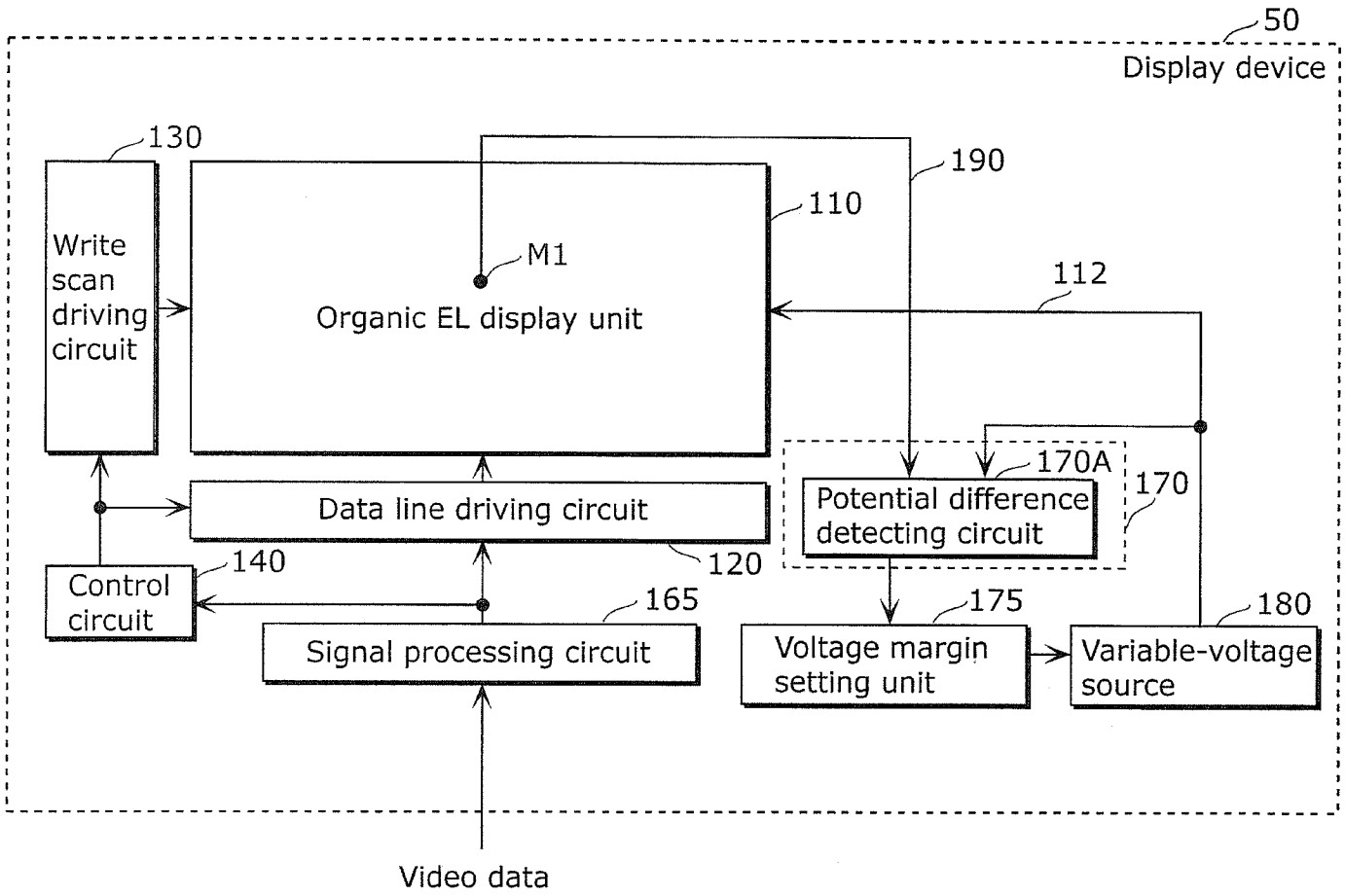
FIG. 1 is a block diagram showing an outline configuration of a display device according to Embodiment 1.

According to an exemplary embodiment of the present disclosure, a display device includes: a power supplying unit configured to output at least one of a high-side output potential and a low-side output potential; a display unit in which a plurality of pixels are arranged and which receives power supply from the power supplying unit; two or more detecting lines each of which has one end connected to a corresponding one of two or more pixels inside the display unit, and is for transmitting a high-side applied potential or a low-side applied potential that is applied to the corresponding one of the two or more pixels; a relay unit connected to the other end of each of the two or more detecting lines and to one end of one or more output lines which are fewer in number than the two or more detecting lines, and configured to output, to the one or more output lines, at least one applied potential out of the two or more high-side applied potentials or at least one applied potential out of the two or more low-side applied potentials, the high-side and low-side applied potentials being transmitted by the two or more detecting lines; and a regulating unit connected to the relay unit via the one or more output lines and configured to regulate at least one of the high-side output potential and the low-side output potential to be outputted by the power supplying unit, such that any one of the following potential differences reaches a predetermined potential difference: a potential difference between a reference potential and the high-side applied potential outputted by the relay unit; a potential difference between the reference potential and the low-side applied potential outputted by the relay unit; and a potential difference between the high-side applied potential and the low-side applied potential, wherein the display unit and the relay unit are provided on the same substrate.

According to this configuration, power consumption reducing effect is high, and a display device that maximizes such effect can be realized.

In this regard, in a configuration which monitors the power source voltage of pixels using detection lines in order to reduce power consumption, increasing the number of the detecting lines to enhance detection accuracy also increases the number of leads (output lines) for leading the detection lines outside the panel, and thus the problem of complicating the structure of the connection between the panel and the substrate outside the panel arises.

In response to this, in a display device according to an aspect, providing a relay unit in the panel in which the display unit is provided allows the number of leads (output lines) for leading the detecting lines outside the panel to be reduced, and thus the structure of the connection between the panel and the substrate outside the panel can be simplified. This produces the advantageous effect of excellent power consumption reducing effect, and realizing a display device that maximizes such effect.

Here, the display device may further include a detecting circuit connected to the other end of each of the one or more output lines and to the regulating unit, wherein the detecting circuit may be configured to detect and select, from among the applied potentials outputted by the relay unit, at least one of a lowest applied potential out of the high-side applied potentials and a highest applied potential out of the low-side applied potentials, and to output the selected at least one applied potential to the regulating unit.

Furthermore, the relay unit may further include, internally, a detecting circuit connected to the other end of each of the one or more output lines, and the detecting circuit may be configured to detect and select, from among the applied potentials transmitted by the two or more detecting lines, at least one of a lowest applied potential out of the high-side applied potentials and a highest applied potential out of the low-side applied potentials, and to output the selected at least one applied potential to the one or more output lines.

Furthermore, the relay unit may be configured to time-divide the applied potentials transmitted by the two or more detecting lines, and sequentially output the time-divided applied potentials to the one or more output lines, and the regulating unit may be configured to regulate at least one of the high-side output potential and the low-side output potential to be outputted by the power supplying unit, such that at least one of the following potential differences reaches the predetermined potential difference: a potential difference between the reference potential and a lowest applied potential out of the high-side applied potentials; and a potential difference between the reference potential and a highest applied potential out of the low-side applied potentials, the high-side and low-side applied potentials being included in the applied potentials outputted by the relay unit.

Furthermore, the relay device may be configured to convert, into digital data, the applied potentials inputted to the relay device as analog data, and output the applied potentials as the digital data.

Furthermore, each of the pixels may include a driver and a luminescence element, the driver may include a source electrode and a drain electrode, the luminescence element may include a first electrode and a second electrode, the first electrode being connected to one of the source electrode and the drain electrode of the driver, the high-side applied potential may be applied to one of the second electrode and the other of the source electrode and the drain electrode, and the low-side applied potential may be applied to the other of the second electrode and the other of the source electrode and the drain electrode.

Furthermore, the second electrode may form part of a common electrode provided in common to the pixels, the common electrode may be electrically connected to the power supplying unit so that a potential is applied to the common electrode from a periphery of the common electrode, and at least a predetermined one of the two or more pixels may be disposed near a center of the display unit.

Accordingly, since regulating is performed based on the potential difference at the location where the voltage drop amount is normally largest such as near the center of the display unit, the high-side output potential of the power supplying unit and the low-side output potential of the power supplying unit can be easily regulated particularly when the size of the display unit is increased.

Furthermore, the second electrode may be made of a transparent conductive material including a metal oxide.

Furthermore, the luminescent element may be an organic electroluminescence (EL) element.

Accordingly, since heat generation can be suppressed through the reduction of power consumption, the deterioration of the organic EL element can be suppressed.

Furthermore, the inventive concept of the present disclosure can be implemented, not only as such a display device, but also as display device driving method having the processing units included in the display device as steps.

A method of driving a display device according to an exemplary embodiment of the present disclosure is a method of driving a display device including a power supplying unit which outputs at least one of a high-side output potential and a low-side output potential, a display device in which a plurality of pixels are arranged and which receives power supply from the power supplying unit, and two or more detecting lines each of which has one end connected to a corresponding one of two or more pixels inside the display unit, and is for transmitting a high-side applied potential or a low-side applied potential applied to the corresponding one of the two or more pixels, the method including: outputting, to one or more output lines, at least one applied potential out of the high-side applied potentials or at least one applied potential out of the low-side applied potentials, the one or more output lines being fewer in number than the two or more detecting lines, and the high-side and low-side applied potentials being transmitted by the two or more detecting lines; and regulating at least one of the high-side output potential and the low-side output potential such that any one of the following potential differences reaches a predetermined potential difference: a potential difference between a reference potential and the high-side applied potential outputted in the outputting; a potential difference between the reference potential and the low-side applied potential outputted in the outputting; and a potential difference between the high-side applied potential and the low-side applied potential.

Hereinafter, certain exemplary embodiments shall be described based on the Drawings. In Embodiments 1 to 5, a configuration by which a display device obtains a power consumption reducing effect shall be described. In Embodiment 6 a configuration by which a display device obtains a maximum power consumption reducing effect shall be described. It is to be noted that descriptions directly related to the Claims are found in Embodiment 6. Furthermore, hereinafter, the same reference numerals are given to the same or corresponding elements in all the figures, and redundant description thereof shall be omitted.

Embodiment 1

In Embodiment 1 of the present disclosure, the case where a display device includes one detection point (M1) connected to a monitor wire (also referred to as a detecting line) as a minimum configuration for obtaining power consumption reducing effect shall be specifically described below using the Drawings.

FIG. 1 is a block diagram showing the schematic configuration of the display device according to this embodiment.

A display device 50 shown in the figure includes an organic electroluminescence (EL) display unit 110, a data line driving circuit 120, a write scan driving circuit 130, a control circuit 140, a signal processing circuit 165, a maximum value detecting circuit 170 including a potential difference detecting circuit 170A, a variable-voltage source 180, and a monitor wire 190.

Figure 2:
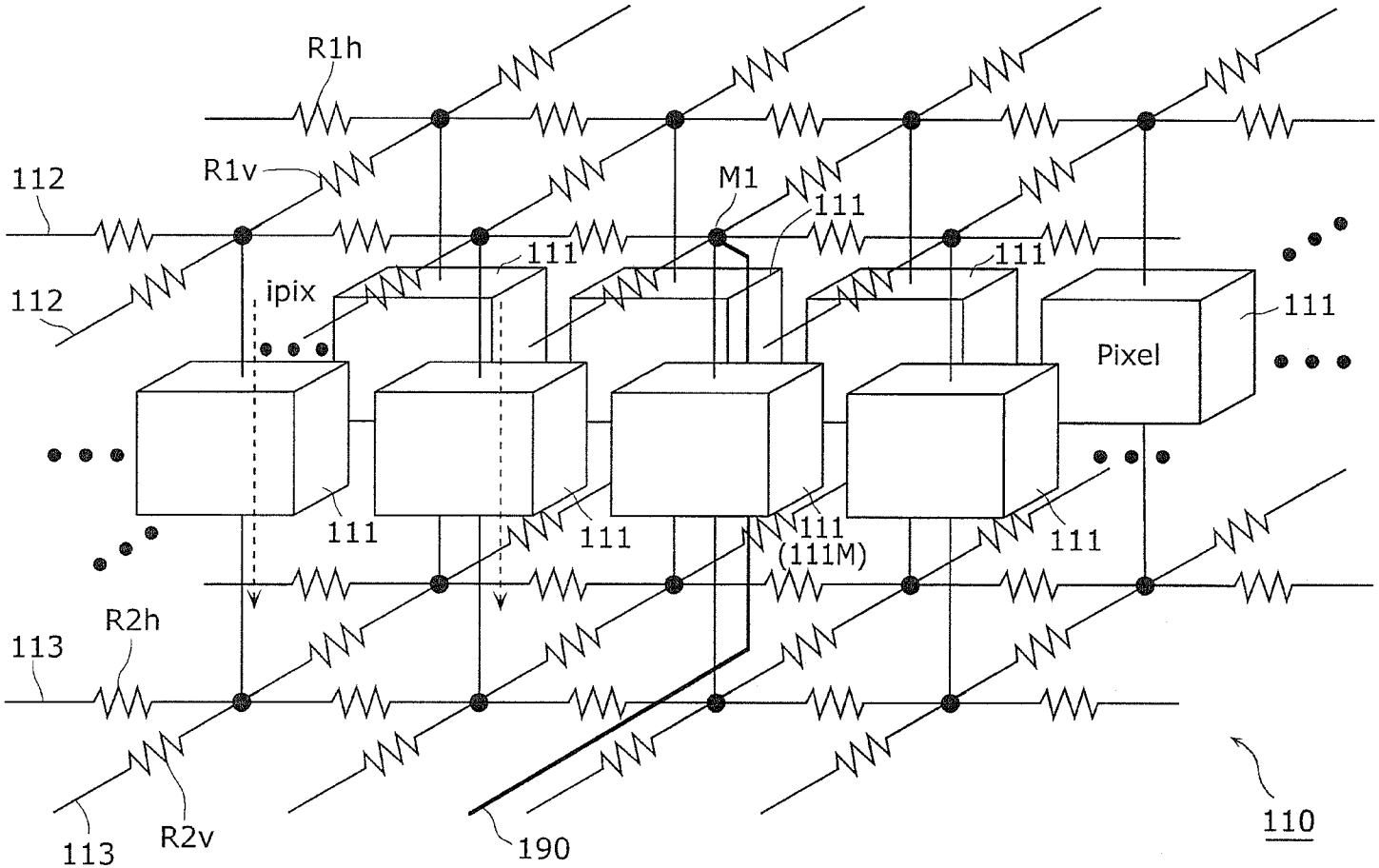
FIG. 2 is a perspective view schematically showing a configuration of an organic EL display unit.

FIG. 2 is a perspective view schematically showing the configuration of the organic EL display unit 110. It is to be noted that the upper portion of the figure is the display screen side.

As shown in the figure, the organic EL display unit 110 includes the pixels 111, the first power source wire 112, and the second power source wire 113.

Each pixel 111 is connected to the first power source wire 112 and the second power source wire 113, and produces luminescence at a luminance that is in accordance with a pixel current ipix that flows to the pixel 111. At least one predetermined pixel out of the pixels 111 is connected to the monitor wire 190 at a detecting point M1. Hereinafter, the pixel 111 that is directly connected to the monitor wire 190 shall be denoted as monitor pixel 111M. The monitor pixel 111M is located near the center of the organic EL display unit 110. It is to be noted that near the center includes the center and the surrounding parts thereof.

The first power source wire 112 is arranged in a net-like manner. On the other hand, the second power source wire 113 is formed in the form of a continuous film on the organic EL display unit 110, and potential outputted by the variable-voltage source 180 is applied to the second power source wire 113 from the periphery of the organic EL display unit 110. In FIG. 2, the first power source wire 112 and the second power source wire 113 are schematically illustrated in mesh-form in order to show the resistance components of the first power source wire 112 and the second power source wire 113. It is to be noted that the second power source wire 113 is, for example, a grounding wire, and may be grounded to a common grounding potential of the display device 100, at the periphery of the organic EL display unit 110.

A horizontal first power source wire resistance R1*h* and a vertical first power source wire resistance R1*v* are present in the first power source wire 112. A horizontal second power source wire resistance R2*h* and a vertical second power source wire resistance R2*v* are present in the second power source wire 113. It is to be noted that, although not illustrated, each of the pixels 111 is connected to the write scan driving circuit 130 and the data line driving circuit 120, and is also connected to a scanning line for controlling the timing at which the pixel produces luminescence and stops producing luminescence, and to a data line for supplying signal voltage corresponding to the luminescence luminance of the pixel 111.

Figure 3:
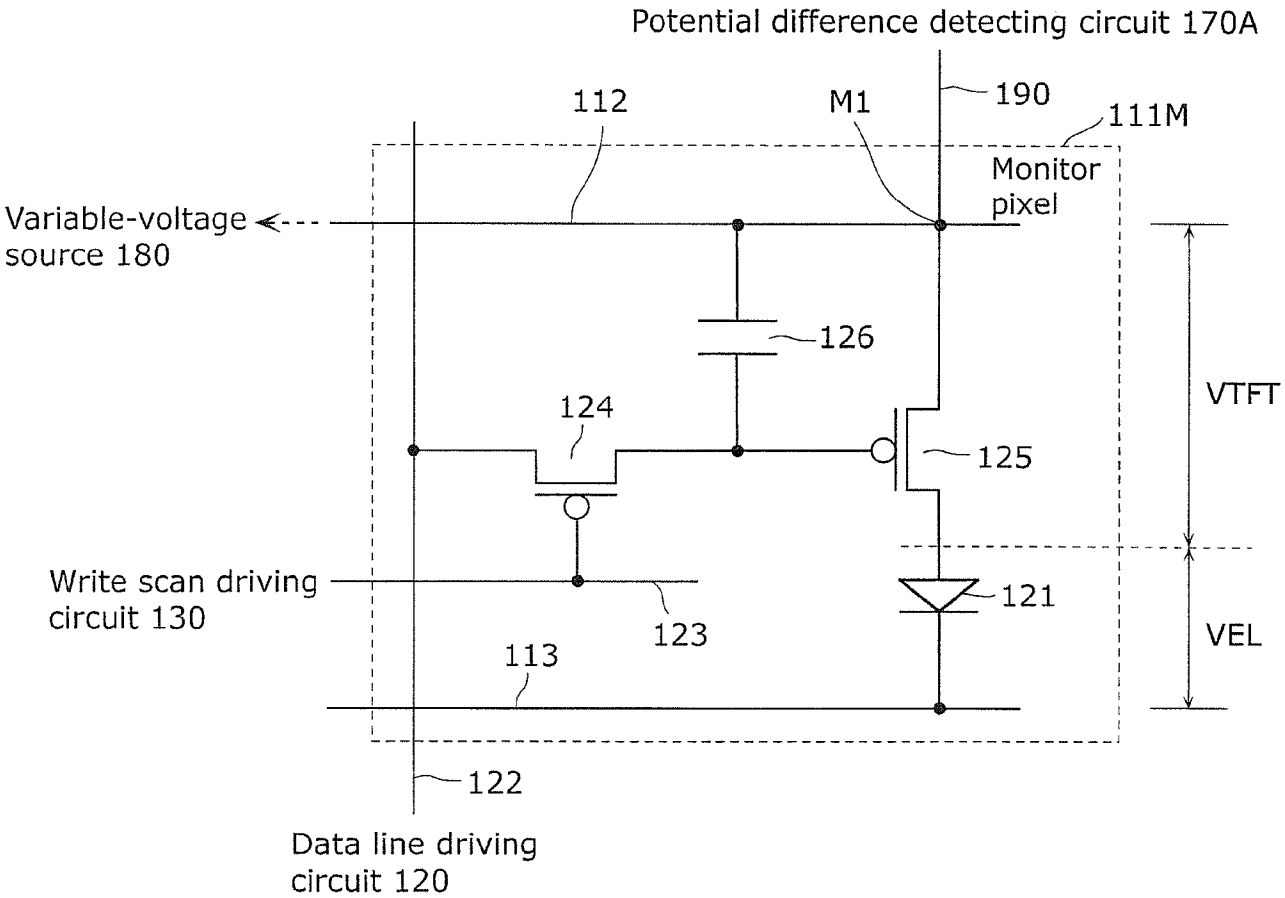
FIG. 3 is a circuit diagram showing an example of a specific configuration of a pixel.

FIG. 3 is a circuit diagram showing an example of a specific configuration of a pixel 111.

The pixel 111 shown in the figure includes a driver and a luminescence element. The driver includes a source electrode and a drain electrode. The luminescence element includes a first electrode and a second electrode. The first electrode is connected to one of the source electrode and the drain electrode of the driver. The high-side potential is applied to one of (i) the other of the source electrode and the drain electrode and (ii) the second electrode, and the low-side potential is applied to the other of (i) the other of the source electrode and the drain electrode and (ii) the second electrode. Specifically, each of the pixels 111 includes an organic EL element 121, a data line 122, a scanning line 123, a switch transistor 124, a driving transistor 125, and a holding capacitor 126. The pixels 111 are, for example, arranged in a matrix (in rows and columns) in the organic EL display unit 110.

The organic EL element 121, which corresponds to the luminescence element, has an anode electrode connected to the drain of the driving transistor 125 and a cathode connected to the second power source wire 113, and produces luminescence with a luminance that is in accordance with the value of the current flowing between the anode electrode and the cathode electrode. The cathode electrode of the organic EL element 121 forms part of a common electrode provided in common to the pixels 111. The common electrode is electrically connected to the variable-voltage source 180 so that potential is applied to the common electrode from the periphery thereof. Specifically, the common electrode functions as the second power source wire 113 in the organic EL display unit 110. Furthermore, the cathode electrode is formed from a transparent conductive material made of a metallic oxide. It is to be noted that the anode electrode of the organic EL element 121 corresponds to the first electrode, and the cathode electrode of the organic EL element 121 corresponds to the second electrode.

The data line 122 is connected to the data line driving circuit 120 and one of the source and the drain of the switch transistor 124, and signal voltage corresponding to the video data is applied to the data line 122 by the data line driving circuit 120.

The scanning line 123 is connected to the write scan driving circuit 130 and the gate of the switch transistor 124, and turns the switching transistor 124 ON and OFF according to the voltage applied by the write scan driving circuit 130.

The switching transistor 124 has one of a source and a drain connected to the data line 122, the other of the source and the drain connected to the gate of the driving transistor 125 and one end of the holding capacitor 126, and is, for example, a P-type thin-film transistor (TFT).

The driving transistor 125, which corresponds to the driver, has a source connected to the first power source wire 112, a drain connected to the anode of the organic EL element 121, a and a gate connected to the one end of the holding capacitor 126 and the other of the source and the drain of the switch transistor 124, and is, for example, a P-type TFT. With this, the driving transistor 125 supplies the organic EL element 121 with current that is in accordance with the voltage held in the holding capacitor 126. Furthermore, in the monitor pixel 111M, the source of the driving transistor 125 is connected to the monitor wire 190.

The holding capacitor 126 has the one end connected to the other of the source and the drain of the switch transistor 124, and the other end connected to the first power source wire 112, and holds the potential difference between the potential of the first power source wire 112 and the potential of the gate of the driving transistor 125 when the switch transistor 124 is turned OFF. Specifically, the holding capacitor 126 holds a voltage corresponding to the signal voltage.

The data line driving circuit 120 outputs a signal voltage corresponding to the video data, to the pixels 111 via the data lines 122.

The write scan driving circuit 130 sequentially scans the pixels 111 by outputting a scanning signal to the scanning lines 123. Specifically, the switch transistors 124 are turned ON and OFF on a row-basis. With this, the signal voltages outputted to the data lines 122 are applied to the pixels 111 in the row selected by the write scan driving circuit 130. Therefore, the pixels 111 produce luminescence with a luminance that is in accordance with the video data.

The control circuit 140 instructs the drive timing to each of the data line driving circuit 120 and the write scan driving circuit 130.

The signal processing circuit 165 outputs, to the data line driving circuit 120, a signal voltage corresponding to the inputted video data.

The voltage margin setting unit 175 regulates, based on a voltage (VEL+VTFT) at a peak gradation level and the potential difference ΔV detected by the potential difference detecting circuit 170A, the variable-voltage source 180 so that the potential of the monitor pixel 111M is set to a predetermined potential. Specifically, the voltage margin setting unit 175 calculates a voltage drop margin Vdrop based on the potential difference detected by the potential difference detecting circuit 170A. Subsequently, the voltage margin setting unit 175 sums up the voltage (VEL+VTFT) at the peak gradation level and the voltage drop margin Vdrop, and outputs the summation result VEL+VTFT+Vdrop, as the potential of a first reference voltage Vref1A, to the variable-voltage source 180.

The potential difference detecting circuit 170A measures a high-side potential applied to the monitor pixel 111M. Specifically, the potential difference detecting circuit 170A measures, via the monitor wire 190, the high-side potential applied to the monitor pixel 111M. Specifically, the potential difference detecting circuit 170A measures the potential at the detecting point M1. In addition, the potential difference detecting circuit 170A measures the high-side output potential of the variable-voltage source 180, and measures the potential difference ΔV between the measured high-side potential applied to the monitor pixel 111M and the high-side output potential of the variable-voltage source 180. Subsequently, the potential difference detecting circuit 170A outputs the measured potential difference ΔV to the voltage margin setting unit 175.

The variable-voltage source 180, which corresponds to the power supplying unit, outputs the high-side potential and the low-side potential to the organic EL display unit 110. The variable-voltage source 180 outputs an output voltage Vout for setting the high-side potential of the monitor pixel 111M to the predetermined potential (VEL+VTFT), according to the first reference voltage Vref1A outputted by the voltage margin setting unit 175.

The monitor wire 190 has one end connected to the monitor pixel 111M and the other end connected to the potential difference detecting circuit 170, and transmits the high-side potential applied to the monitor pixel 111M.

Next, a detailed configuration of the variable-voltage source 180 shall be briefly described.

Figure 4:
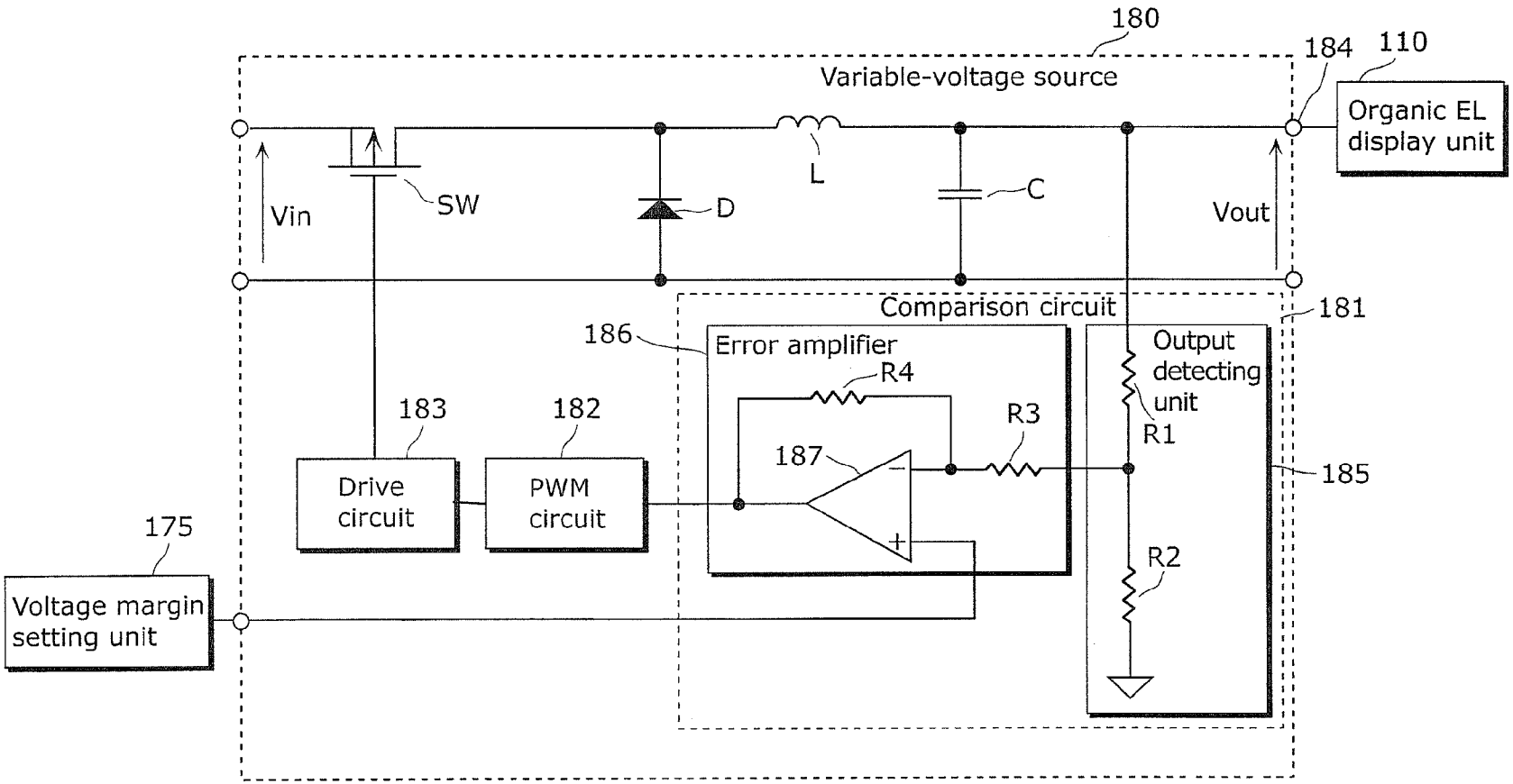
FIG. 4 is a block diagram showing an example of a specific configuration of a variable-voltage source according to Embodiment 1.

FIG. 4 is a block diagram showing an example of a specific configuration of a variable-voltage source according to Embodiment 1. It is to be noted that the organic EL display unit 110 and the voltage margin setting unit 175 which are connected to the variable-voltage source are also shown in the figure.

The variable-voltage source 180 shown in the figure includes a comparison circuit 181, a pulse width modulation (PWM) circuit 182, a drive circuit 183, a switch SW, a diode D, an inductor L, a capacitor C, and an output terminal 184, and converts an input voltage Vin into an output voltage Vout which is in accordance with the first reference voltage Vref1A, and outputs the output voltage Vout from the output terminal 184. It is to be noted that, although not illustrated, an AC-DC converter is provided in a stage ahead of an input terminal to which the input voltage Vin is inputted, and it is assumed that conversion, for example, from 100 V AC to 20 V DC is already carried out.

The comparison circuit 181 includes an output detecting unit 185 and an error amplifier 186, and outputs a voltage that is in accordance with the difference between the output voltage Vout and the first reference voltage Vref1A, to the PWM circuit 182.

The output detecting unit 185, which includes two resistors R1 and R2 provided between the output terminal 184 and a grounding potential, voltage-divides the output voltage Vout in accordance with the resistance ratio between the resistors R1 and R2, and outputs the voltage-divided output voltage Vout to the error amplifier 186.

The error amplifier 186 compares the Vout that has been voltage-divided by the output detection unit 185 and the first reference voltage Vref1A outputted by the voltage margin setting unit 175, and outputs, to the PWM circuit 182, a voltage that is in accordance with the comparison result. Specifically, the error amplifier 186 includes an operational amplifier 187 and resistors R3 and R4. The operational amplifier 187 has an inverting input terminal connected to the output detecting unit 185 via the resistor R3, a non-inverting input terminal connected to the voltage margin setting unit 175, and an output terminal connected to the PWM circuit 182. Furthermore, the output terminal of the operational amplifier 187 is connected to the inverting input terminal via the resistor R4. With this, the error amplifier 186 outputs, to the PWM circuit 182, a voltage that is in accordance with the potential difference between the voltage inputted from the output detecting unit 185 and the first reference voltage Vref1A inputted from the signal processing circuit 165. Stated differently, the error amplifier 186 outputs, to the PWM circuit 182, a voltage that is in accordance with the potential difference between the output voltage Vout and the first reference voltage Vref1A.

The PWM circuit 182 outputs, to the drive circuit 183, pulse waveforms having different duties depending on the voltage outputted by the comparison circuit 181. Specifically, the PWM circuit 182 outputs a pulse waveform having a long ON duty when the voltage outputted by the comparison circuit 181 is large, and outputs a pulse waveform having a short ON duty when the outputted voltage is small. Stated differently, the PWM circuit 182 outputs a pulse waveform having a long ON duty when the potential difference between the output voltage Vout and the first reference voltage Vref1A is big, and outputs a pulse waveform having a short ON duty when the potential difference between the output voltage Vout and the first reference voltage Vref1A is small. It is to be noted that the ON period of a pulse waveform is a period in which the pulse waveform is active.

The drive circuit 183 turns ON the switch SW during the period in which the pulse waveform outputted by the PWM circuit 182 is active, and turns OFF the switch SW during the period in which the pulse waveform outputted by the PWM circuit 182 is inactive.

The switch SW is turned ON and OFF by the drive circuit 183. The input voltage Vin is outputted, as the output voltage Vout, to the output terminal 184 via the inductor L and the capacitor C only while the switch SW is ON. Accordingly, from 0V, the output voltage Vout gradually approaches 20 V (Vin). At this time the inductor L and the capacitor C are charged. Since voltage is applied (charged) to both ends of the inductor L, the output voltage Vout becomes a potential which is lower than the input voltage Vin by such voltage.

As the output voltage Vout approaches the first reference voltage Vref1A, the voltage inputted to the PWM circuit 182 becomes smaller, and the ON duty of the pulse signal outputted by the PWM circuit 182 becomes shorter.

Then, the time in which the switch SW is ON also becomes shorter, and the output voltage Vout gently converges with the first reference voltage Vref1A.

The potential of the output voltage Vout, while having slight voltage fluctuations, eventually settles to a potential in the vicinity of Vout=Vref1.

In this manner, the variable-voltage source 180 generates the output voltage Vout which becomes the first reference voltage Vref1A outputted by the signal processing circuit 165, and supplies the output voltage Vout to the organic EL display unit 110.

Figures 5, 6:
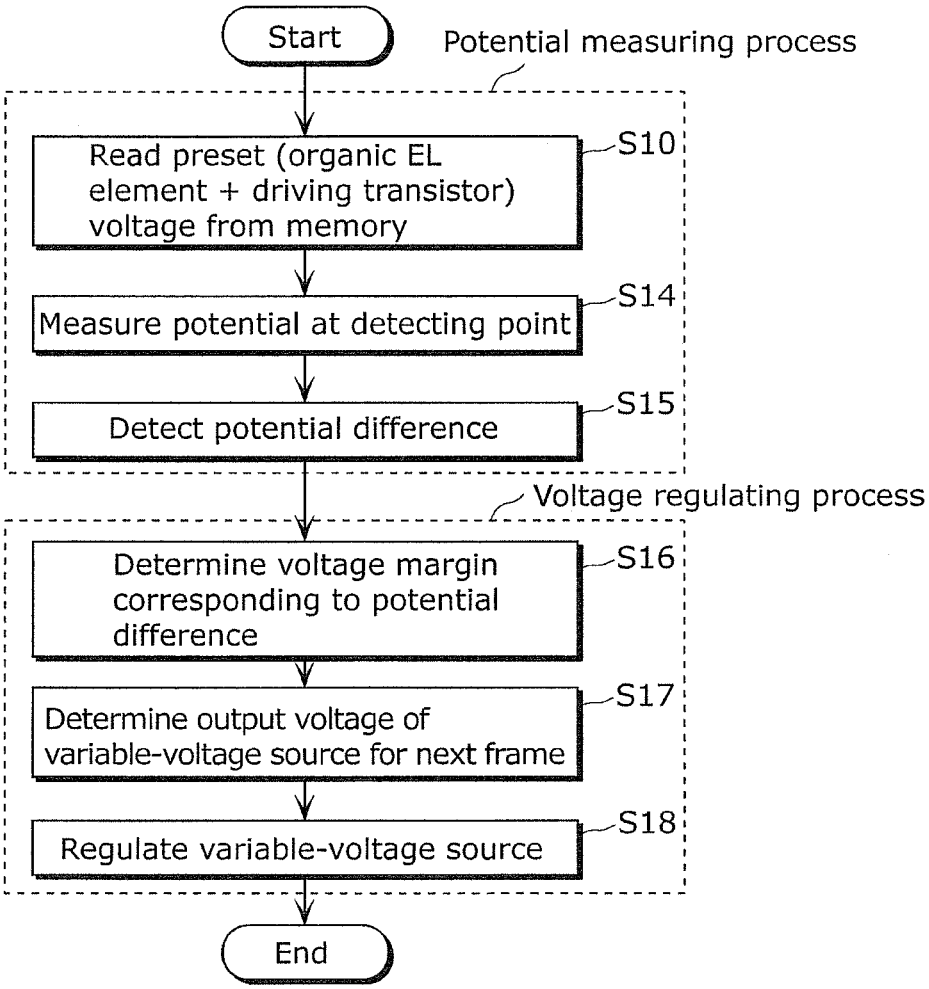
FIG. 5 is a flowchart showing the operation of the display device according to Embodiment 1.
FIG. 6 is a chart showing an example of a required voltage conversion table which is referenced by a voltage margin setting unit.

Next, the operation of the aforementioned display device 50 shall be described using FIG. 5 to FIG. 7.

FIG. 5 is a flowchart showing the operation of the display device 50 according to Embodiment 1.

First, the voltage margin setting unit 175 reads, from a memory, the preset voltage (VEL+VTFT) corresponding to the peak gradation level (step S10). Specifically, the voltage margin setting unit 175 determines the VTFT+VEL corresponding to the gradation levels for each color, using a required voltage conversion table indicating the required voltage VTFT+VEL corresponding to the peak gradation level for each color.

FIG. 6 is a chart showing an example of a required voltage conversion table which is referenced by the voltage margin setting unit 175.

As shown in the figure, required voltages VTFT+VEL respectively corresponding to the peak gradation level (gradation level 255) are stored in the required voltage conversion table. For example, the required voltage at the peak gradation level of R is 11.2 V, the required voltage at the peak gradation level of G is 12.2 V, and the required voltage at the peak gradation level of B is 8.4 V. Among the required voltages at the peak gradation levels of the respective colors, the largest voltage is the 12.2 V of G. Therefore, the voltage margin setting unit 175 determines VTFT+VEL to be 12.2 V.

Meanwhile, the potential difference detecting circuit 170A detects the potential at the detecting point M1 via the monitor wire 190 (step S14).

Next, the potential difference detecting circuit 170A detects the potential difference ΔV between the potential of the output terminal 184 of the variable-voltage source 180 and the potential at the detecting point M1 (step S15). Subsequently, the potential difference detecting circuit 170A outputs the detected potential difference ΔV to the voltage margin setting unit 175.

Next, the voltage margin setting unit 175 determines a voltage drop margin Vdrop corresponding to the potential difference ΔV detected by the potential difference detecting circuit 170A, based on a potential difference signal outputted by the potential difference detecting circuit 170A (step S16). Specifically, the voltage margin setting unit 175 has a voltage margin conversion table indicating the voltage drop margin Vdrop corresponding to the potential difference ΔV.

FIG. 7 is a chart showing an example of the voltage margin conversion table that is referenced by the voltage margin setting unit 175.

As shown in the figure, voltage drop margins Vdrop respectively corresponding to the potential differences ΔV are stored in the voltage margin conversion table. For example, when the potential difference ΔV is 3.4V, the voltage drop margin Vdrop is 3.4V. Therefore, the voltage margin setting unit 175 determines the voltage drop margin Vdrop to be 3.4 V.

Now, as shown in the voltage margin conversion table, the potential difference ΔV and the voltage drop margin Vdrop have an increasing function relationship. Furthermore, the output voltage Vout of the variable-voltage source 180 rises with a bigger voltage drop margin Vdrop. In other words, the potential difference ΔV and the output voltage Vout have an increasing function relationship.

Next, the voltage margin setting unit 175 determines the output voltage Vout that the variable-voltage source 180 is to be made to output in the next frame period (step S17). Specifically, the output voltage Vout that the variable-voltage source 180 is to be made to output in the next frame period is assumed to be VTFT+VEL+Vdrop which is the sum value of (i) VTFT+VEL determined in the determination (step S13) of the voltage required by the organic EL element 121 and the driving transistor 125 and (ii) the voltage drop margin Vdrop determined in the determination (step S15) of the voltage margin corresponding to the potential difference ΔV.

Lastly, the voltage margin setting unit 175 regulates the variable-voltage source 180 by setting the first reference voltage Vref1A as VTFT+VEL+Vdrop at the beginning of the next frame period (step S18). With this, in the next frame period, the variable-voltage source 180 supplies Vout=VTFT+VEL+Vdrop to the organic EL display unit 110.

In this manner, the display device 50 according to this embodiment is configured with the minimum configuration for obtaining a power consumption reducing effect. Specifically, the display device 50 includes: the variable-voltage source 180 which outputs the high-side potential and the low-side potential; the potential difference detecting circuit 170A which measures, for the monitor pixel 111M in the organic EL display unit 110, (i) the high-side potential applied to the monitor pixel 111M and (ii) the high-side potential output voltage Vout of the variable-voltage source 180; and the voltage margin setting unit 175 which regulates the variable-voltage source 180 so as to set, to the predetermined potential (VTFT+VEL), the high-side potential that is applied to the monitor pixel 111M that is measured by the potential difference detecting circuit 170A. Furthermore, the potential difference detecting circuit 170A, in addition, measures the high-side potential output voltage Vout of the variable-voltage source 180, detects the potential difference between the measured high-side potential output voltage Vout and the high-side potential applied to the monitor pixel 111M. The voltage margin setting unit 175 regulates the variable-voltage source 180 in accordance with the potential difference detected by the potential difference detecting circuit 170A.

With this, the display device 50 can reduce excess voltage and reduce power consumption by detecting the voltage drop caused by the horizontal first power source wire resistance R1*h* and a vertical first power source wire resistance R1*v* and giving feedback to the variable-voltage source 180 regarding the degree of such voltage drop.

Furthermore, in the display device 50, the monitor pixel 111M is located near the center of the organic EL display unit 110, and thus the output voltage Vout of the variable-voltage source 180 can be easily regulated even when the size of the organic EL display unit 110 is increased.

Furthermore, since heat generation by the organic EL element 121 is suppressed through the reduction of power consumption, the deterioration of the organic EL element 121 can be prevented.

Next, the display pattern transition in the case where the video data inputted up to the Nth frame changes from the N+1th frame onward, in the display device 50 described above, shall be described using FIG. 8 and FIG. 9.

Initially, the video data that is assumed to have been inputted in the Nth frame and the N+1th frame shall be described.

First, it is assumed that, up to the Nth frame, the video data corresponding to the central part of the organic EL display unit 110 is a peak gradation level (R:G:B=255:255:255) in which the central part of the organic EL display unit 110 is seen as being white. On the other hand, it is assumed that the video data corresponding to a part of the organic EL display unit 110 other than the central part is a gray gradation level (R:G:B=50:50:50) in which the part of the organic EL display unit 110 other than the central part is seen as being gray.

Furthermore, from the N+1th frame onward, it is assumed that the video data corresponding to the central part of the organic EL display unit 110 is the peak gradation level (R:G:B=255:255:255) as in the Nth frame. On the other hand, it is assumed that the video data corresponding to the part of the organic EL display unit 110 other than the central part is a gray gradation level (R:G:B=150:150:150) that can be seen as a brighter gray than in the Nth frame.

Next, the operation of the display device 50 in the case where video data as described above is inputted in the Nth frame and the N+1th frame shall be described.

Figure 8:
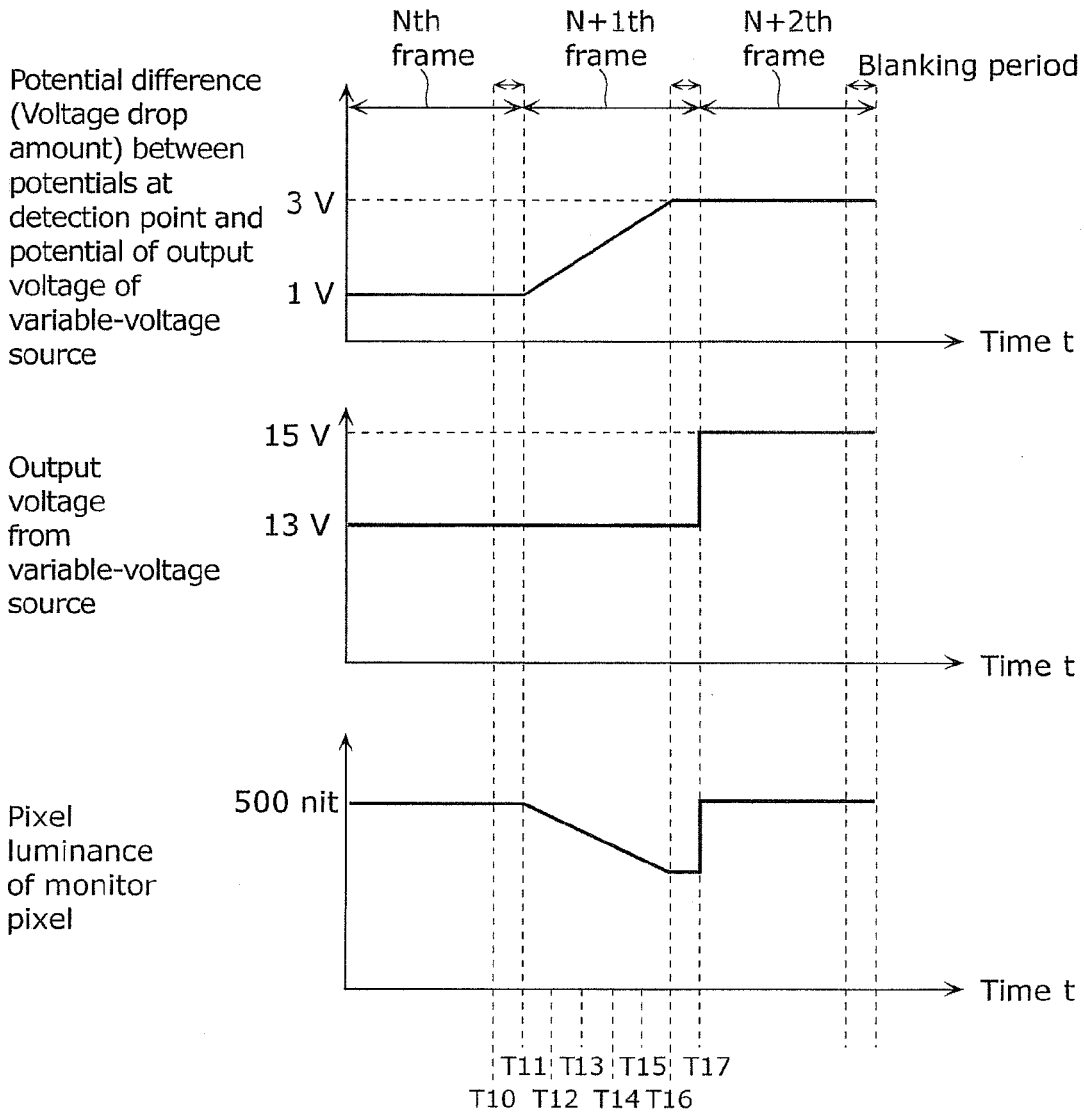
FIG. 8 is a timing chart showing the operation of the display device from an Nth frame to an N+2th frame.

FIG. 8 is a timing chart showing the operation of the display device 50 from the Nth frame to the N+2th frame.

The figure shows the potential difference ΔV detected by the potential difference detecting circuit 170A, the output voltage Vout from the variable-voltage source 180, and the pixel luminance of the monitor pixel 111M. Furthermore, a blanking period is provided at the end of each frame period.

Figure 9:
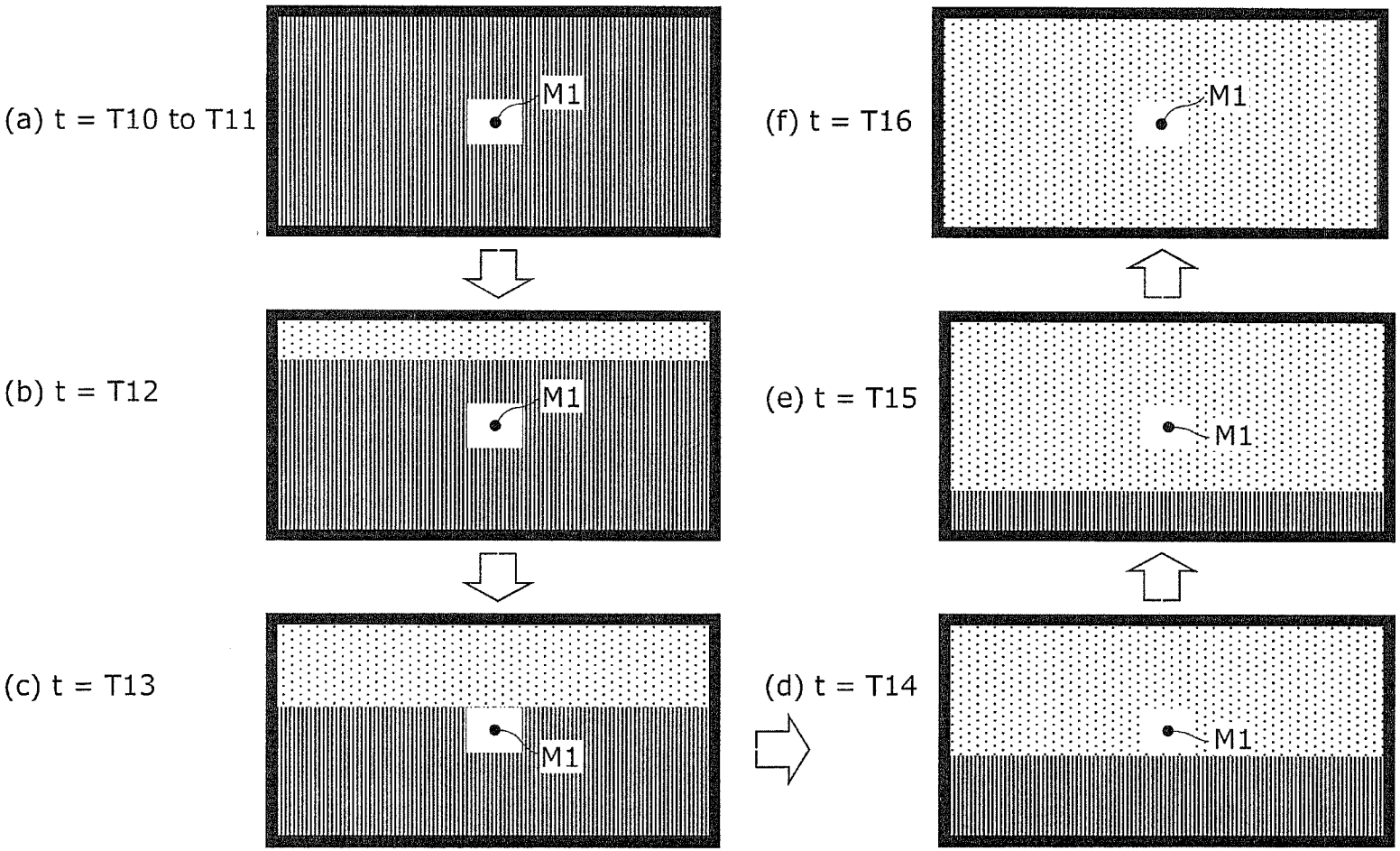
FIG. 9 is diagram schematically showing images displayed on the organic EL display unit.

FIG. 9 is diagram schematically showing images displayed on the organic EL display unit.

In a time t=T10, the signal processing circuit 165 receives input of the video data of the Nth frame. The voltage margin setting unit 175 uses the required voltage conversion table and sets the 12.2 V required voltage at the peak gradation level of G to the voltage (VTFT+VEL).

Meanwhile, the potential difference detecting circuit 170A detects the potential at the detecting point M1 via the monitor wire 190, and detects the potential difference ΔV between the detected potential and the output voltage Vout outputted by the variable-voltage source 180. For example, in time t=T10, the potential difference detecting circuit 170 detects ΔV=1V. Subsequently, the signal processing circuit 160 uses the voltage margin conversion table and determines the voltage drop margin Vdrop for the N+1th frame to be 1 V.

A time t=T10 to T11 is the blanking period of the Nth frame. In this period, an image which is the same as that in the time t=T10 is displayed in the organic EL display unit 110.

(a) in FIG. 9 schematically shows an image displayed on the organic EL display unit 110 in time t=T10 to T11. In this period, the image displayed on the organic EL display unit 110 corresponds to the image data of the Nth frame, and thus the central part is white and the part other than the central part is gray.

In time t=T11, the voltage margin setting unit 175 sets the voltage of the first reference voltage Vref1A as the sum VTFT+VEL+Vdrop (for example, 13.2 V) of the aforementioned voltage (VTFT+VEL) and the voltage drop margin Vdrop.

Over a time t=T11 to T16, the image corresponding to the video data of the N+1th frame is gradually displayed on the organic EL display unit 110 ((b) to (f) in FIG. 9). At this time, the output voltage Vout from the variable-voltage source 180 is, at all times, the VTFT+VEL+Vdrop that is set to the voltage of the first reference voltage Vref1A in the time t=T11. However, the video data corresponding to the part of the organic EL display unit 110 other than the central part is a gray gradation level that can be seen as a gray that is brighter than that in the Nth frame. Therefore, the amount of current supplied by the variable-voltage source 180 to the organic EL display unit 110 gradually increases over a time t=T11 to T16, and the voltage drop in the first power source wire 112 gradually increases following this increase in the amount of current. With this, there is a shortage of power source voltage for the pixels 111 in the central part of the organic EL display unit 110, which are the pixels 111 in a brightly displayed region. Stated differently, luminance drops below the image corresponding to the video data R:G:B=255:255:255 of the N+1th frame. Specifically, over the time t=T11 to T16, the luminescence luminance of the pixels 111 at the central part of the organic EL display unit 110 gradually drops.

Next, in a time t=T16, the signal processing circuit 165 receives input of the video data of the N+1th frame. The voltage margin setting unit 175 uses the required voltage conversion table and continues to set the 12.2 V required voltage at the peak gradation level of G to the voltage (VTFT+VEL).

Meanwhile, the potential difference detecting circuit 170A detects the potential at the detecting point M1 via the monitor wire 190, and detects the potential difference ΔV between the detected potential and the output voltage Vout outputted by the variable-voltage source 180. For example, in time t=T16, the potential difference detecting circuit 170A detects ΔV=3V. Subsequently, the signal processing circuit 160 uses the voltage margin conversion table and determines the voltage drop margin Vdrop for the N+1th frame to be 3V.

Next, in time t=T17, the voltage margin setting unit 175 sets the voltage of the first reference voltage Vref1A to the sum VTFT+VEL+Vdrop (for example, 15.2 V) of the aforementioned voltage (VTFT+VEL) and the voltage drop margin Vdrop. Therefore, from time t=T17 onward, the potential at the detecting point M1 becomes VTFT+VEL which is the predetermined potential.

In this manner, in the display device 50, although luminance temporarily drops in the N+1th frame, this is a very short period and thus has practically no impact on the user.

Embodiment 2

Compared to the display device according to Embodiment 1, a display device according to this embodiment is different in that the reference voltage that is inputted to a variable-voltage source not only changes depending on a change in the potential difference ΔV detected by a potential difference detecting circuit, but also changes depending on a peak signal detected, for each frame, from the inputted video data. Hereinafter, description shall not be repeated for points which are the same as in Embodiment 1 and shall be centered on the points of difference from Embodiment 1. Furthermore, the figures applied to Embodiment 1 shall be used for figures that would otherwise overlap with those in Embodiment 1.

In Embodiment 2 of the present disclosure, the case where a display device includes one detection point (M1) connected to a monitor wire (also referred to as a detecting line) as a minimum configuration for obtaining power consumption reducing effect shall be specifically described below using the Drawings.

Figure 10:
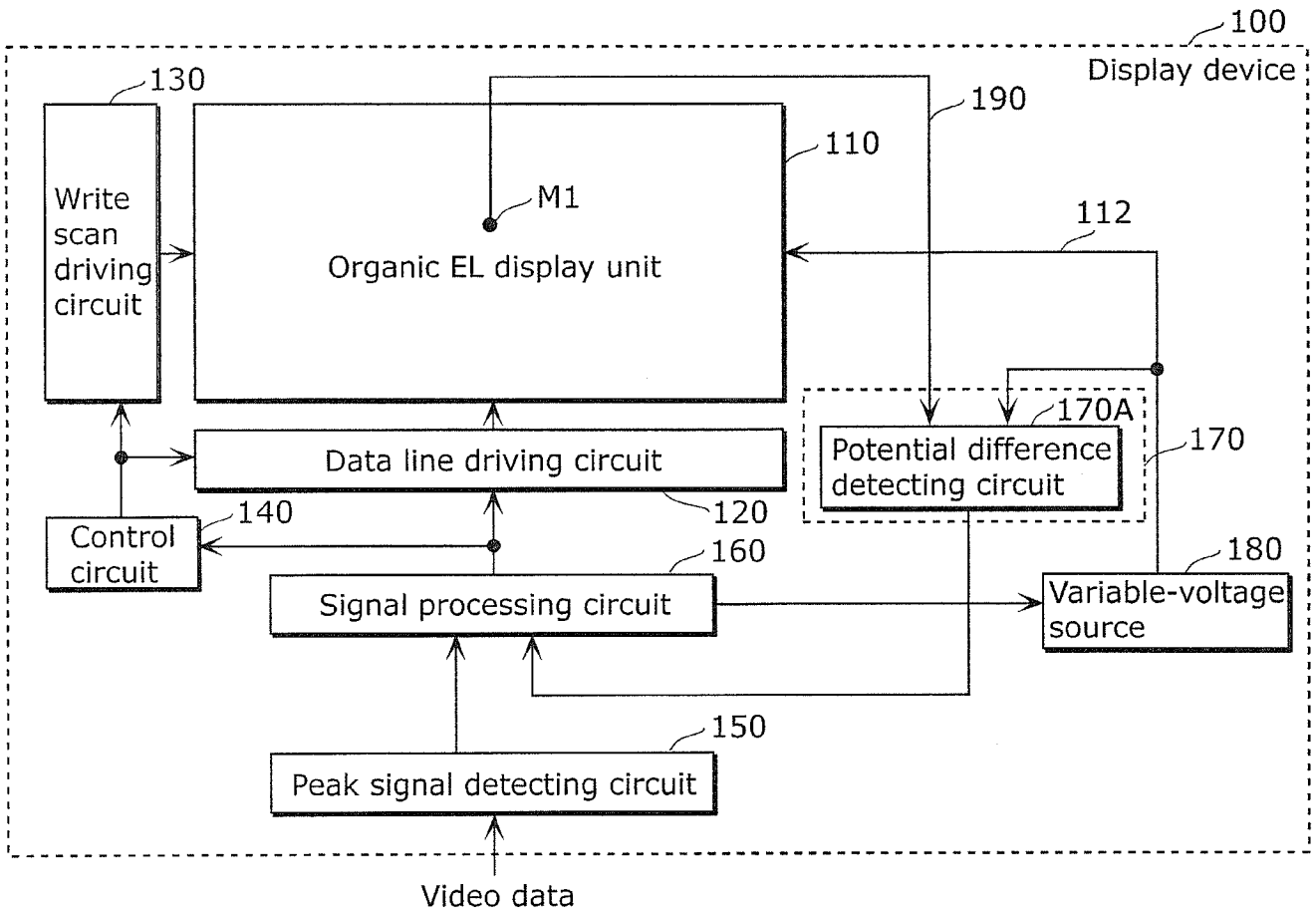
FIG. 10 is a block diagram showing an outline configuration of a display device according to Embodiment 2.

FIG. 10 is a block diagram showing the schematic configuration of the display device according to this embodiment.

A display device 100 shown in the figure includes the organic electroluminescence (EL) display unit 110, the data line driving circuit 120, the write scan driving circuit 130, the control circuit 140, the peak signal detecting circuit 150, the signal processing circuit 160, the maximum value detecting circuit 170 including the potential difference detecting circuit 170A, the variable-voltage source 180, and the monitor wire 190.

The configuration of the organic EL display unit 110 is the same as that shown in FIG. 2 and FIG. 3 in Embodiment 1.

The peak signal detecting circuit 150 detects the peak value of the video data inputted to the display device 100, and outputs a peak signal representing the detected peak value to the signal processing circuit 160. Specifically, the peak signal detecting circuit 150 detects, as the peak value, data of the highest gradation level out of the video data. High gradation level data corresponds to an image that is to be displayed brightly by the organic EL display unit 110.

The signal processing circuit 160 regulates the variable-voltage source 180 so that the potential of the monitor pixel 111M is set to a predetermined potential, based on the peak signal outputted by the peak signal detecting circuit 150 and a potential difference ΔV detected by the potential difference detecting circuit 170A. Specifically, the signal processing circuit 160 determines the voltage required by the organic EL element 121 and the driving transistor 125 when causing the pixels 111 to produce luminescence according to the peak signal outputted by the peak signal detecting circuit 150. Furthermore, the signal processing circuit 160 calculates a voltage margin based on the potential difference detected by the potential difference detecting circuit 170A. Subsequently, the signal processing circuit 160 sums up a voltage VEL required by the organic EL element 121, a voltage VTFT required by the driving transistor 125, and the voltage drop margin Vdrop, and outputs the summation result VEL+VTFT+Vdrop, as the potential of a first reference voltage Vref1, to the variable-voltage source 180.

Furthermore, the signal processing circuit 160 outputs, to the data line driving circuit 120, a signal voltage corresponding to the video data inputted via the peak signal detecting circuit 150.

The potential difference detecting circuit 170A measures a high-side potential applied to the monitor pixel 111M. Specifically, the potential difference detecting circuit 170A measures, via the monitor wire 190, the high-side potential applied to the monitor pixel 111M. Specifically, the potential difference detecting circuit 170A measures the potential at the detecting point M1. In addition, the potential difference detecting circuit 170A measures the high-side output potential of the variable-voltage source 180, and measures the potential difference ΔV between the measured high-side potential applied to the monitor pixel 111M and the high-side output potential of the variable-voltage source 180. Subsequently, the potential difference detecting circuit 170A outputs the measured potential difference ΔV to the signal processing circuit 160.

The variable-voltage source 180, which corresponds to the power supplying unit, outputs the high-side potential and the low-side potential to the organic EL display unit 110. The variable-voltage source 180 outputs an output voltage Vout for setting the high-side potential of the monitor pixel 111M to the predetermined potential (VEL+VTFT), according to the first reference voltage Vref1 outputted by the signal processing circuit 160

The monitor wire 190 has one end connected to the monitor pixel 111M and the other end connected to the potential difference detecting circuit 170, and transmits the high-side potential applied to the monitor pixel 111M.

Next, a detailed configuration of the variable-voltage source 180 shall be briefly described.

Figure 11:
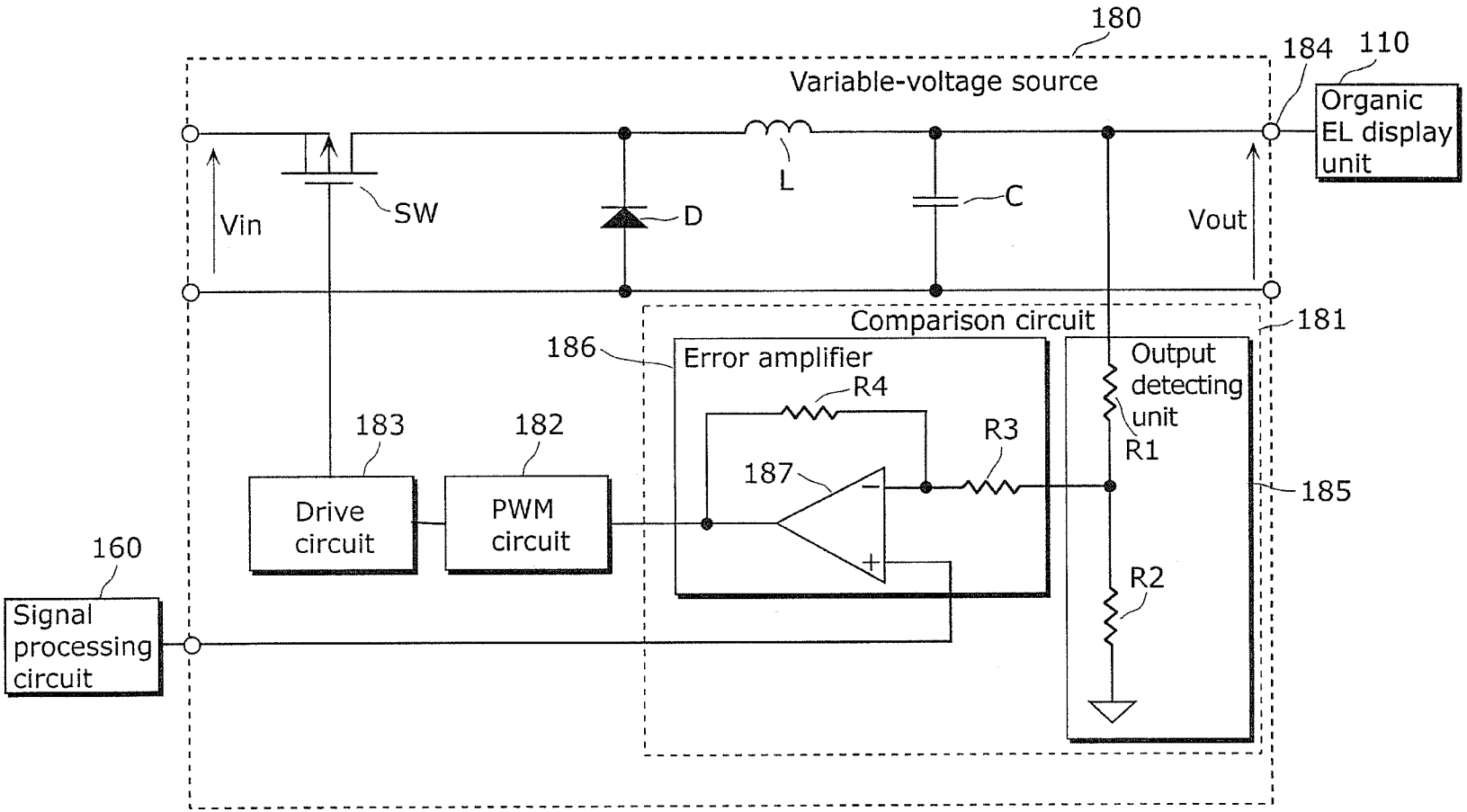
FIG. 11 is a block diagram showing an example of a specific configuration of a variable-voltage source according to Embodiment 2.

FIG. 11 is a block diagram showing an example of a specific configuration of a variable-voltage source according to Embodiment 2. It is to be noted that the organic EL display unit 110 and the signal processing circuit 160 which are connected to the variable-voltage source are also shown in the figure.

The variable-voltage source 180 shown in the figure is the same as the variable-voltage source 180 described in Embodiment 1.

The error amplifier 186 compares the Vout that has been voltage-divided by the output detection unit 185 and the first reference voltage Vref1 outputted by the signal processing circuit 160, and outputs, to the PWM circuit 182, a voltage that is in accordance with the comparison result. Specifically, the error amplifier 186 includes an operational amplifier 187 and resistors R3 and R4. The operational amplifier 187 has an inverting input terminal connected to the output detecting unit 185 via the resistor R3, a non-inverting input terminal connected to the signal processing circuit 160, and an output terminal connected to the PWM circuit 182. Furthermore, the output terminal of the operational amplifier 187 is connected to the inverting input terminal via the resistor R4. With this, the error amplifier 186 outputs, to the PWM circuit 182, a voltage that is in accordance with the potential difference between the voltage inputted from the output detecting unit 185 and the first reference voltage Vref1 inputted from the signal processing circuit 160. Stated differently, the error amplifier 186 outputs, to the PWM circuit 182, a voltage that is in accordance with the potential difference between the output voltage Vout and the first reference voltage Vref1.

The PWM circuit 182 outputs, to the drive circuit 183, pulse waveforms having different duties depending on the voltage outputted by the comparison circuit 181. Specifically, the PWM circuit 182 outputs a pulse waveform having a long ON duty when the voltage outputted by the comparison circuit 181 is large, and outputs a pulse waveform having a short ON duty when the outputted voltage is small. Stated differently, the PWM circuit 182 outputs a pulse waveform having a long ON duty when the potential difference between the output voltage Vout and the first reference voltage Vref1 is big, and outputs a pulse waveform having a short ON duty when the potential difference between the output voltage Vout and the first reference voltage Vref1 is small. It is to be noted that the ON period of a pulse waveform is a period in which the pulse waveform is active.

As the output voltage Vout approaches the first reference voltage Vref1, the voltage inputted to the PWM circuit 182 decreases, and the ON duty of the pulse signal outputted by the PWM circuit 182 becomes shorter.

Then, the time in which the switch SW is ON becomes shorter, and the output voltage Vout gently converges with the first reference voltage Vref1.

The potential of the output voltage Vout, while having slight voltage fluctuations, eventually settles to a potential in the vicinity of Vout=Vref1.

In this manner, the variable-voltage source 180 generates the output voltage Vout which becomes the first reference voltage Vref1 outputted by the signal processing circuit 160, and supplies the output voltage Vout to the organic EL display unit 110.

Figure 12:
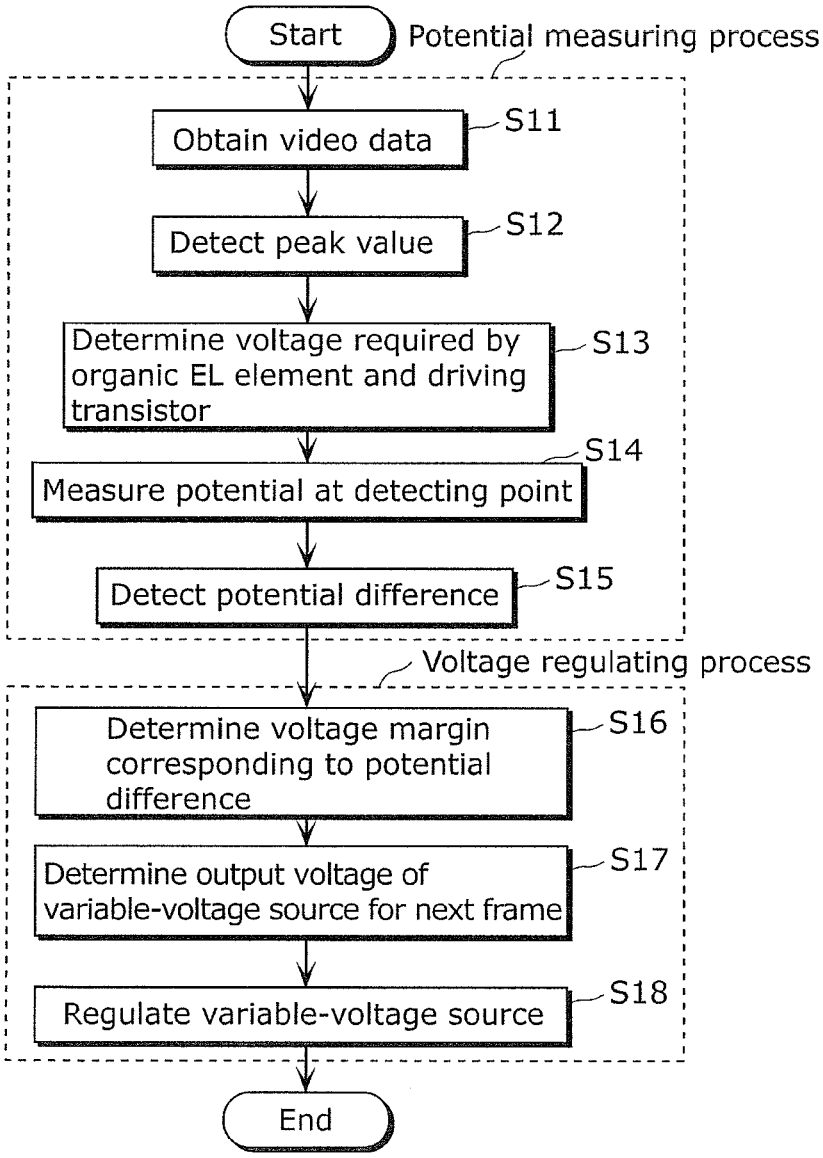
FIG. 12 is a flowchart showing the operation of the display device.

Next, the operation of the aforementioned display device 100 shall be described using FIG. 12, FIG. 13, and FIG. 7.

FIG. 12 is a flowchart showing the operation of the display device 100.

First, the peak signal detecting circuit 150 obtains the video data for one frame period inputted to the display device 100 (step S11). For example, the peak signal detecting circuit 150 includes a buffer and stores the video data for one frame period in such buffer.

Next, the peak signal detecting circuit 150 detects the peak value of the obtained video data (step S12), and outputs a peak signal representing the detected peak value to the signal processing circuit 160. Specifically, the peak signal detecting circuit 150 detects the peak value of the video data for each color. For example, for each of red (R), green (G), and blue (B), the video data is expressed using the 256 gradation levels from 0 to 255 (luminance being higher with a larger value). Here, when part of the video data of the organic EL display unit 110 has R:G:B=177:124:135, another part of the video data of the organic EL display unit 110 has R:G:B=24:177:50, and yet another part of the video data of the organic EL display unit 110 has R:G:B=10:70:176, the peak signal detecting circuit 150 detects 177 as the peak value of R, 177 for the peak value of G, and 176 as the peak value of B, and outputs, to the signal processing circuit 160, a peak signal representing the detected peak value of each color.

Next, the signal processing circuit 160 determines the voltage VTFT required by the driving transistor 125 and the voltage VEL required by the organic EL element 121 when causing the organic EL element 121 to produce luminescence according to the peak values outputted by the peak signal detecting circuit 150 (step S13). Specifically, the signal processing circuit 160 determines the VTFT+VEL corresponding to the gradation levels for each color, using a required voltage conversion table indicating the required voltage VTFT+VEL corresponding to the gradation levels for each color.

FIG. 13 is a chart showing an example of the required voltage conversion table provided in the signal processing circuit 160.

As shown in the figure, required voltages VTFT+VEL respectively corresponding to the gradation levels of each color are stored in the required voltage conversion table. For example, the required voltage corresponding to the peak value 177 of R is 8.5 V, the required voltage corresponding to the peak value 177 of G is 9.9 V, and the required voltage corresponding to the peak value 176 of B is 9.9 V. Among the required voltages corresponding to the peak values of the respective colors, the biggest voltage is 9.9 V corresponding to the peak value of B. Therefore, the signal processing circuit 160 determines VTFT+VEL to be 9.9 V.

Meanwhile, the potential difference detecting circuit 170A detects the potential at the detecting point M1 via the monitor wire 190 (step S14).

Next, the potential difference detecting circuit 170A detects the potential difference ΔV between the potential of the output terminal 184 of the variable-voltage source 180 and the potential at the detecting point M1 (step S15). Subsequently, the potential difference detecting circuit 170A outputs the detected potential difference ΔV to the signal processing circuit 160.

Next, the signal processing circuit 160 determines a voltage drop margin Vdrop corresponding to the potential difference ΔV detected by the potential difference detecting circuit 170A, based on a potential difference signal outputted by the potential difference detecting circuit 170A (step S16). Specifically, the signal processing circuit 160 has a voltage margin conversion table indicating the voltage drop margin Vdrop corresponding to the potential difference ΔV.

As shown in FIG. 7, voltage drop margins Vdrop respectively corresponding to the potential differences ΔV are stored in the voltage margin conversion table. For example, when the potential difference ΔV is 3.4V, the voltage drop margin Vdrop is 3.4V. Therefore, the signal processing circuit 160 determines the voltage drop margin Vdrop to be 3.4V.

Now, as shown in the voltage margin conversion table, the potential difference ΔV and the voltage drop margin Vdrop have an increasing function relationship. Furthermore, the output voltage Vout of the variable-voltage source 180 rises with a bigger voltage drop margin Vdrop. In other words, the potential difference ΔV and the output voltage Vout have an increasing function relationship.

Next, the signal processing circuit 160 determines the output voltage Vout that the variable-voltage source 180 is to be made to output in the next frame period (step S17). Specifically, the output voltage Vout that the variable-voltage source 180 is to be made to output in the next frame period is assumed to be VTFT+VEL+Vdrop which is the sum value of (i) VTFT+VEL determined in the determination (step S13) of the voltage required by the organic EL element 121 and the driving transistor 125 and (ii) the voltage drop margin Vdrop determined in the determination (step S15) of the voltage margin corresponding to the potential difference ΔV.

Lastly, the signal processing circuit 160 regulates the variable-voltage source 180 by setting the first reference voltage Vref1 as VTFT+VEL+Vdrop at the beginning of the next frame period (step S18). With this, in the next frame period, the variable-voltage source 180 supplies Vout=VTFT+VEL+Vdrop to the organic EL display unit 110.

In this manner, the display device 100 according to this embodiment is configured with the minimum configuration for obtaining a power consumption reducing effect. Specifically, the display device 100 includes: the variable-voltage source 180 which outputs the high-side potential and the low-side potential; the potential difference detecting circuit 170A which measures, for the monitor pixel 111M in the organic EL display unit 110, (i) the high-side potential applied to the monitor pixel 111M and (ii) the high-side potential output voltage Vout of the variable-voltage source 180; and the signal processing circuit 160 which regulates the variable-voltage source 180 so as to set, to the predetermined potential (VTFT+VEL), the high-side potential that is applied to the monitor pixel 111M that is measured by the potential difference detecting circuit 170A. Furthermore, the potential difference detecting circuit 170A, in addition, measures the high-side potential output voltage Vout of the variable-voltage source 180, detects the potential difference between the measured high-side potential output voltage Vout and the high-side potential applied to the monitor pixel 111M. The signal processing circuit 160 regulates the variable-voltage source 180 in accordance with the potential difference detected by the potential difference detecting circuit 170A.

With this, the display device 100 can reduce excess voltage and reduce power consumption by detecting the voltage drop caused by the horizontal first power source wire resistance R1*h* and a vertical first power source wire resistance R1*v* and giving feedback to the variable-voltage source 180 regarding the degree of such voltage drop.

Furthermore, in the display device 100, the monitor pixel 111M is located near the center of the organic EL display unit 110, and thus the output voltage Vout of the variable-voltage source 180 can be easily regulated even when the size of the organic EL display unit 110 is increased.

Furthermore, since heat generation by the organic EL element 121 is suppressed through the reduction of power consumption, the deterioration of the organic EL element 121 can be prevented.

Next, the display pattern transition in the case where the video data inputted up to the Nth frame changes from the N+1th frame onward, in the display device 100 described above, shall be described using FIG. 8 and FIG. 9.

Initially, the video data that is assumed to have been inputted in the Nth frame and the N+1th frame shall be described.

First, it is assumed that, up to the Nth frame, the video data corresponding to the central part of the organic EL display unit 110 is a peak gradation level (R:G:B=255:255:255) in which the central part of the organic EL display unit 110 is seen as being white. On the other hand, it is assumed that the video data corresponding to a part of the organic EL display unit 110 other than the central part is a gray gradation level (R:G:B=50:50:50) in which the part of the organic EL display unit 110 other than the central part is seen as being gray.

Furthermore, from the N+1th frame onward, it is assumed that the video data corresponding to the central part of the organic EL display unit 110 is the peak gradation level (R:G:B=255:255:255) as in the Nth frame. On the other hand, it is assumed that the video data corresponding to the part of the organic EL display unit 110 other than the central part is a gray gradation level (R:G:B=150:150:150) that can be seen as a brighter gray than in the Nth frame.

Next, the operation of the display device 100 in the case where video data as described above is inputted in the Nth frame and the N+1th frame shall be described.

FIG. 8 shows the potential difference ΔV detected by the potential difference detecting circuit 170A, the output voltage Vout from the variable-voltage source 180, and the pixel luminance of the monitor pixel 111M. Furthermore, a blanking period is provided at the end of each frame period.

In time t=T10, the peak signal detecting circuit 150 detects the peak value of the video data of the Nth frame. The signal processing circuit 160 determines VTFT+VEL from the peak value detected by the peak signal detecting circuit 150. Here, since the peak value of the video data of the Nth frame is R:G:B=255:255:255, the signal processing circuit 160 uses the required voltage conversion table and determines the required voltage VTFT+VEL for the N+1th frame to be, for example, 12.2V.

Meanwhile, the potential difference detecting circuit 170A detects the potential at the detecting point M1 via the monitor wire 190, and detects the potential difference ΔV between the detected potential and the output voltage Vout outputted by the variable-voltage source 180. For example, in time t=T10, the potential difference detecting circuit 170 detects ΔV=1V. Subsequently, the signal processing circuit 160 uses the voltage margin conversion table and determines the voltage drop margin Vdrop for the N+1th frame to be 1V.

A time t=T10 to T11 is the blanking period of the Nth frame. In this period, an image which is the same as that in the time t=T10 is displayed in the organic EL display unit 110.

(a) in FIG. 9 schematically shows an image displayed on the organic EL display unit 110 in time t=T10 to T11. In this period, the image displayed on the organic EL display unit 110 corresponds to the image data of the Nth frame, and thus the central part is white and the part other than the central part is gray.

In time t=T11, the signal processing circuit 160 sets the potential of the first reference voltage Vref1 as the sum VTFT+VEL+Vdrop (for example, 13.2V) of the determined required voltage VTFT+VEL and the voltage drop margin Vdrop.

Over a time t=T11 to T16, the image corresponding to the video data of the N+1th frame is gradually displayed on the organic EL display unit 110 ((b) to (f) in FIG. 9). At this time, the output voltage Vout from the variable-voltage source 180 is, at all times, the VTFT+VEL+Vdrop set to the voltage of the first reference voltage Vref1 in time t=T11. However, the video data corresponding to the part of the organic EL display unit 110 other than the central part is a gray gradation level that can be seen as a gray that is brighter than that in the Nth frame. Therefore, the amount of current supplied by the variable-voltage source 180 to the organic EL display unit 110 gradually increases over a time T11 to T16, and the voltage drop in the first power source wire 112 gradually increases following this increase in the amount of current. With this, there is a shortage of power source voltage for the pixels 111 in the central part of the organic EL display unit 110, which are the pixels 111 in a brightly displayed region. Stated differently, luminance drops below the image corresponding to the video data R:G:B=255:255:255 of the N+1th frame. Specifically, over the time t=T11 to T16, the luminescence luminance of the pixels 111 at the central part of the organic EL display unit 110 gradually drops.

Next, in time t=T16, the peak signal detecting circuit 150 detects the peak value of the video data of the N+1th frame. Here, since the detected peak value of the video data of the N+1th frame is R:G:B=255:255:255, the signal processing circuit 160 determines the required voltage VTFT+VEL for the N+2th frame to be, for example, 12.2 V.

Meanwhile, the potential difference detecting circuit 170A detects the potential at the detecting point M1 via the monitor wire 190, and detects the potential difference ΔV between the detected potential and the output voltage Vout outputted by the variable-voltage source 180. For example, in time t=T16, the potential difference detecting circuit 170A detects ΔV=3V. Subsequently, the signal processing circuit 160 uses the voltage margin conversion table and determines the voltage drop margin Vdrop for the N+2th frame to be 3V.

Next, in time t=T17, the signal processing circuit 160 sets the voltage of the first reference voltage Vref1 to the sum VTFT+VEL+Vdrop (for example, 15.2V) of the determined required voltage VTFT+VEL and the voltage drop margin Vdrop. Therefore, from time t=T17 onward, the potential at the detecting point M1 becomes VTFT+VEL which is the predetermined potential.

In this manner, in the display device 100, although luminance temporarily drops in the N+1th frame, this is a very short period and thus has practically no impact on the user.

Embodiment 3

In Embodiment 3, an example different from that in Embodiment 1, that is, a different example for the case where a display device includes one detection point (M1) connected to a monitor wire (also referred to as a detecting line) as a minimum configuration for obtaining power consumption reducing effect, shall be described below. A display device according to this embodiment is nearly the same as the display device 100 according to Embodiment 2 but is different in not including the potential difference detecting circuit 170A and in having the potential at the detecting point M1 inputted to the variable-voltage source. Furthermore, the signal processing circuit is different in setting the voltage to be outputted to the variable-voltage source to the required voltage VTFT+VEL. With this, in the display device according to this embodiment, the output voltage Vout of the variable-voltage source can be regulated in real-time in accordance with the voltage drop amount, and thus, compared with Embodiment 1, the temporary drop in pixel luminance can be prevented. This shall be described in detail below using the Drawings.

Figure 14:
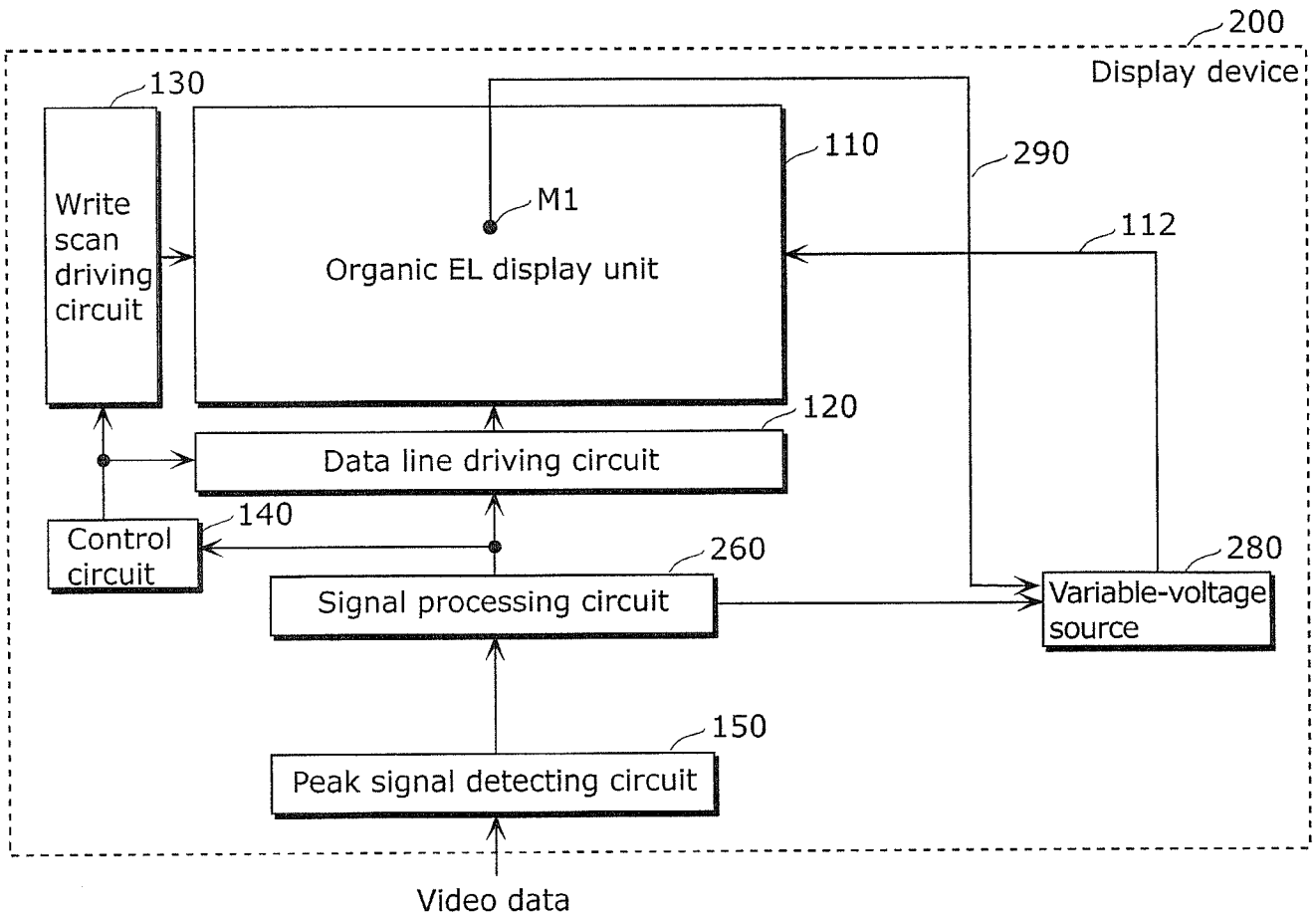
FIG. 14 is a block diagram showing an outline configuration of a display device according to Embodiment 3.

FIG. 14 is a block diagram showing an outline configuration of the display device according to this embodiment.

A display device 200 according to this embodiment shown in the figure is different compared to the display device 100 according to Embodiment 2 shown in FIG. 10 in not including the potential difference detecting circuit 170A, and in including a monitor wire 290 in place of the monitor wire 190, a signal processing circuit 260 in place of the signal processing circuit 160, and a variable-voltage source 280 in place of the variable-voltage source 180.

The signal processing circuit 260 determines a second reference voltage Vref2 to be outputted to the variable-voltage source 280, from the peak signal outputted by the peak signal detecting circuit 150. Specifically, the signal processing circuit 260 uses the required voltage conversion table and determines the sum VTFT+VEL of the voltage VEL required by the organic EL element 121 and the voltage VTFT required by the driving transistor 125. Subsequently, the signal processing circuit 260 sets the determined VTFT+VEL as the voltage of the second reference voltage Vref2.

In such manner, the second reference voltage Vref2 that is outputted to the variable-voltage source 280 by the signal processing circuit 260 of the display device 200 according to this embodiment is different from the first reference voltage Vref1 that is outputted to the variable-voltage source 180 by the signal processing circuit 160 of the display device 100 according to Embodiment 1, and is a voltage determined in accordance with the video data only. Specifically, the second reference voltage Vref2 is not dependent on the potential difference ΔV between the potential of the output voltage Vout of the variable-voltage source 280 and the potential at the detecting point M1.

The variable-voltage source 280 measures the high-side potential applied to the monitor pixel 111M, via the monitor wire 290. Specifically, the variable-voltage source 280 measures the potential at the detecting point M1. Subsequently, the variable-voltage source 280 regulates the output voltage Vout in accordance with the measured potential at the detecting point M1 and the second reference voltage Vref2 outputted by the signal processing circuit 260.

The monitor wire 290 has one end connected to the detecting point M1 and the other end connected to the variable-voltage source 280, and transmits the potential at the detecting point M1 to the variable-voltage source 280.

Figure 15:
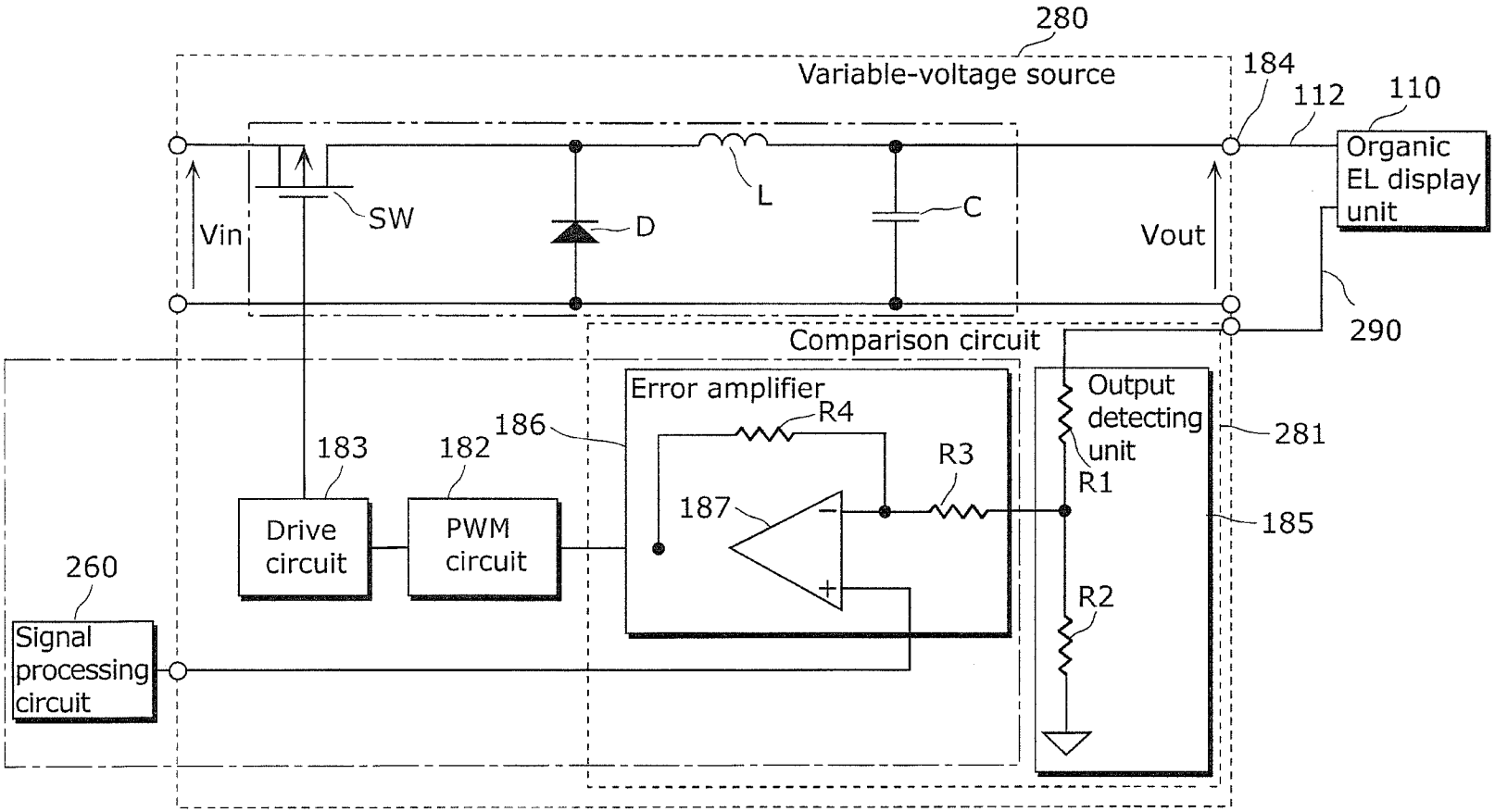
FIG. 15 is a block diagram showing an example of a specific configuration of a variable-voltage source according to Embodiment 3.

FIG. 15 is a block diagram showing an example of a specific configuration of the variable-voltage source 280 in Embodiment 3. It is to be noted that the organic EL display unit 110 and the signal processing circuit 260 which are connected to the variable-voltage source are also shown in the figure.

The variable-voltage source 280 shown in the figure has nearly the same configuration as the variable-voltage source 180 shown in FIG. 11 but is different in including, in place of the comparison circuit 181, a comparison circuit 281 which compares the potential at the detecting point M1 and the potential of the second reference voltage Vref2.

Here, assuming that the output potential of the variable-voltage source 280 is Vout, and the voltage drop amount from the output terminal 184 of the variable-voltage source 280 to the detecting point M1 is ΔV, the potential at the detecting point M1 becomes Vout−ΔV. Specifically, in this embodiment, the comparison circuit 281 compares Vref2 and Vout−ΔV. As described above, since Vref2=VTFT+VEL, it can be said that the comparison circuit 281 is comparing VTFT+VEL and Vout−ΔV.

On the other hand, in Embodiment 2, the comparison circuit 181 compares Vref1 and Vout. As described above, since Vref1=VTFT+VEL+ΔV, it can be said that, in Embodiment 2, the comparison circuit 181 is comparing VTFT+VEL+ΔV and Vout.

Therefore, although the comparison circuit 281 has different comparison subjects as the comparison circuit 181, the comparison result is the same. Specifically, when the voltage drop amount from the output terminal 184 of the variable-voltage source to the detecting point M1 is the same between Embodiment 2 and Embodiment 3, the voltage outputted by the comparison circuit 181 to the PWM circuit and the voltage outputted by the comparison circuit 281 to the PWM circuit are the same. As a result, the output voltage Vout of the variable-voltage source 180 and the output voltage Vout of the variable-voltage source 280 become the same. Furthermore, the potential difference ΔV and the output voltage Vout also have an increasing function relationship in the second embodiment.

Compared to the display device 100 according to Embodiment 1, the display device 200 configured in the above manner can regulate the output voltage Vout in accordance with the potential difference ΔV between the output terminal 184 and the detecting point M1 in real-time. This is because, in the display device 100 according to Embodiment 2, the signal processing circuit 160 changes the first reference voltage Vref1 for a frame only at the beginning of each frame period. In contrast, in the display device 200 according to this embodiment, Vout can be regulated independently of the control by the signal processing circuit 260, by inputting the voltage that is dependent on the ΔV, that is, Vout−ΔV directly to the comparison circuit 281 of the variable-voltage source 280 without passing through the signal processing circuit 260.

Next, the operation of the display device 200 configured in the above manner, in the case where the video data inputted up to the Nth frame changes from the N+1th frame onward, as in Embodiment 2, shall be described. It is to be noted that, as in Embodiment 2, it is assumed that, up to the Nth frame, the inputted video data is R:G:B=255:255:255 for the central part of the organic EL display unit 110 and is R:G:B=50:50:50 for the part other than the central part, and, from the N+1th frame onward, the inputted video data is R:G:B=255:255:255 for the central part of the organic EL display unit 110 and is R:G:B=150:150:150 for the part other than the central part.

Figure 16:
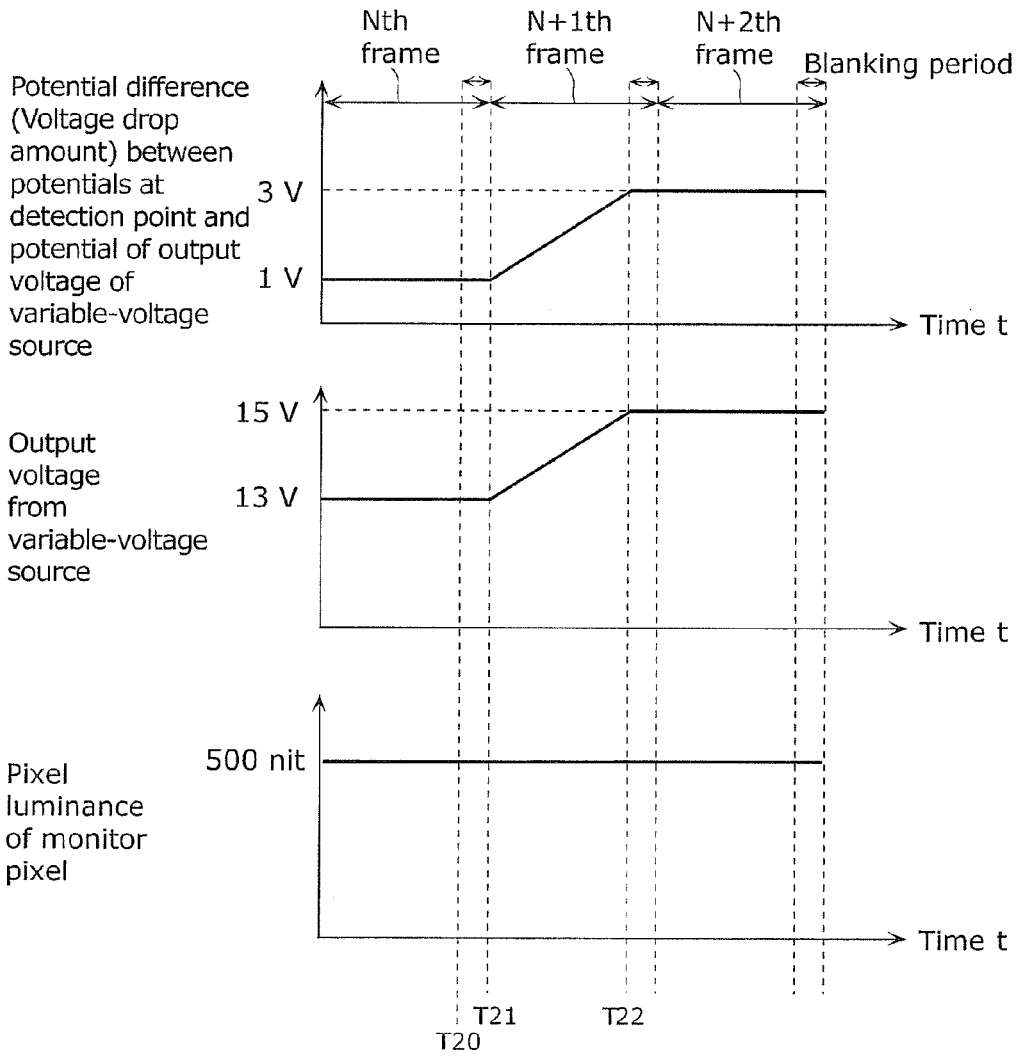
FIG. 16 is a timing chart showing the operation of the display device from an Nth frame to an N+2th frame.

FIG. 16 is a timing chart showing the operation of the display device 200 from the Nth frame to the N+2th frame.

In time t=T20, the peak signal detecting circuit 150 detects the peak value of the video data of the Nth frame. The signal processing circuit 260 determines VTFT+VEL from the peak value detected by the peak signal detecting circuit 150. Here, since the peak value of the video data of the Nth frame is R:G:B=255:255:255, the signal processing circuit 160 uses the required voltage conversion table and determines the required voltage VTFT+VEL for the N+1th frame to be, for example, 12.2V.

Meanwhile, the output detecting unit 185 constantly detects the potential at the detecting point M1, via the monitor wire 290.

Next, in time t=T21, the signal processing circuit 260 sets the voltage of the second reference voltage Vref2 to the determined required voltage VTFT+VEL (for example, 12.2V).

Over a time t=T21 to T22, the image corresponding to the video data of the N+1th frame is gradually displayed on the organic EL display unit 110. At this time, the amount of current supplied by the variable-voltage source 280 to the organic EL display unit 110 gradually increases, as described in Embodiment 2. Therefore, following the increase in the amount of current, the voltage drop in the first power source wire 112 gradually increases. Specifically, the potential at the detecting point M1 gradually drops. Stated differently, the potential difference ΔV between the potential of the output voltage Vout and the potential at the detecting point M1 gradually increases.

Here, since the error amplifier 186 outputs, in real-time, a voltage that is in accordance with the potential difference between VTFT+VEL and Vout−ΔV, the error amplifier 186 outputs a voltage that causes Vout to rise in accordance with the increase in the potential difference ΔV.

Therefore, with the variable-voltage source 280, Vout rises in real-time in accordance with the potential difference ΔV.

This resolves the shortage of power source voltage for the pixels 111 in the central part of the organic EL display unit 110 which are the pixels 111 in the brightly displayed region. In other words, the drop in pixel luminance is resolved.

In this manner, the display device 200 according to this embodiment is configured with the minimum configuration for obtaining a power consumption reducing effect. Specifically, in the display device 200, the signal processing circuit 160, and the error amplifier 186, PWM circuit 182, and drive circuit 183 of the variable-voltage source 280 detect the potential difference between the high-side potential of the monitor pixel 111M that is measured by the output detecting unit 185 and the predetermined potential, and regulate the switch SW in accordance with the detected potential difference. Accordingly, compared with the display device 100 according to Embodiment 2, the display device 200 according to this embodiment is able to regulate the output voltage Vout of the variable-voltage source 280 in real-time in accordance with the voltage drop amount, and thus compared to Embodiment 2, the temporary drop in pixel luminance can be prevented.

It is to be noted that, in this embodiment, the organic EL display unit 110 corresponds to the display unit; the signal processing circuit 260, and the error amplifier 186, PWM circuit 182, and drive circuit 183 of the variable-voltage source 280 which are surrounded by the dashed-and-single-dotted line in FIG. 15 correspond to the voltage regulating unit. The switch SW, the diode D, the inductor L, and the capacitor C which are surrounded by the dashed-and-double-dotted line in FIG. 15 correspond to the power supplying unit.

Embodiment 4

In Embodiment 4 of the present disclosure, the case where a display device includes plural detection points (M1 to M5) each connected to a corresponding monitor wire (also referred to as a detecting line) as a configuration for obtaining power consumption reducing effect shall be specifically described below.

The display device according to this embodiment is nearly the same as the display device 100 according to Embodiment 2 but is different in measuring the high-side potential of each of two or more pixels 111, detecting the potential difference between each of the measured potentials and the potential of the output voltage of the variable-voltage source 180, and regulating the variable-voltage source 180 in accordance with the largest potential difference out of the detection results. With this, the output voltage Vout of the variable-voltage source 180 can be more appropriately regulated. Therefore, power consumption can be effectively reduced even when the size of the organic EL display unit is increased. This shall be described in detail below using the Drawings.

Figure 17:
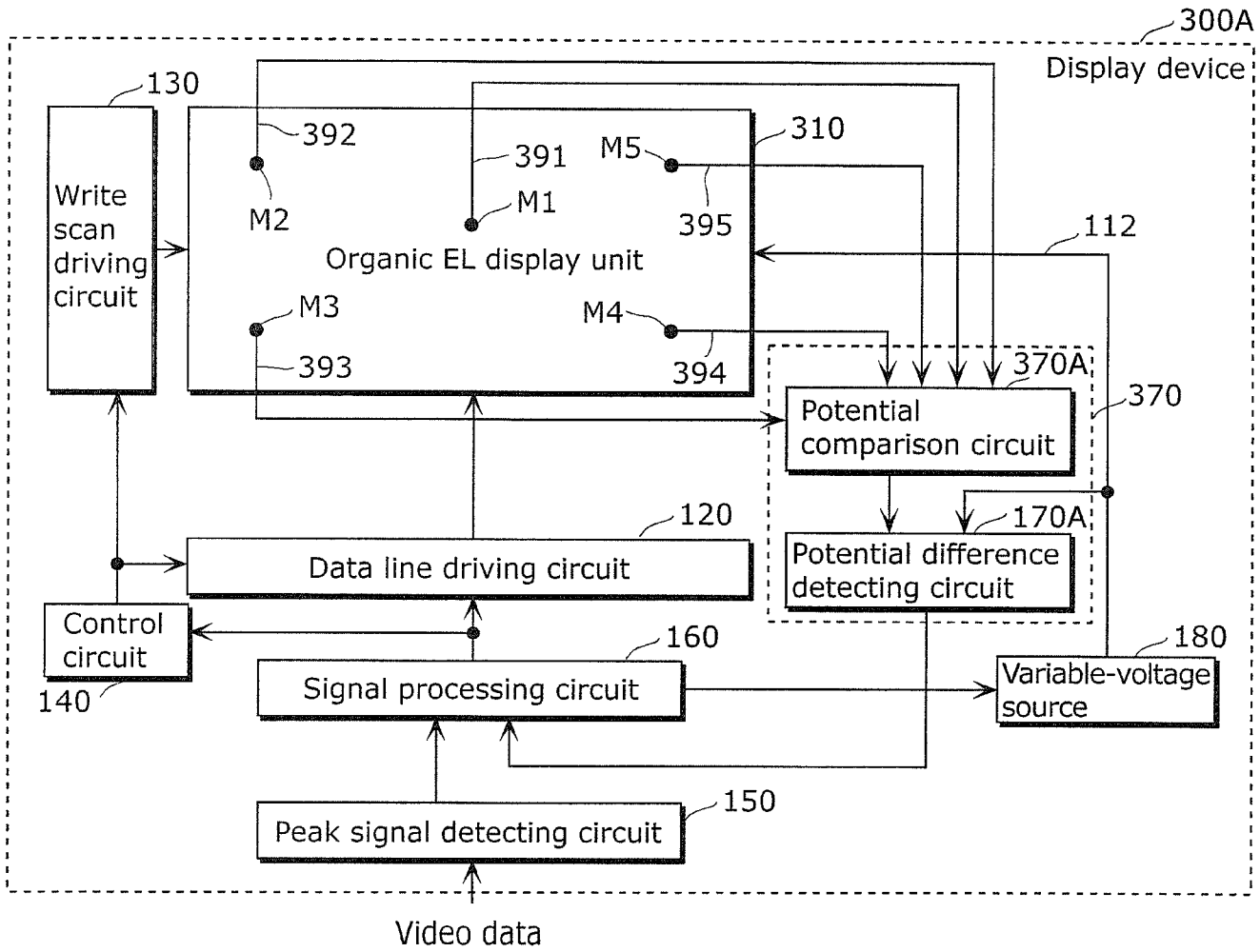
FIG. 17 is a block diagram showing an outline configuration of a display device according to Embodiment 4.

FIG. 17 is a block diagram showing an example of an outline configuration of the display device according to this embodiment.

A display device 300A according to this embodiment shown in the figure is nearly the same as the display device 100 according to Embodiment 2 shown in FIG. 10, but is different compared to the display device 100 in further including a potential comparison circuit 370A, and in including an organic EL display unit 310 in place of the organic EL display unit 110, and monitor wires 391 to 395 in place of the of the monitor wire 190. Here, a maximum value detecting circuit 370 includes the potential comparison circuit 370A and the potential difference detecting circuit 170A.

The organic EL display unit 310 is nearly the same as the organic EL display unit 110 but is different compared to the organic EL display unit 110 in the placement of the monitor wires 391 to 395 which are provided, on a one-to-one correspondence with detecting points M1 to M5, for measuring the potential at the corresponding detecting point.

It is preferable to provide the detecting points M1 to M5 evenly inside the organic EL display unit 310; for example, at the center of the organic EL display unit 310 and at the center of each region obtained by dividing the organic EL display unit 310 into four as shown in FIG. 17. It is to be noted that although the five detecting points M1 to M5 are illustrated in the figure, having even two or three detecting points is sufficient, as long as there are plural detecting points.

Each of the monitor wires 391 to 395 is connected to the corresponding one of the detecting points M1 to M5 and to the potential comparison circuit 370A, and transmits the potential of the corresponding one of the detecting points M1 to M5 to the potential comparison circuit 370A. With this, the potential comparison circuit 370A can measure the potentials at the detecting points M1 to M5 via the monitor wires 391 to 395.

The potential comparison circuit 370A measures the potentials at the detecting points M1 to M5 via the monitor wires 391 to 395. Stated differently, the potential comparison circuit 370A measures the high-side potential applied to plural monitor pixels 111M. In addition, the potential comparison circuit 370A selects the lowest potential among the measured potentials at the detecting points M1 to M5, and outputs the selected potential to the potential difference detecting circuit 170A.

The potential difference detecting circuit 170A, as in Embodiment 2, detects the potential difference ΔV between the inputted potential and the output voltage Vout of the variable-voltage source 180, and outputs the detected potential difference ΔV to the signal processing circuit 160.

Therefore, the signal processing circuit 160 regulates the variable-voltage source 180 based on the potential selected by the potential comparison circuit 370A. As a result, the variable-voltage source 180 outputs, to the organic EL display unit 310, an output voltage Vout with which dropping of luminance does not occur in any of the monitor pixels 111M.

As described above, in the display device 300A according to this embodiment, the potential comparison circuit 370A measures the high-side potential applied to each of the pixels 111 inside the organic EL display unit 310, and selects the lowest potential among the measured potentials of the pixels 111. In addition, the potential difference detecting circuit 170A detects the potential difference ΔV between the lowest potential selected by the potential comparison circuit 370A and the potential of the output voltage Vout of the variable-voltage source 180. Then, the signal processing circuit 160 regulates the variable-voltage source 180 in accordance with the detected potential difference ΔV.

It is to be noted that, in the display device 300A according to this embodiment: the variable-voltage source 180 corresponds to the power supplying unit; the organic EL display unit 310 corresponds to the display unit; one part of the potential comparison circuit 370A, the potential difference detecting circuit 170A, and the signal processing circuit 160 correspond to the voltage regulating unit.

Furthermore, although the potential comparison circuit 370A and the potential difference detecting circuit 170A are provided separately in the display device 300A, a potential comparison circuit which compares the potential of the output voltage Vout of the variable-voltage source 180 and the potential at each of the detecting points M1 to M5 may be provided in place of the potential comparison circuit 370A and the potential difference detecting circuit 170A.

Figure 18:
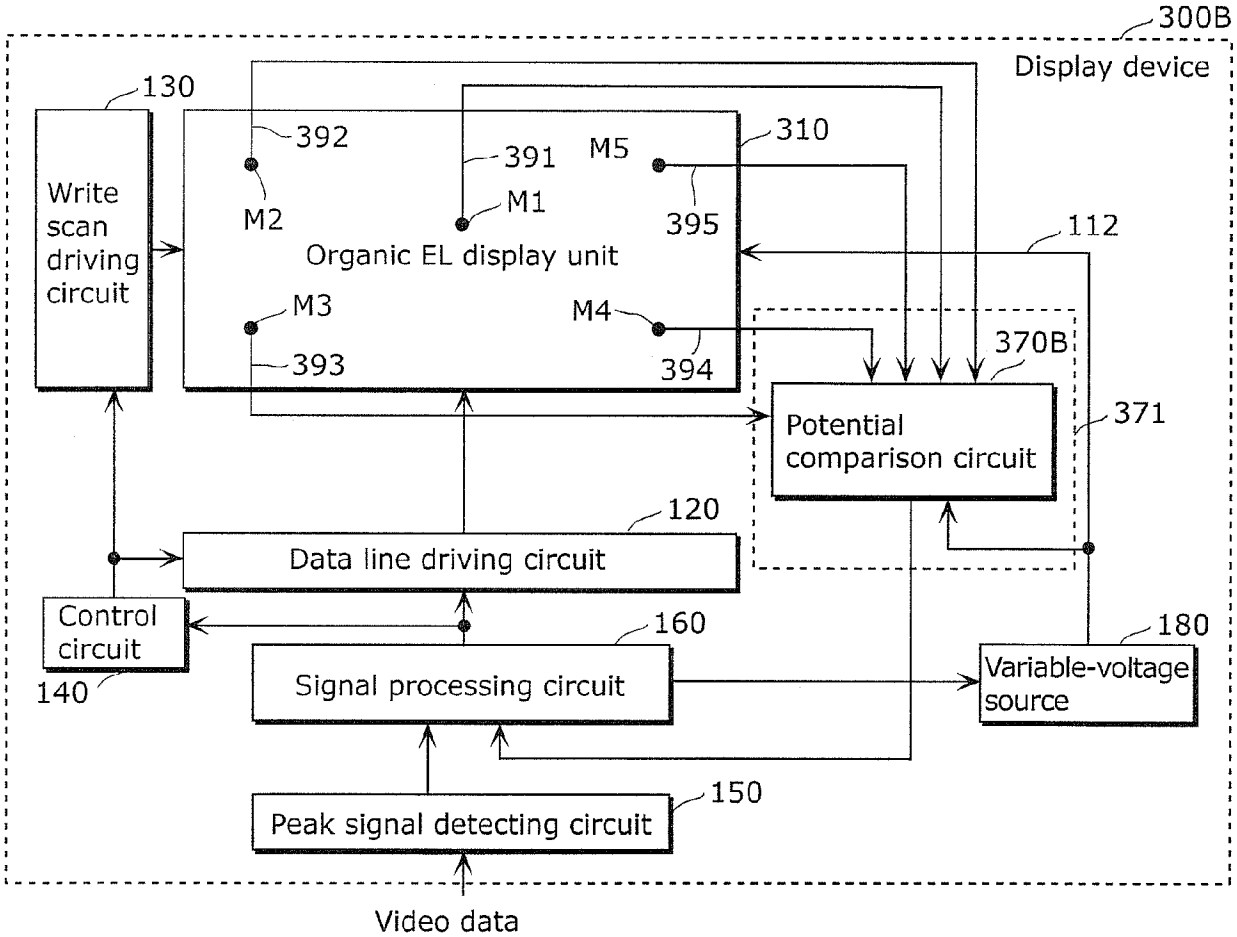
FIG. 18 is a block diagram showing another example of an outline configuration of a display device according to Embodiment 4.

FIG. 18 is a block diagram showing another example of an outline configuration of a display device according to Embodiment 4.

A display device 300B shown in the figure has nearly the same configuration as the display device 300A shown in FIG. 17, but the configuration of a maximum value detecting circuit 371 is different. Specifically, the maximum value detecting circuit 371 is different in including a potential comparison circuit 370B in place of the potential comparison circuit 370A and the potential difference detecting circuit 170A.

The potential comparison circuit 370B detects potential differences corresponding to the detecting points M1 to M5 by comparing the potential of the output voltage Vout of the variable-voltage source 180 and the potential at each of the detecting points M1 to M5. Subsequently, the potential comparison circuit 370B selects the largest potential difference out of the detected potential differences, and outputs the potential difference ΔV, which is the largest potential difference, to the signal processing circuit 160.

The signal processing circuit 160 regulates the variable-voltage source 180 in the same manner as the signal processing circuit 160 of the display apparatus 300A.

It is to be noted that, in the display device 300B, the variable-voltage source 180 corresponds to the power supplying unit, and the organic EL display unit 310 corresponds to the display unit.

As described above, the display devices 300A and 300B according to this embodiment supply, to the organic EL display unit 310, an output voltage Vout with which dropping of luminance does not occur in any of the monitor pixels 111M. In other words, by setting the output voltage Vout to a more appropriate value, it is possible to further reduce power consumption and suppress the dropping of luminance of the pixel 111. This effect shall be described below using FIG. 19A to FIG. 20B.

Figure 19A:
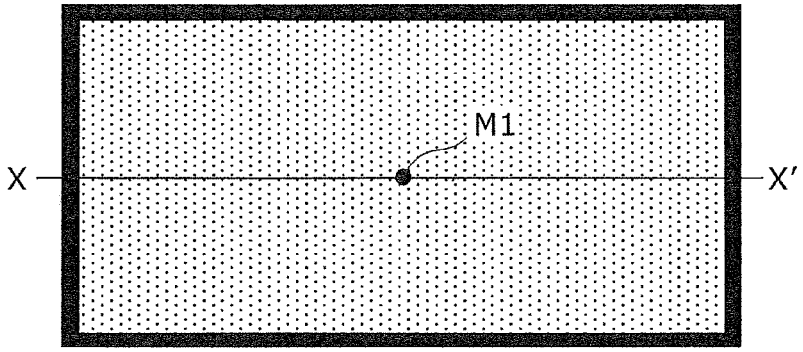
FIG. 19A is diagram schematically showing an example of an image displayed on the organic EL display unit.
Figure 19B:
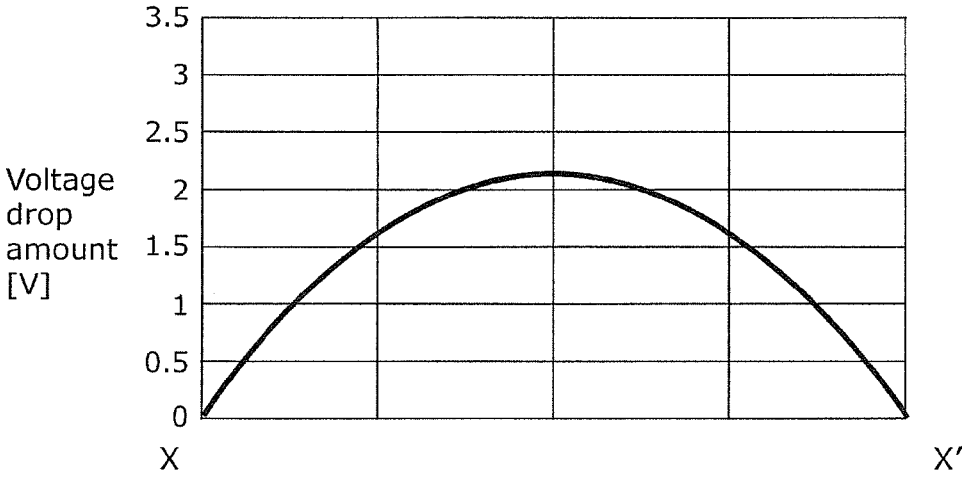
FIG. 19B is a graph showing a voltage drop amount for a first power source wire in line x-x' in FIG. 19A.

FIG. 19A is a diagram schematically showing an example of an image displayed on the organic EL display unit 310, and FIG. 19B is a graph showing the voltage drop amount for the first power source wire 112 in line x-x' in the case of the image shown in FIG. 19A. Furthermore, FIG. 20A is a diagram schematically showing another example of an image displayed on the organic EL display unit 310, and FIG. 20B is a graph showing the voltage drop amount for the first power source wire 112 in line x-x' in the case of the image shown in FIG. 20A.

As shown in the FIG. 19A, when all of the pixels 111 of the organic EL display unit 310 produce luminescence at the same luminance, the voltage drop amount for the first power source wire 112 is as shown in FIG. 19B.

Therefore, the worst case for the voltage drop can be known by checking the potential at the detecting point M1 at the center of the screen. Therefore, by adding the voltage drop margin Vdrop corresponding to the voltage drop amount ΔV of the detecting point M1 to VTFT+VEL, it is possible to cause all of the pixels 111 inside the organic EL display unit 310 to produce luminescence at a precise luminance.

Figure 20A:
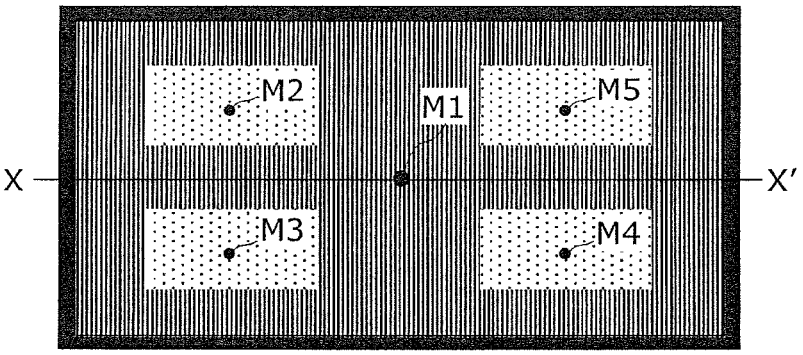
FIG. 20A is diagram schematically showing another example of an image displayed on the organic EL display unit 310.
Figure 20B:
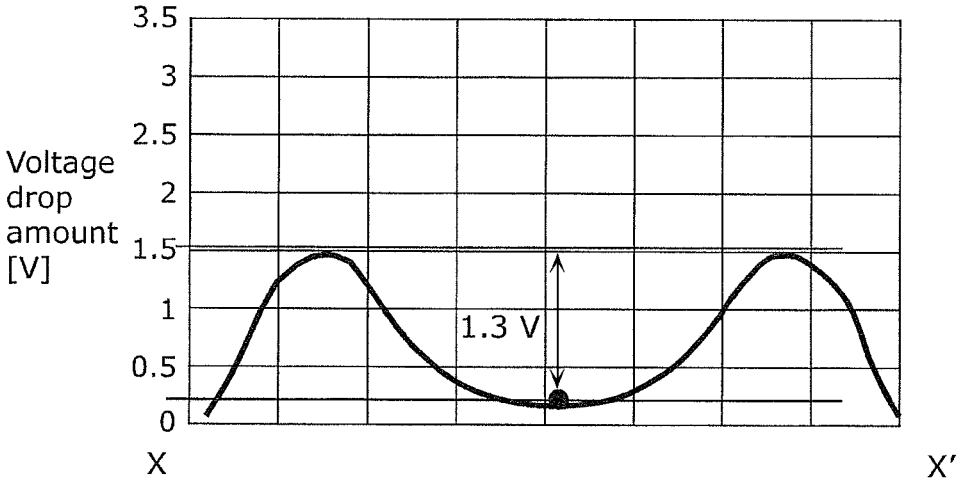
FIG. 20B is a graph showing a voltage drop amount for the first power source wire in line x-x' in FIG. 20A.

On the other hand, as shown in the FIG. 20A, when the pixels 111 at the central part of regions obtained when the screen is divided in two in the vertical direction and divided in two in the horizontal direction, that is, regions obtained by dividing the screen into four, produce luminescence at the same luminance and the other pixels 111 do not produce luminescence, the voltage drop amount for the first power source wire 112 is as shown in FIG. 20B.

Therefore, when measuring only the potential at the detecting point M1 at the center of the screen, it is necessary to set, as the voltage drop margin, a voltage obtained by adding a certain offset potential to the detected potential. For example, by pre-setting the voltage margin conversion table such that a voltage obtained by always adding an offset of 1.3V to the voltage drop amount (0.2V) at the center of the screen is set as the voltage drop margin Vdrop, it is possible to cause all of the pixels 111 inside the organic EL display unit 310 to produce luminescence at a precise luminance. Here, producing luminescence at a precise luminance means that the driving transistor 125 of the pixel 111 is operating in the saturation region.

However, in this case, since 1.3 V is always required as a voltage drop margin Vdrop, the power consumption reducing effect is lessened. For example, even in the case of an image in which the actual voltage drop amount is 0.1 V, 0.1+1.3=1.4 V is held as the voltage drop margin, and thus the output voltage Vout increases by such amount, and the power consumption reducing effect is lessened.

In view of this, by adopting a configuration which divides the screen into four as shown in FIG. 20A and measures the potential at the five locations of the detecting points M1 to M5 at the center of each of the four regions and the center of the entire screen, the accuracy of voltage drop amount detection can be enhanced. Therefore, it is possible to reduce the additional offset amount and increase the power consumption reducing effect.

For example, in the case where the potential at the detecting points M2 to M5 is 1.3 V in FIG. 20A and FIG. 20B, by setting, as the voltage drop margin, a voltage obtained by adding an offset of 0.2 V to the respective voltages at the detecting points M2 to M5, it is possible to cause all of the pixels 111 inside the organic EL display unit 310 to produce luminescence at a precise luminance.

In this case, even in the case of an image in which the actual voltage drop amount is 0.1 V, the value to be set as the voltage drop margin Vdrop is 0.1+0.2=0.3V, and thus 1.1 V of power source voltage can be further reduced compared to when only the potential at the detecting point M1 at the center of the screen is measured.

As described above, compared to the display devices 100 and 200, in the display devices 300A and 300B, there are many detecting points and the output voltage Vout can be regulated in accordance with the largest value out of the measured voltage drop amounts. Therefore, power consumption can be effectively reduced even when the size of the organic EL display unit 310 is increased.

Embodiment 5

In this embodiment, an example different from that in Embodiment 4, that is, a different example for the case where a display device includes plural detection points (M1 to M5) each connected to a corresponding monitor wire (also referred to as a detecting line) as a configuration for obtaining power consumption reducing effect shall be specifically described below. In the same manner as the display devices 300A and 300B according to Embodiment 4, in a display device according to this embodiment, the high-side potential for each of plural pixels 111 is measured, and the potential difference between each of the plural detected potentials and the potential of the output voltage of the variable-voltage source is detected. Subsequently, the variable-voltage source is regulated so that the output voltage of the variable-voltage source changes in accordance with the largest potential difference. However, the display device according to this embodiment is different compared to the display devices 300A and 300B in that the potential selected in the potential comparison circuit is inputted, not to the signal processing circuit, but to the variable-voltage source.

With this, in the display device according to this embodiment, the output voltage Vout of the variable-voltage source can be regulated in real-time in accordance with the voltage drop amount, and thus, compared to the display devices 300A and 300B in Embodiment 4, the temporary drop in pixel luminance can be prevented. This shall be described in detail below using the Drawings.

Figure 21:
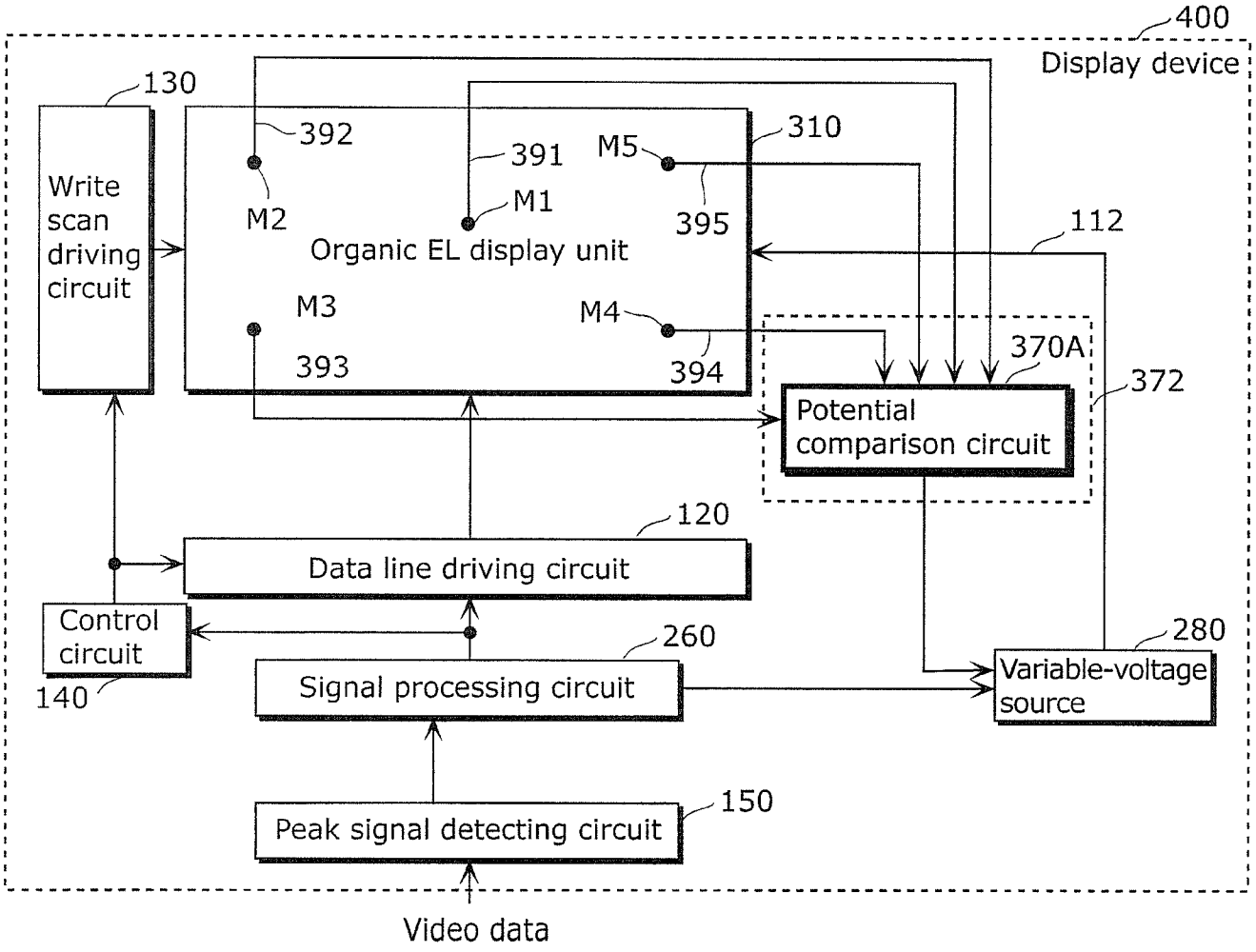
FIG. 21 is a block diagram showing an outline configuration of a display device according to Embodiment 5.

FIG. 21 is a block diagram showing an outline configuration of the display device according to this embodiment.

A display device 400 in the figure has nearly the same configuration as the display device 300A in Embodiment 4 but is different in including: the variable-voltage source 280 in place of the variable-voltage source 180; the signal processing circuit 260 in place of the signal processing circuit 160; and a maximum value detecting circuit 372 including the potential comparison circuit 370A and without including the potential comparison circuit 170A, and in having the potential selected by the potential comparison circuit 370A inputted to the variable-voltage source 280.

With this, in the variable-voltage source 280, the output voltage Vout rises in real-time in accordance with the lowest voltage selected by the potential comparison circuit 370A.

Therefore, compared to the display devices 300A and 300B, the display device 400 according to this embodiment can resolve the temporary drop in pixel luminance.

As described above, the respective display devices according to Embodiments 1 to 5 are able to reduce power consumption by regulating at least one of the high-side output potential of the power supplying unit and the low-side output potential of the power supplying unit in accordance with the voltage drop amount occurring from the power supplying unit to at least one of the pixels. In other words, Embodiments 1 to 5 can realize a display device having a high power consumption reducing effect.

It is to be noted that the display device having excellent power consumption reducing effect is not limited to those in the above-described embodiments. Modifications that can be obtained by executing various modifications to Embodiments 1 to 5 that are conceivable to a person of ordinary skill in the art without departing from the essence of the inventive concept of the present disclosure, and various devices internally equipped with the display device according to an exemplary embodiment of the present disclosure are included in the inventive concept of the present disclosure.

For example, the drop in the pixel luminance of the pixel to which the monitor wire inside the organic EL display unit is provided may be compensated.

Figure 22:
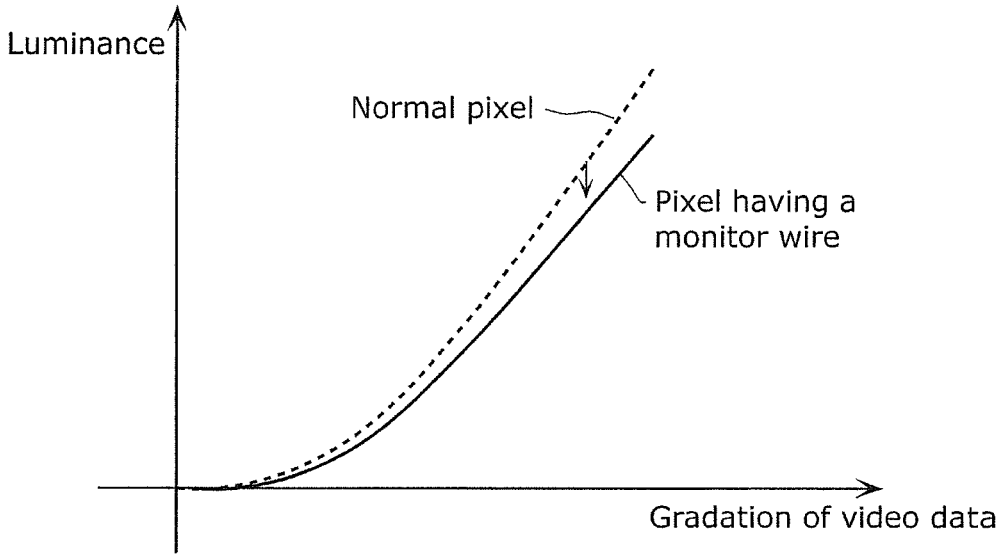
FIG. 22 is a graph showing pixel luminance of a normal pixel and pixel luminance of a pixel having a monitor wire, corresponding to the gradation levels of video data.

FIG. 22 is a graph showing pixel luminance of a normal pixel and pixel luminance of a pixel having a monitor wire, corresponding to the gradation levels of video data. It is to be noted that a normal pixel refers to a pixel among the pixels of the organic EL display unit, other than the pixel provided with a monitor wire.

Figure 23:
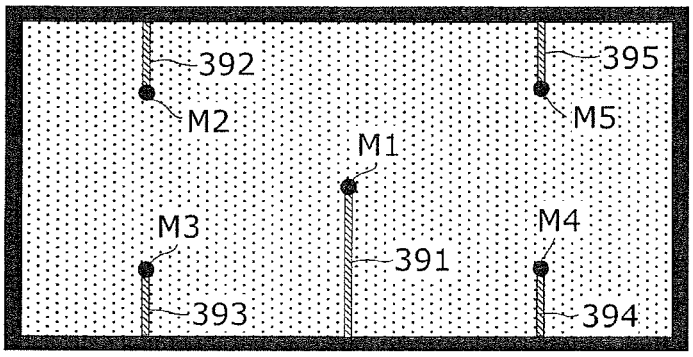
FIG. 23 is a diagram schematically showing an image in which line defects occur.

As is clear from the figure, when the gradation levels of the video data are the same, the luminance of the pixel having the monitor wire drops more than the luminance of the normal pixel. This is because, with the provision of a monitor wire, the capacitance value of the holding capacitor 126 of the pixel decreases. Therefore, even when video data which causes luminance to be produced with the same luminance evenly throughout the entirety of the organic EL display unit is inputted, the image to be displayed on the organic EL display unit is an image in which the luminance of the pixels having a monitor wire is lower than the luminance of the other pixels. In other words, line defects occur. FIG. 23 is a diagram schematically showing an image in which line defects occur. The figure schematically shows, for example, an image displayed on the organic EL display unit 310 when line defects occur in the display device 300A.

In order to prevent line defects, the display device may correct the signal voltage applied to the organic EL display unit from the data line driving circuit 120. Specifically, since the positions of the pixels having a monitor wire are known at the time of designing, it is sufficient to pre-set the signal voltage to be provided to the pixels in such locations to be higher by the amount of drop in luminance. With this, it is possible to prevent line defects caused by the provision of monitor wires.

Furthermore, although the signal processing circuit 160 and 260 have the required voltage conversion table indicating the required voltage VTFT+VEL corresponding to the gradation levels of each color, the signal processing circuits may have, in place of the required voltage conversion table, the current-voltage characteristics of the driving transistor 125 and the current-voltage characteristics of the organic EL element 121, and determine VTFT+VEL by using these two current-voltage characteristics.

Figure 24:
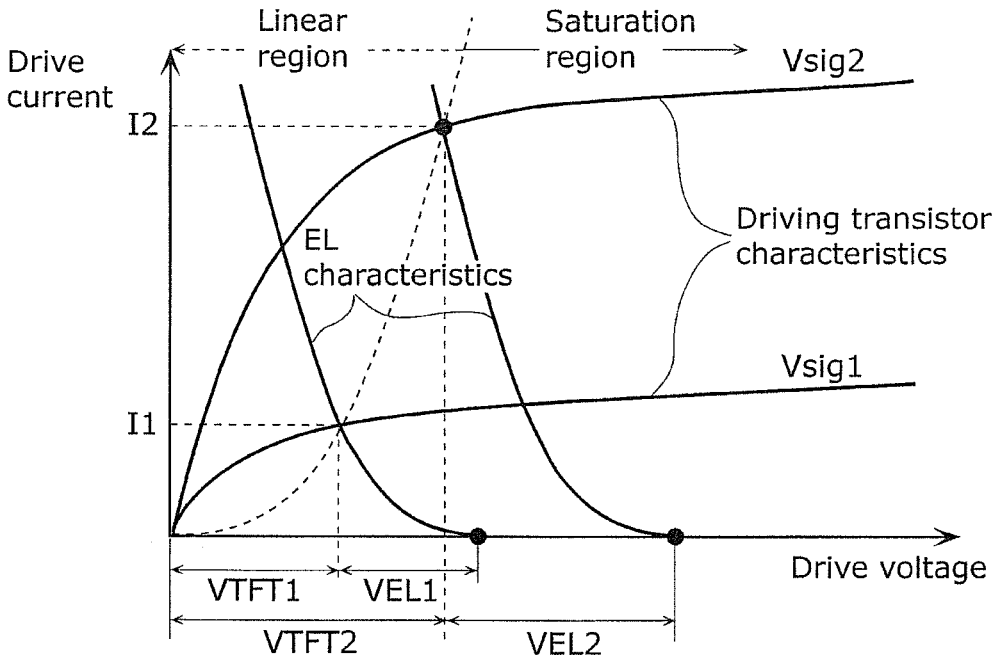
FIG. 24 is a graph showing together current-voltage characteristics of a driving transistor and current-voltage characteristics of an organic EL element.

FIG. 24 is a graph showing together current-voltage characteristics of a driving transistor and current-voltage characteristics of an organic EL element. In the horizontal axis, the direction of dropping with respect to the source potential of the driving transistor is the normal direction.

In the figure, current-voltage characteristics of the driving transistor and current-voltage characteristics of the organic EL element which correspond to two different gradation levels are shown, and the current-voltage characteristics of the driving transistor corresponding to a low gradation level is indicated by Vsig1 and the current-voltage characteristics of the driving transistor corresponding to a high gradation level is indicated by Vsig2.

In order to eliminate the impact of display defects due to changes in the source-to-drain voltage of the driving transistor, it is necessary to cause the driving transistor to operate in the saturation region. On the other hand, the pixel luminescence of the organic EL element is determined according to the drive current. Therefore, in order to cause the organic EL element to produce luminescence precisely in accordance with the gradation level of video data, it is sufficient that the voltage remaining after the drive voltage (VEL) of the organic EL element corresponding to the drive current of the organic EL element is deducted from the voltage between the source electrode of the driving transistor and the cathode electrode of the organic EL element is a voltage that can cause the driving transistor to operate in the saturation region. Furthermore, in order to reduce power consumption, it is preferable that the drive voltage (VTFT) of the driving transistor be low.

Therefore, in FIG. 24, the organic EL element produces luminescence precisely in accordance with the gradation level of the video data and power consumption can be reduced most with the VTFT+VEL that is obtained through the characteristics passing the point of intersection of the current-voltage characteristics of the driving transistor and the current-voltage characteristics of the organic EL element on the line indicating the boundary between the linear region and the saturation region of the driving transistor.

In this manner, the required voltage VTFT+VEL corresponding to the gradation levels for each color may be calculated using the graph shown in FIG. 24.

Furthermore, although the variable-voltage source supplies the high-side output voltage Vout to the first power source wire 112 and the second power source wire 113 is grounded in the periphery of the organic EL display unit in the respective embodiments, the variable-voltage source may supply low-side output voltage to the second power source wire 113.

Furthermore, the display device may include a low-side potential monitor wire having one end connected to the monitor pixel 111M and the other end connected to the voltage measuring unit according to respective embodiments, for transmitting the low-side potential applied to the monitor pixel 111M.

Furthermore, in the respective embodiments, the voltage measuring unit may measure at least one of the high-side potential applied to the monitor pixel 111M and the low-side potential applied to the monitor pixel 111M, and the voltage regulating unit may regulate the power supplying unit in accordance with the measured potential so that the potential difference between the high-side potential of the monitor pixel 111M and the low-side potential of the monitor pixel is set to a predetermined potential difference.

With this, power consumption can be further reduced. This is because, since the cathode electrode of the organic EL element 121 which makes up part of the common electrode included in the second power source wire 113 uses a transparent electrode (for example, ITO) having high sheet resistance, the voltage drop amount for the second power source wire 113 is larger than the voltage drop amount for the first power source wire 112. Therefore, by regulating in accordance with the low-side potential applied to the monitor pixels 111M, the output potential of the power supplying unit can be regulated more appropriately.

Furthermore, in Embodiments 3 and 5, the voltage regulating unit may detect the potential difference between the low-side potential of the monitor pixel 111M measured by the voltage measuring unit and the predetermined potential, and regulate the power supplying unit in accordance with the detected potential difference.

Furthermore, in Embodiments 2 and 4, the signal processing circuit 160 may change the first reference voltage Vref1 on a plural frame (for example, a 3-frame) basis instead of changing the first reference voltage Vref1 on a per frame basis.

With this, the power consumption occurring in the variable-voltage source 180 can be reduced by the fluctuation of the potential of the first reference voltage Vref1.

Furthermore, the signal processing circuit 160 may measure the potential differences outputted from the potential difference detecting circuit 170A and the potential comparison circuit 370B over plural frames, average the measured potential differences, and regulate the variable-voltage source 180 in accordance with the average potential difference. Specifically, the process of detecting the potential at the detecting point (step S14) and the process of detecting the potential difference (step S15) in the flowchart shown in FIG. 12 may be executed over plural frames, and the potential differences for the plural frames detected in the process of detecting the potential difference (step S15) may be averaged in the process of determining the voltage margin (step S16), and the voltage margin may be determined in accordance with the average potential difference.

Furthermore, the signal processing circuits 160 and 260 may determine the first reference voltage Vref1 and the second reference voltage Vref2 with consideration being given to an aged deterioration margin for the organic EL element 121. For example, assuming that the aged deterioration margin for the organic EL element 121 is Vad, the signal processing circuit 160 may determine the voltage of the first reference voltage Vref1 to be VTFT+VEL+Vdrop+Vad, and the signal processing circuit 260 may determine the voltage of the second reference voltage Vref2 to be VTFT+VEL+Vad.

Furthermore, although the switch transistor 124 and the driving transistor 125 are described as being P-type transistors in the above-described embodiments, they may be configured of N-type transistors.

Furthermore, although the switch transistor 124 and the driving transistor 125 are TFTs, they may be other field-effect transistors.

Furthermore, the processing units included in the display devices 50, 100, 200, 300A, 300B, and 400 according to the above-described embodiments are typically implemented as an LSI which is an integrated circuit. It is to be noted that part of the processing units included in the display devices 50, 100, 200, 300A, 300B, and 400 can also be integrated in the same substrate as the organic EL display units 110 and 310. Furthermore, they may be implemented as a dedicated circuit or a general-purpose processor. Furthermore, a Field Programmable Gate Array (FPGA) which allows programming after LSI manufacturing or a reconfigurable processor which allows reconfiguration of the connections and settings of circuit cells inside the LSI may be used.

Furthermore, part of the functions of the data line driving circuit, the write scan driving circuit, the control circuit, the peak signal detecting circuit, the signal processing circuit, and the potential difference detecting circuit included in the display devices 50, 100, 200, 300A, 300B, and 400 according to the above-described embodiments of the present disclosure may be implemented by having a processor such as a CPU execute a program. Furthermore, the inventive concept of the present disclosure may also be implemented as a display device driving method including the characteristic steps implemented through the respective processing units included in the display devices 50, 100, 200, 300A, 300B, and 400.

Embodiment 6

In Embodiments 1 to 5, a configuration by which a display device obtains a power consumption reducing effect, that is, a configuration for monitoring the power source voltage of pixels using one or plural detecting lines (monitor wires) in order to reduce power consumption is described. In Embodiment 6, a configuration in which a relay unit is provided in a panel in which the display unit is provided, to reduce the number of leads (also referred to as output lines) for leading the detecting lines (monitor wires) outside the panel shall be described as a configuration by which a display device obtains a maximum power consumption reducing effect.

Stated differently, the display devices according to above-described Embodiments 1 to 5 are configured to monitor the power source voltage of a pixel by using a detecting line in order to reduce power consumption, and the accuracy of the detection of the power source voltage of the pixel can be enhanced further as the number of detecting points increases.

Figure 25:
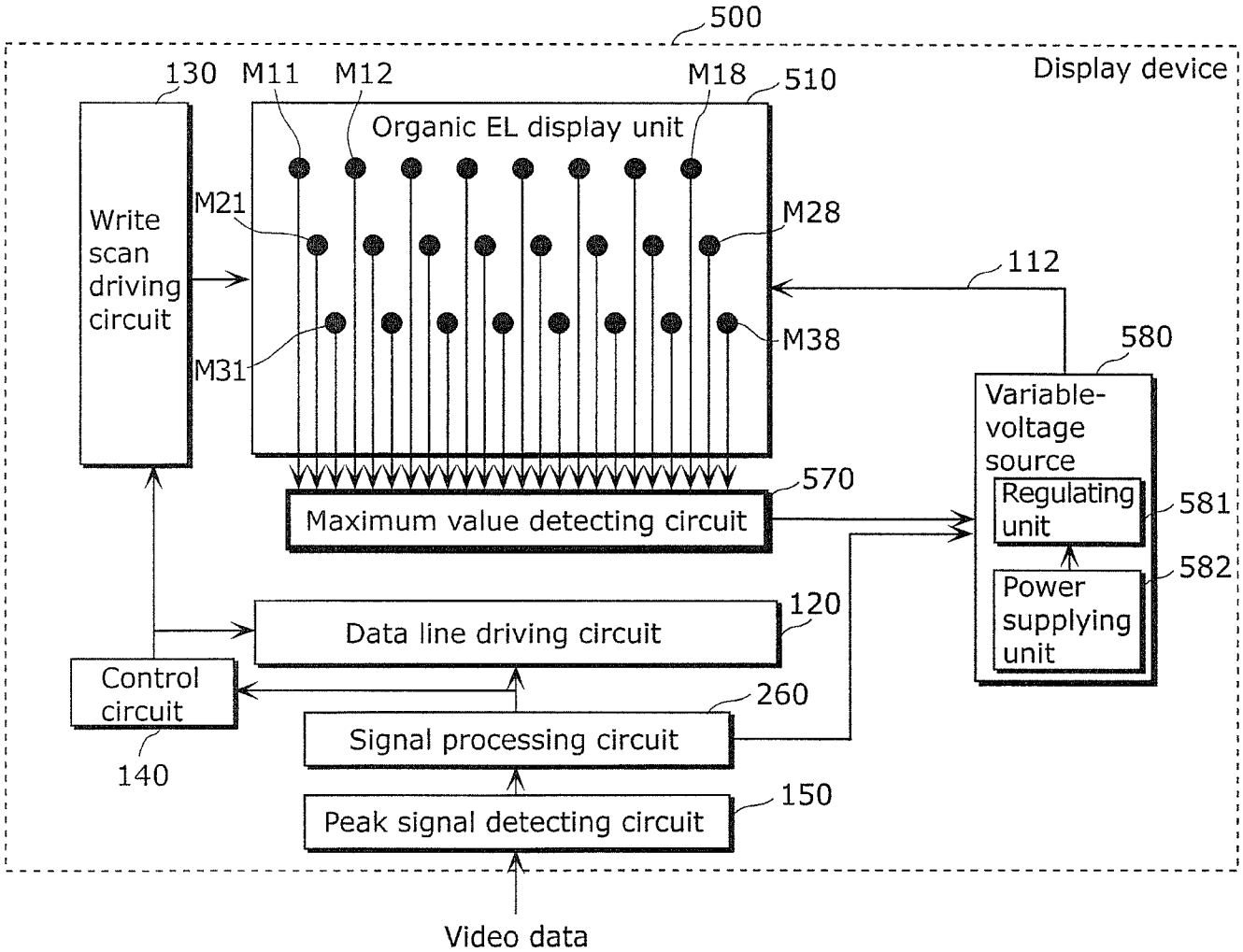
FIG. 25 is a block diagram for describing the outline configuration of the display device according to Embodiments 1 to 5.

FIG. 25 is a block diagram for describing the outline configuration of the display devices according to Embodiments 1 to 5.

A display device 500 shown in the FIG. 25 includes an organic EL display unit 510, the data line driving circuit 120, the write scan driving circuit 130, the control circuit 140, the peak signal detecting circuit 150, the signal processing circuit 260, the maximum value detecting circuit 570, and a variable-voltage source 580. The same numerical reference is given to elements that are the same as those in FIG. 1, FIG. 10, FIG. 14, FIG. 17, FIG. 18, and FIG. 21, and detailed description thereof shall not be repeated.

The organic EL display unit 510 is nearly the same as the organic EL display unit 110 but is different compared to the organic EL display unit 110 in having not one detecting point but 24 points (M11 to M38) as an example of multiple points. Furthermore, detecting lines (monitor wires) are lead from the detecting points M11 to M38 to the maximum value detecting circuit 570.

The detecting lines are two or more wires each of which has one end connected to a corresponding one of two or more pixels in the organic EL display unit 510, and is for transmitting the high-side potential or the low-side potential applied to the corresponding one of the two or more pixels to the maximum value detecting circuit 570.

The maximum value detecting circuit 570 detects and selects, from among the applied potentials that are applied to the two or more pixels and transmitted by the detecting lines, at least one of the lowest potential out of the high-side potentials applied to the pixels and the highest potential out of the low-side potentials, and outputs the selected potential to the variable-voltage source 580.

As previously described, the peak signal detecting circuit 150 detects the peak value of video data inputted to the display device 500, and outputs a peak signal indicating the detected peak value to the signal processing circuit 260.

As previously described, the signal processing circuit 260 regulates the variable-voltage source 508 in accordance with the peak signal outputted by the peak signal detecting circuit 150 and a maximum potential difference $\Delta V$ detected by the maximum value detecting circuit 570, so that the potentials of the monitor pixels (detecting point M11 to detecting point M38) are set to a predetermined potential. Specifically, the signal processing circuit 160 determines the voltage required by the organic EL element 121 and the driving transistor 125 when causing the pixels 111 to produce luminescence according to the peak signal outputted by the peak signal detecting circuit 150.

The variable-voltage source 580 includes a regulating unit 581 and a power supplying unit 582, and outputs at least one of the high-side potential and the low-side potential to the organic EL display unit 510.

The power supplying unit 582 outputs at least one of the high-side potential or the low-side potential to the organic EL display unit 510, via the first power source line 112 for example.

The regulating unit 581 regulates at least one of the high-side output potential and the low-side output potential that are outputted by the power supplying unit 582 so that any one from among the potential difference between the high-side potential and the reference potential, the potential difference between the low-side potential and the reference potential, and the potential difference between the high-side potential and the low-side potential, reaches a predetermined potential difference.

Thus, the display device 500 is configured as described above, and the display device 500 monitors the voltage inside the organic EL display unit 51 (inside the panel), and detects the voltage drop amount to thereby change the external power source voltage in accordance with the video, for the purpose of power consumption reduction.

Furthermore, as shown by the display device 500, the detection accuracy can be raised by providing many detecting points (monitor points), and thus produce the advantageous effect of enhancing the power consumption reducing effect.

However, as in the display device 500, with a configuration which monitors the power source voltage of the pixels by using a large number of detecting lines in order to reduce power consumption, increasing the number of detecting lines in order to enhance detection accuracy also increases the number of leads (output lines) for leading the detecting lines outside the panel, and thus the problem of complicating the structure of the connection between the panel and the substrate outside the panel arises. Furthermore, with an increased number of leads (output lines) to draw out, there is the problem of increased cost required for the mounting process and circuit formation process.

In view of this, it is preferable to have, as a configuration by which a display device obtains the maximum power consumption reducing effect, a display device which, by being provided with a relay unit in the panel in which the display unit is provided, reduces the number of leads (output lines) for leading the detecting lines (monitor lines) outside the panel. Hereinafter, this example shall be specifically described as a display device according to this embodiment, using the Drawings.

Figure 26:
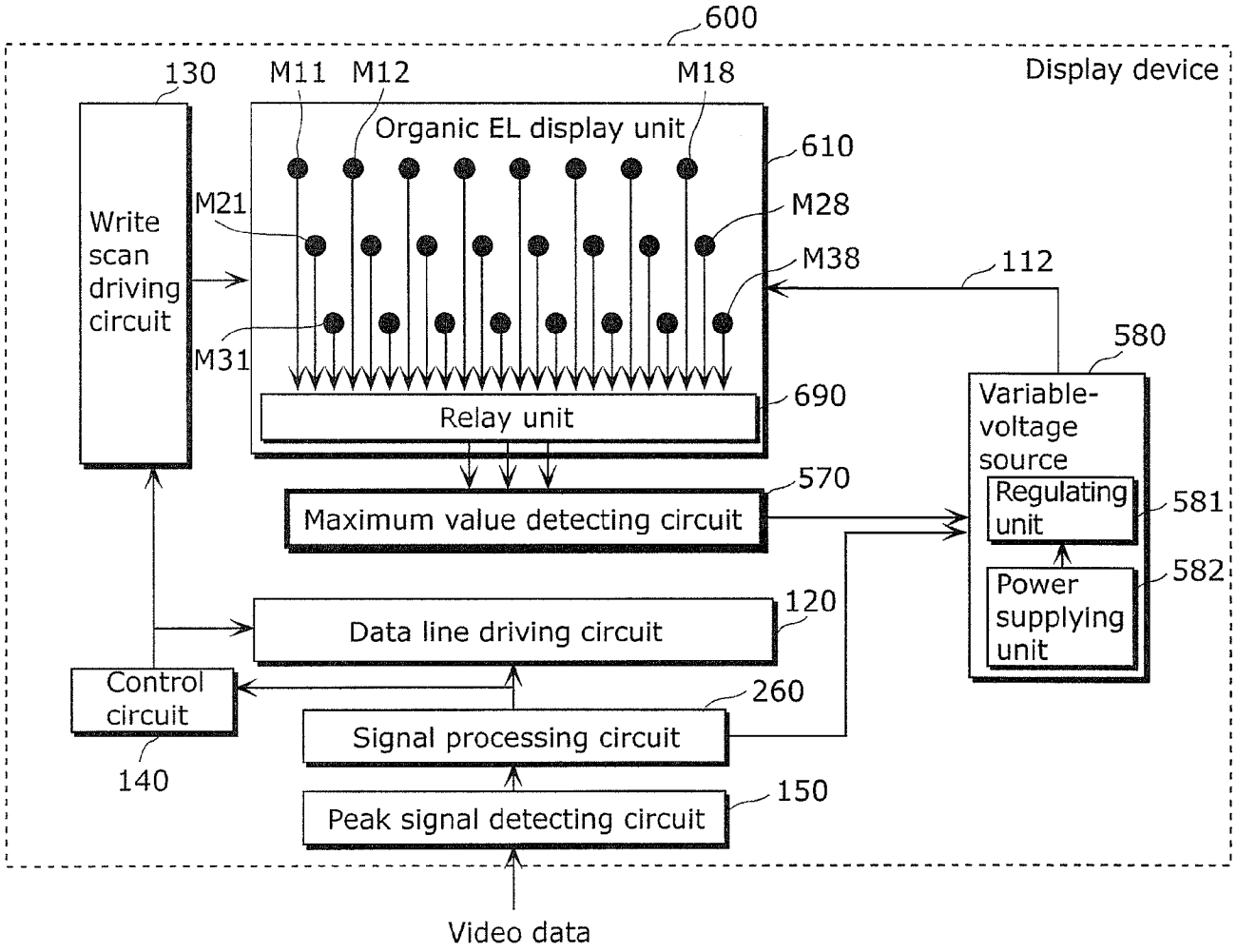
FIG. 26 is a block diagram for describing an outline configuration of a display device according to Embodiment 6.

FIG. 26 is a block diagram for describing an outline configuration of the display device according to this embodiment. It is to be noted that the same numerical reference is given to elements that are the same as those in FIG. 25 and detailed description thereof shall not be repeated.

The configuration of the display device 600 according to this embodiment shown in FIG. 26 is different compared to the display device 500 shown in FIG. 25 in including a relay unit 690.

The maximum value detecting circuit 570, which corresponds to the detecting circuit, detects and selects, from among applied potentials that are applied to two or more pixels, transmitted by the detecting lines, and outputted by the relay unit 690, at least one of the lowest potential out of the high-side potentials and the highest potential out of the low-side potentials applied to the pixels, and outputs the selected potential to the variable-voltage source 580 (specifically, the regulating unit 581).

The relay unit 690, which corresponds to the relay unit, is connected to the other end of each of the detecting lines and is connected to one end of output lines that are fewer in number than the detecting lines, and outputs, to the output lines: at least one applied potential out of the two or more high-side potentials transmitted by the detecting lines; or at least one applied potential out of the two or more low-side potentials transmitted. Furthermore, the relay unit 690 is provided on the same substrate as the organic EL display unit 610.

Specifically, the relay unit 690 is provided on the same substrate as the organic EL display unit 610, is connected to the detecting lines to which the potentials of the detection points M11 to M38 are to be inputted, and is connected to the output lines that are fewer in number than the detecting lines and output the predetermined potential to the maximum value detecting circuit 570. The relay unit 690 outputs, to the regulating unit 581 via the output lines, at least one applied potential out of the two or more high-side potentials inputted from the detecting lines, and at least one applied potential out of the two or more low-side potentials inputted from the detecting lines.

The regulating unit 581 is connected to the relay unit 690 via the output lines and regulates at least one of the high-side output potentials and the low-side output potentials outputted by the power supplying unit 582 so that any one of the following potential differences reaches a predetermined potential difference: the potential difference between the high-side potential outputted by the relay unit 690 and the reference potential; the potential difference between the low-side potential outputted by the relay unit 690 and the reference potential; and the potential difference between the high-side potential and the low-side potential.

The display device 600 is configured as described above. Specifically, in the display device 600 according to this embodiment, by providing the relay unit 690 in the panel in which the organic EL display unit 610 is provided, the potentials transmitted by the detecting lines are outputted to the maximum value detecting circuit, with the number of leads (output lines) that are drawn out to the outside of the panel being reduced. This configuration allows simplification of the structure of the connection between the panel and the substrate outside the panel. This produces the advantageous effect of enabling the implementation of a display device in which wiring-related costs are reduced and the power consumption reducing effect is maximized.

Figure 27:
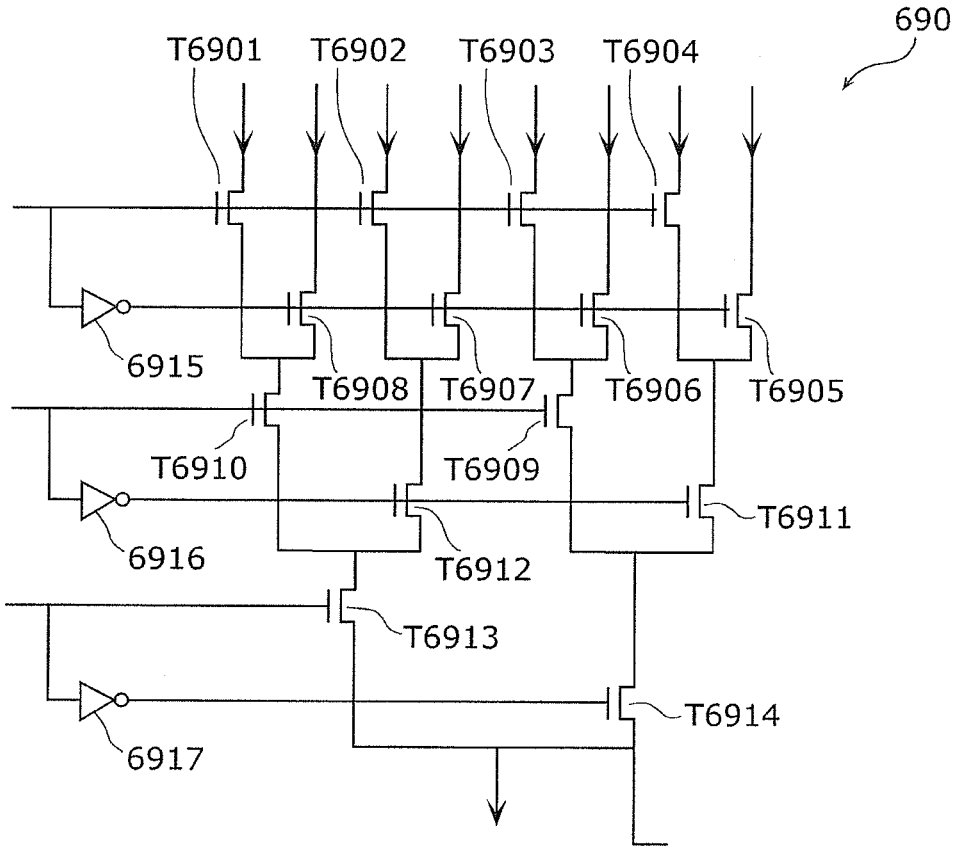
FIG. 27 is a circuit diagram showing an example of a specific configuration of a relay unit according to Embodiment 6.
Figure 28:
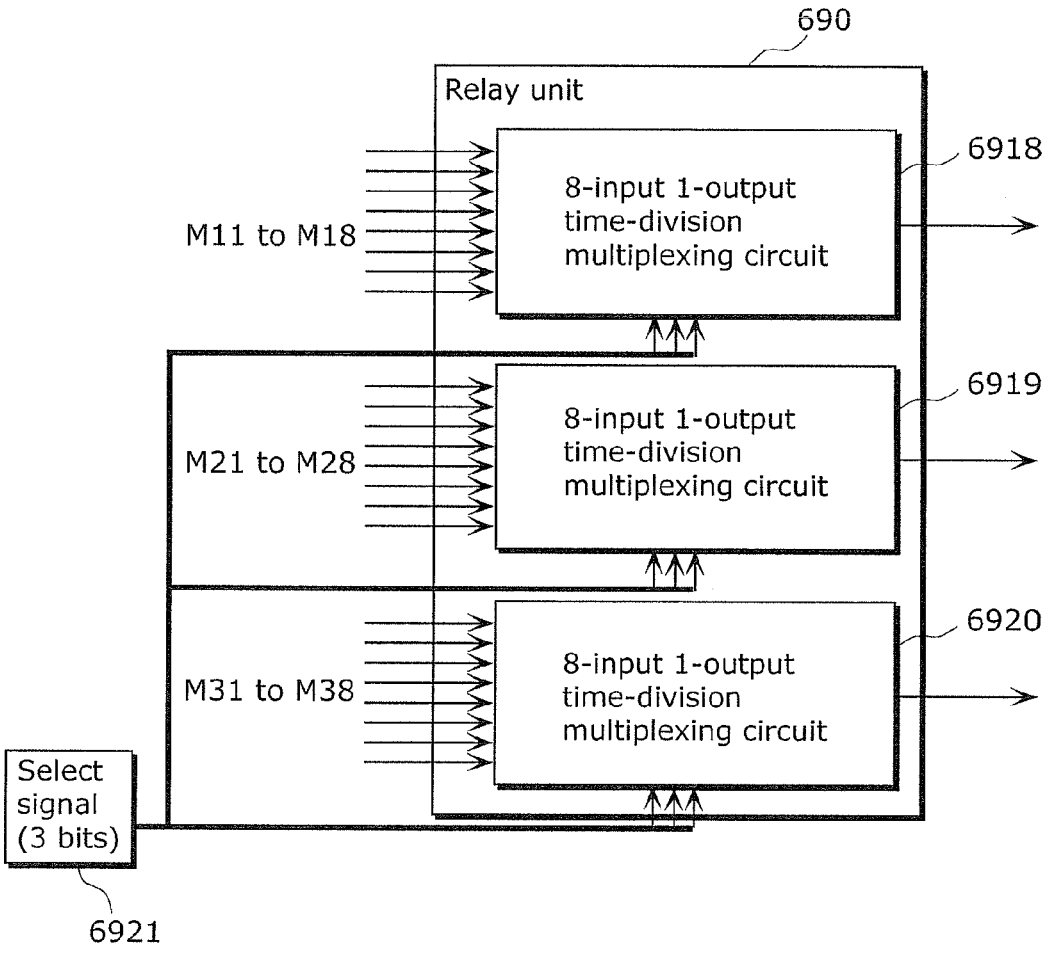
FIG. 28 is a block diagram showing an example of a specific configuration of the relay unit according to Embodiment 6.

FIG. 27 is a circuit diagram showing an example of a specific configuration of the relay unit 690 according to Embodiment 6. FIG. 28 is a block diagram showing an example of a specific configuration of the relay unit 690 according to Embodiment 6.

As shown in FIG. 27, the relay unit 690 is configured of a multiplexer including transistors T6901 to T6914 and logic circuits 6915 to 6917 which are NOT circuits.

The logic circuit 6915 has as an input the voltage that is applied for example to the gates of the transistors T6901 to T6904, and applies, to the gates of the transistors T6905 to T6908, a voltage corresponding to an output obtained by inverting the input. In the same manner, the logic circuit 6916 has as an input the voltage applied to the gates of the transistors T6909 and T6910, and applies, to the gates of the transistors T6911 and T6912, a voltage corresponding to an output obtained by inverting the input. Furthermore, the logic circuit 6917 has as an input the voltage applied to the gate of the transistor T6913, and applies, to the gate of the transistor T6914, a voltage corresponding to an output obtained by inverting the input.

The relay unit 690 uses the multiplexer configured in the above-described manner to relay, by time-division, the potentials detected for example at the eight detecting points M11 to M18 and transmitted by the corresponding eight detecting lines, to a single output line for leading the potential outside the panel. Specifically, using a 3-bit select signal, the relay unit 690 can time-divide and transmit the signals transmitted by the eight detecting lines, using a single output line.

Stated differently, by having 8-input 1-output time-division multiplexing circuits 6918 to 6920 as shown in FIG. 28, the relay unit 690 is able to time-divide and transmit through three output lines and using 3-bit select signals, the signals transmitted by the 32 detecting lines corresponding to the detection points M1 to M38. Here, each of the 8-input 1-output time-division multiplexing circuits 6918 to 6920 is configured of the circuit shown in FIG. 27.

It is to be noted that, in the same manner, if a time-division multiplexing circuit using a 4-bit select signal is provided, the signals transmitted to 64 detecting lines can be time-divided and transmitted through four output lines.

As described above, the relay unit 690 time-divides and sequentially outputs, to the output lines, the applied potentials applied to the two or more pixels that are transmitted by the detecting lines. Subsequently, the regulating unit 581 regulates at least one of the high-side output potentials and the low-side output potentials outputted by the power supplying unit 582 such that at least one of the following potential differences reaches a predetermined potential difference: the potential difference between the reference potential and the lowest potential out of the high-side potentials out of the applied potentials applied to the two or more pixels that are outputted by the relay unit 690; and the potential difference between the reference potential and the highest potential out of the low-side potentials out of the applied potentials.

Figure 29A:
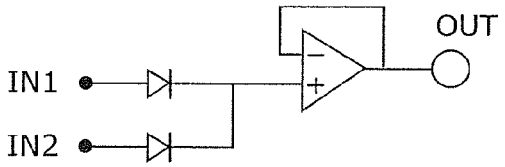
FIG. 29A is a circuit diagram showing an example of a specific configuration of a maximum value detecting circuit according to Embodiment 6.
Figure 29B:
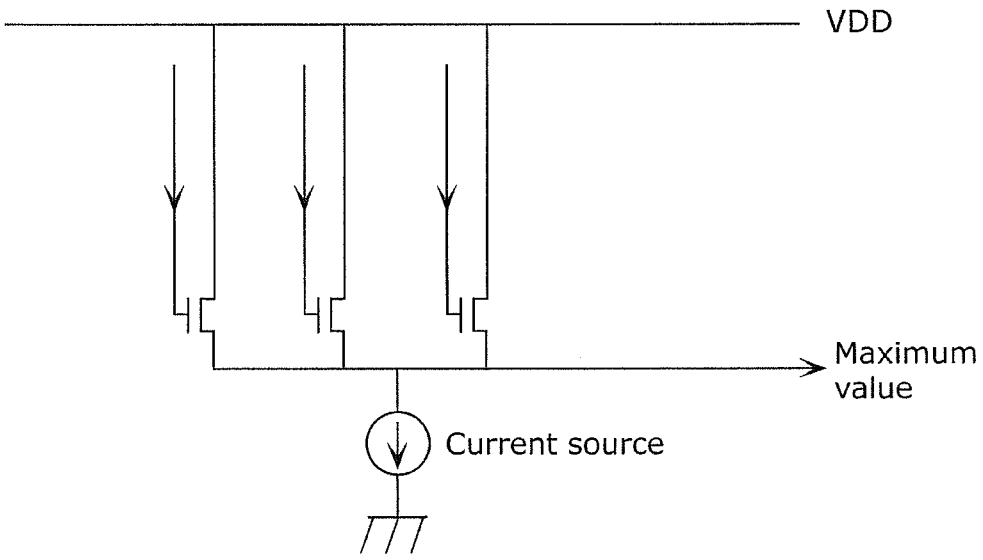
FIG. 29B is a circuit diagram showing an example of a specific configuration of the maximum value detecting circuit according to Embodiment 6.

FIG. 29A and FIG. 29B are circuit diagrams showing an example of a specific configuration of the maximum value detecting circuit 570. The circuit configuration shown in FIG. 29A and FIG. 29B are well-known and do not require description, thus their description shall be omitted here.

It is to be noted that the circuit making up the maximum value detecting circuit is not limited to that shown in FIG. 29A and FIG. 29B. For example, the maximum value detecting circuit may include a maximum value detecting circuit and a minimum value detecting circuit. An example of this is described below.

Figure 30:
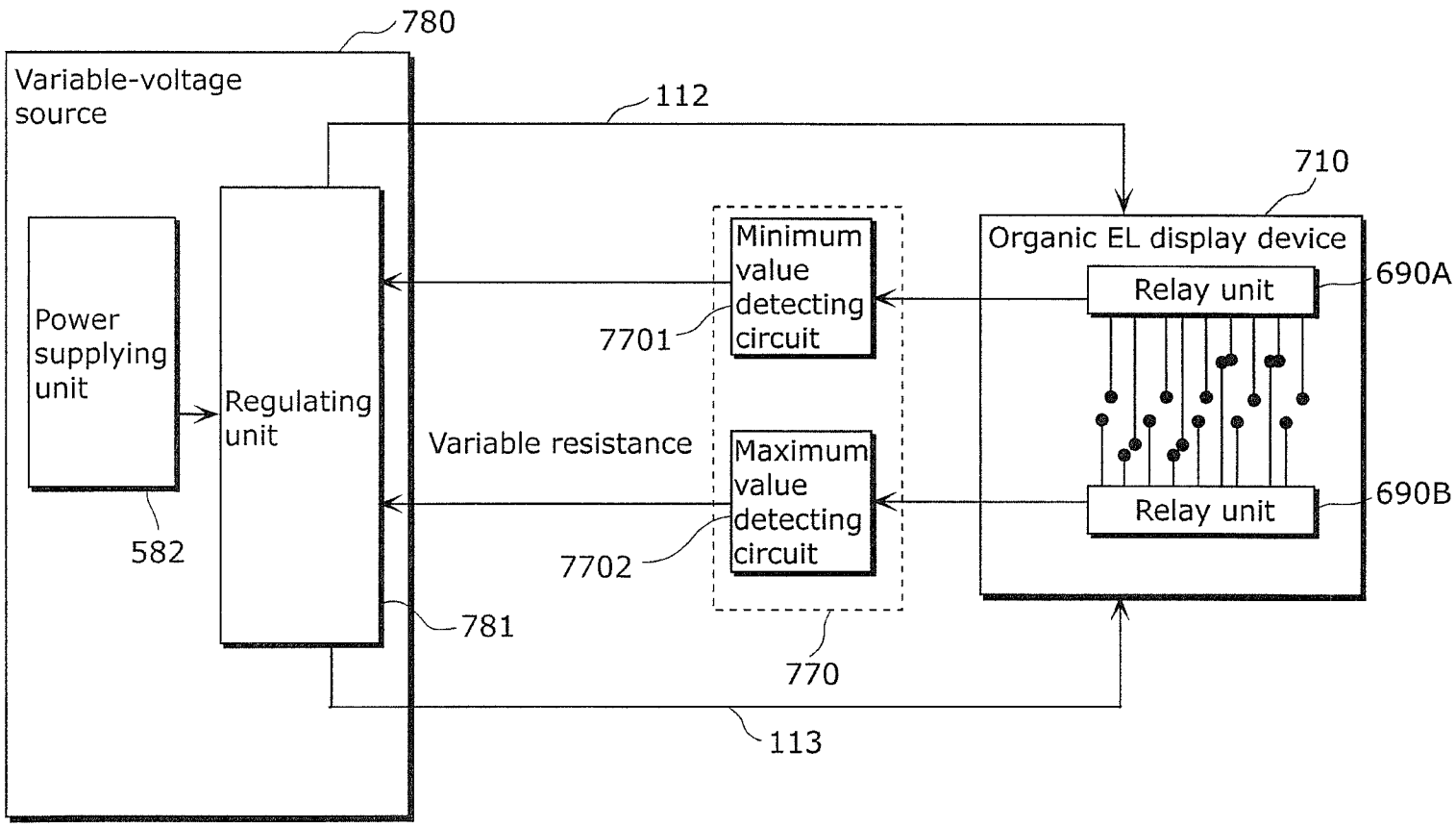
FIG. 30 is a diagram showing main units of the display device in the case where the maximum value detecting circuit according to Embodiment 6 includes a maximum value detecting circuit and a minimum value detecting circuit.

FIG. 30 is a diagram showing main units of the display device in the case where a maximum value detecting circuit 770 according to Embodiment 6 includes a maximum value detecting circuit 7701 and a minimum value detecting circuit 7702.

As shown in FIG. 30, an organic EL display unit 710 includes a relay unit 690A and a relay unit 690B; the output line of the relay unit 690A is connected to the minimum value detecting circuit 7701 included in the maximum value detecting circuit 770; and the output line of the relay unit 690B is connected to the maximum value detecting circuit 7702 included in the maximum value detecting circuit 770.

A regulating unit 781 regulates at least one of the high-side output potentials and the low-side output potentials outputted by the power supplying unit 582, so that any one of the following potential differences reaches a predetermined potential difference: the potential difference between the reference potential and the high-side potential detected by the maximum value detecting circuit 7702; the potential difference between the reference potential and the low-side potential detected by the minimum value detecting circuit 7701; and the potential difference between the high-side potential detected by the maximum value detecting circuit 7702 and the low-side potential detected by the minimum value detecting circuit 7701. The regulating unit 781 supplies the regulated output potential to the organic EL display unit 710, via the first power source wire 112 and the second power source wire 113.

It is to be noted that although it is assumed that the relay unit 690 is configured of the relay unit 690A and the relay unit 690B, its configuration is not limited to this. The relay unit 690 may be configured using a single unit. In such a case, it is sufficient that the output line of the relay unit 690 be branched off into two and connected to the minimum value detecting circuit 7701 and the maximum value detecting circuit 7702.

Figure 31A:
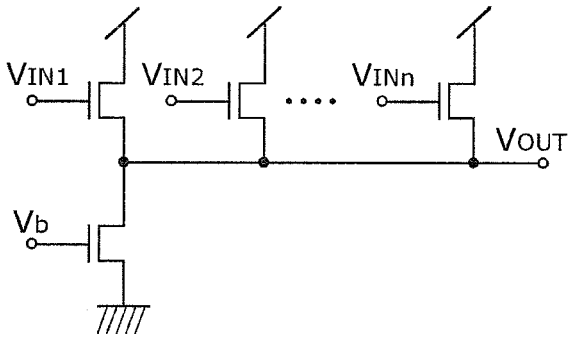
FIG. 31A is a circuit diagram showing an example of a specific configuration of the maximum value detecting circuit according to Embodiment 6.
Figure 31B:
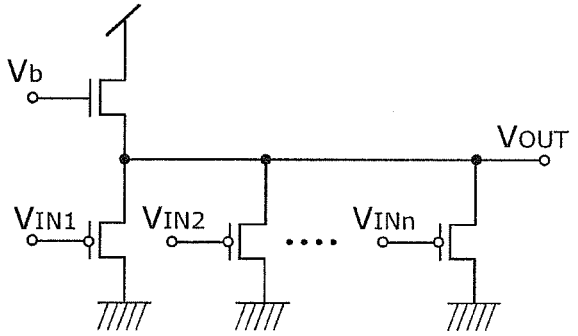
FIG. 31B is a circuit diagram showing an example of a specific configuration of the maximum value detecting circuit according to Embodiment 6.
Figure 32A:
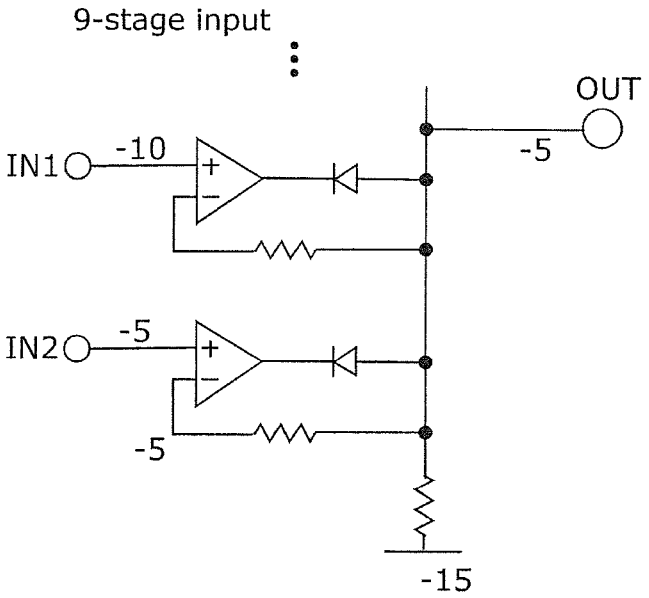
FIG. 32A is a circuit diagram showing an example of a specific configuration of the maximum value detecting circuit according to Embodiment 6.
Figure 32B:
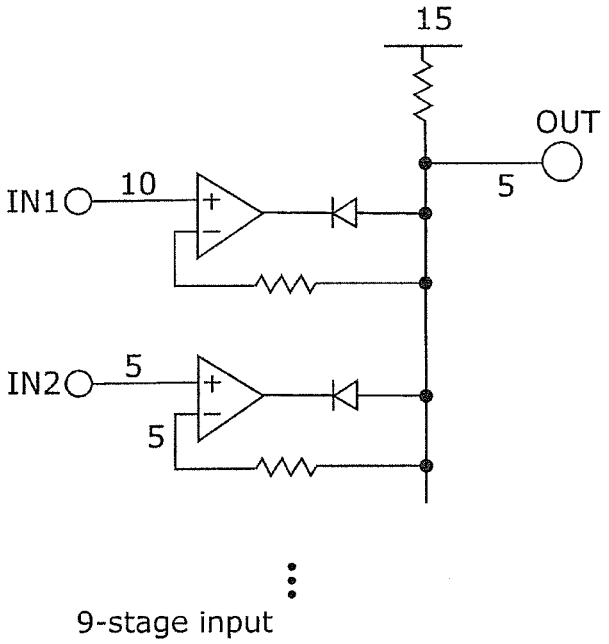
FIG. 32B is a circuit diagram showing an example of a specific configuration of the maximum value detecting circuit according to Embodiment 6.

Here, FIG. 31A and FIG. 31B as well as FIG. 32A and FIG. 32B are circuit diagrams each showing an example of a specific configuration of the maximum value detecting circuit 570 according to Embodiment 6. It is to be noted that the example circuit making up the maximum value detecting circuit 7702 shown in FIGS. 31A and 32A are well-known and do not require description, and thus their description shall be omitted here. Likewise, the example circuit making up the minimum value detecting circuit 7701 shown in FIGS. 31B and 32B are well-known and do not require description, and thus their description shall be omitted here.

As described above, according to this embodiment, a relay unit is provided in a panel in which the organic EL display unit is provided, to thereby reduce the number of leads for leading the detecting lines outside the panel. With this configuration, the display device according to this embodiment allows simplification of the structure of the connection between the panel and the substrate outside the panel. This produces the advantageous effect of enabling the implementation of a display device in which wiring-related costs are reduced and the power consumption reducing effect is maximized.

It is to be noted that although the maximum value detecting circuit is described as being provided outside the organic EL display unit (outside the panel) in the foregoing description, the configuration is not limited to such. The maximum value detecting circuit may be provided inside the relay unit.

Figure 33:
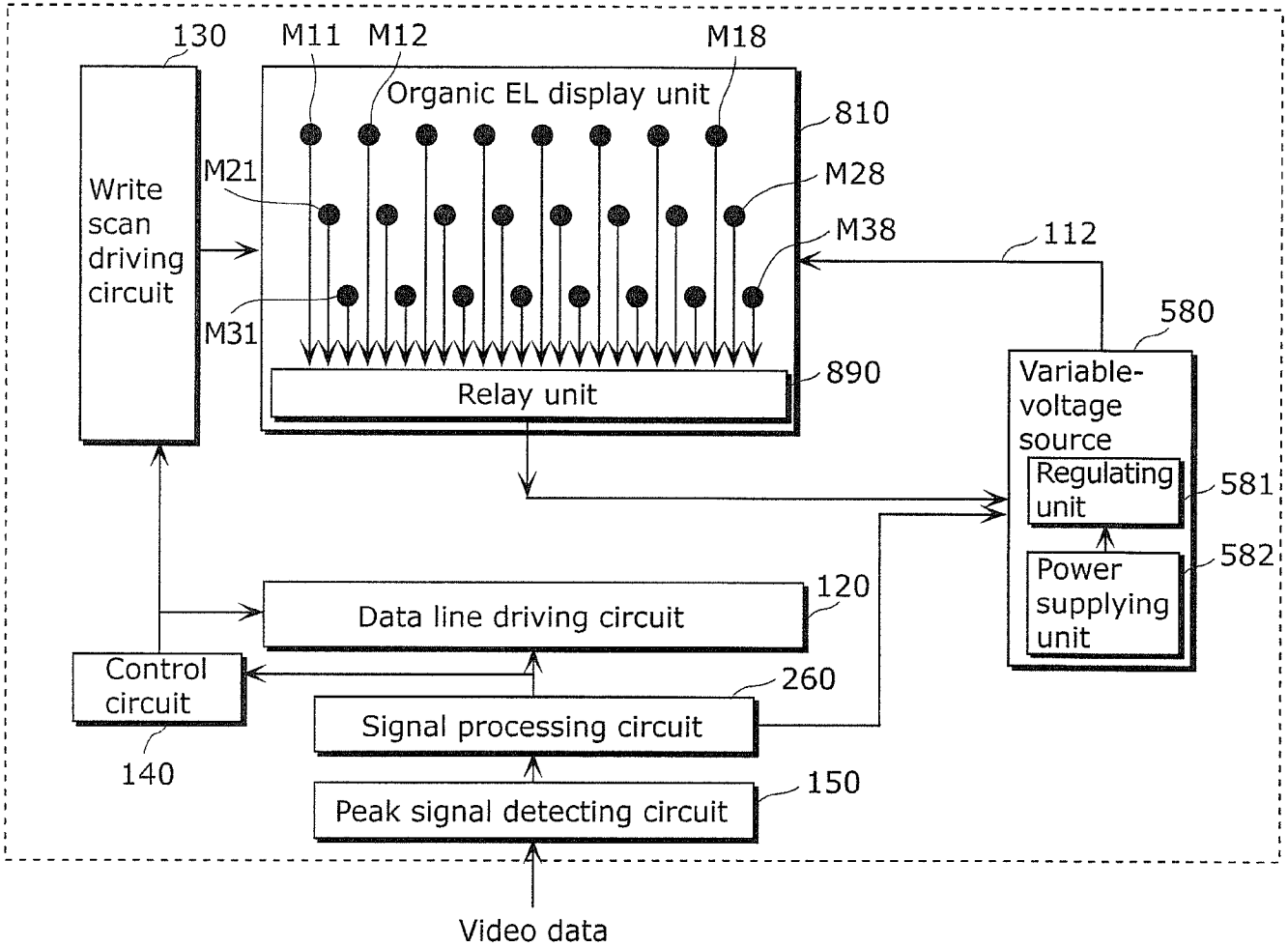
FIG. 33 is a diagram showing an outline configuration of the display device according to Embodiment 6 in the case where the maximum value detecting circuit is provided inside the relay unit according to Embodiment 6.

FIG. 33 is a diagram showing an outline configuration of a display device according to this embodiment, in the case where a maximum value detecting circuit is provided inside a relay unit according to Embodiment 6. Specifically, a relay unit 890 includes, internally, a detecting circuit connected to an output line; the detecting circuit detects and selects, among the applied potentials applied to the two or more pixels that are transmitted by the detecting lines, at least one of the highest potential out of high-side potentials and the lowest potential out of the low-side potentials, and outputs the selected potential to the output line.

In this manner, the circuit which obtains the maximum value or the minimum value of the applied voltages transmitted by the detecting lines (monitor lines) is provided inside the organic EL display unit, and thus allowing further reduction of wires. This produces the advantageous effect of enabling the implementation of a display device in which wiring-related costs are reduced and the power consumption reducing effect is maximized.

Although the display device and the method of driving the same according to the present disclosure have been described based on the embodiments, the inventive concept of the present disclosure is not limited to such embodiments. Various modifications of the exemplary embodiments as well as embodiments resulting from arbitrary combinations of constituent elements of different exemplary embodiments that may be conceived by those skilled in the art are intended to be included within the scope of the inventive concept of the disclosure as long as these do not depart from the essence of the inventive concept of the present disclosure.

It is to be noted that although the foregoing descriptions exemplify the case where the display devices 50, 100, 200, 300A, 300B, 400, 500, and 600 are active-matrix organic EL display devices, the inventive concept of the present disclosure is not limited to such. The display device according to the present disclosure may be applied to organic EL display devices other than the active matrix-type, and may be applied to a display device other than an organic EL display device using a current-driven luminescence element, such as a liquid crystal display device.

Figure 34:
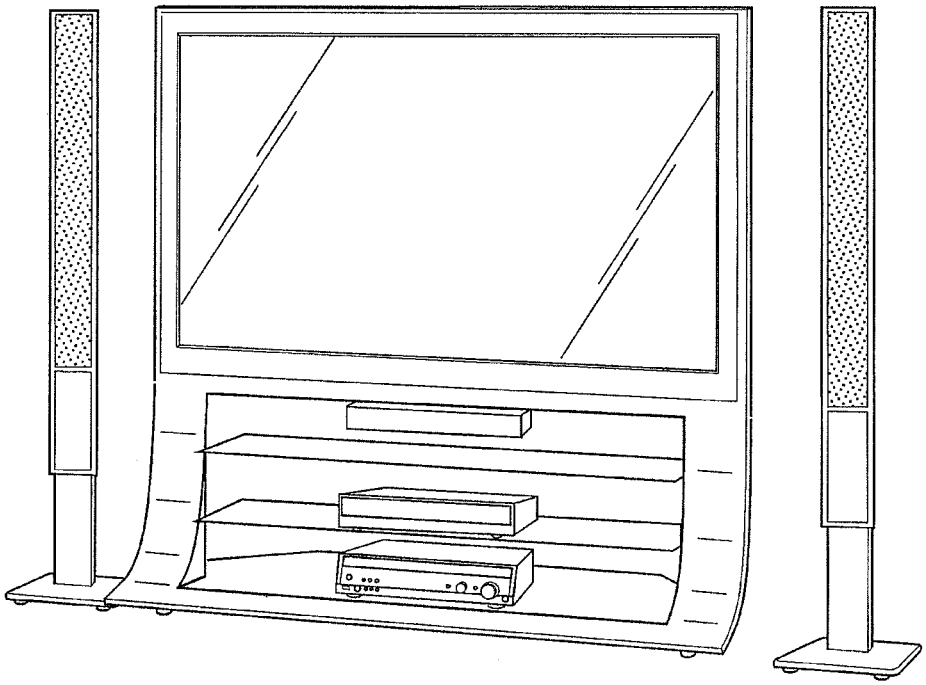
FIG. 34 is an external view of a thin flat-screen TV incorporating the display device according to an exemplary embodiment of the present disclosure.

Furthermore, for example, the display device according to the present disclosure is built into a thin flat-screen TV such as that shown in FIG. 34. A thin, flat TV capable of high-accuracy image display reflecting a video signal is implemented by having the display device according to the present disclosure built into the TV.

Although only some exemplary embodiments have been described in detail above, those skilled in the art will readily appreciate that many modifications are possible in the exemplary embodiments without materially departing from the novel teachings and advantages of the inventive concept of the present disclosure. Accordingly, all such modifications are intended to be included within the scope of the inventive concept of the present disclosure.

INDUSTRIAL APPLICABILITY

One or more exemplary embodiments of the present disclosure is particularly useful as an active-type organic EL flat panel display.

The invention claimed is:

1. A display device, comprising:

a power supplier configured to output at least one of a high-side output potential and a low-side output potential;

a display in which a plurality of pixels are arranged and which receives power supply from the power supplier;

a plurality of scanning lines connected to a corresponding one of the pixels;

a plurality of data lines connected to a corresponding one of the pixels;

two or more detecting lines each of which has one end connected to a corresponding one of two or more pixels inside the display, and is for transmitting a high-side applied potential or a low-side applied potential that is applied to the corresponding one of the two or more pixels;

a relay connected to the other end of each of the two or more detecting lines and to one end of one or more output lines which are fewer in number than the two or more detecting lines, and configured to output, to the one or more output lines, at least one applied potential out of the two or more high-side applied potentials or at least one applied potential out of the two or more low-side applied potentials, the high-side and low-side applied potentials being transmitted by the two or more detecting lines; and a regulator connected to the relay via the one or more output lines and configured to regulate at least one of the high-side output potential and the low-side output potential to be outputted by the power supplier, such that any one of the following potential differences reaches a predetermined potential difference: a potential difference between a reference potential and the high-side applied potential outputted by the relay; a potential difference between the reference potential and the low-side applied potential outputted by the relay; and a potential difference between the high-side applied potential and the low-side applied potential, wherein the display and the relay are provided on the same substrate, each of the pixels includes a driver, a switching element, and a luminescence element, the driver including a source electrode and a drain electrode, the switching element including a gate electrode, a source electrode, and a drain electrode, the luminescence element including a first electrode and a second electrode, each of the plurality of scanning lines is connected to the gate electrode of the switching element of the corresponding one of the pixels, each of the plurality of the data lines is connected to one of the source electrode and the drain electrode of the switching element of the corresponding one of the pixels, the one end of each of the detecting lines is connected to any one of the source electrode of the driver, the drain electrode of the driver, the first electrode, and the second electrode, and the predetermined potential difference is determined based on VTFT, VEL, ΔV, and Vdrop, where VTFT is the voltage required by the driver, VEL is the voltage required by the luminescent element, ΔV is the potential difference between the potential outputted by the power supplier and the potential of the luminescent pixel measured by a voltage measurer, and Vdrop is the voltage margin corresponding to ΔV, which is determined by a voltage margin setter accessing a voltage margin conversion table that indicates a particular Vdrop that corresponds to a designated ΔV.

2. The display device according to claim 1, further comprising:

a detecting circuit connected to the other end of each of the one or more output lines and to the regulator, wherein the detecting circuit is configured to detect and select, from among the applied potentials outputted by the relay, at least one of a lowest applied potential out of the high-side applied potentials and a highest applied potential out of the low-side applied potentials, and to output the selected at least one applied potential to the regulator.

3. The display device according to claim 1, wherein the relay includes, internally, a detecting circuit connected to the other end of each of the one or more output lines, and the detecting circuit is configured to detect and select, from among the applied potentials transmitted by the two or more detecting lines, at least one of a lowest applied potential out of the high-side applied potentials and a highest applied potential out of the low-side applied potentials, and to output the selected at least one applied potential to the one or more output lines.

4. The display device according to claim 1, wherein the relay is configured to time-divide the applied potentials transmitted by the two or more detecting lines, and sequentially output the time-divided applied potentials to the one or more output lines, and the regulator is configured to regulate at least one of the high-side output potential and the low-side output potential to be outputted by the power supplier, such that at least one of the following potential differences reaches the predetermined potential difference: a potential difference between the reference potential and a lowest applied potential out of the high-side applied potentials; and a potential difference between the reference potential and a highest applied potential out of the low-side applied potentials, the high-side and low-side applied potentials being included in the applied potentials outputted by the relay.

5. The display device according to claim 1, wherein the relay is configured to convert, into digital data, the applied potentials inputted to the relay as analog data, and output the applied potentials as the digital data.

6. The display device according to claim 1, wherein the first electrode is connected to one of the source electrode and the drain electrode of the driver, the high-side applied potential is applied to one of the second electrode and the other of the source electrode and the drain electrode, and the low-side applied potential is applied to the other of the second electrode and the other of the source electrode and the drain electrode.

7. The display device according to claim 6, wherein the second electrode is part of a common electrode provided in common to the pixels, the common electrode is electrically connected to the power supplier so that a potential is applied to the common electrode from a periphery of the common electrode, and at least a predetermined one of the two or more pixels is disposed near a center of the display.

8. The display device according to claim 7, wherein the second electrode comprises a transparent conductive material including a metal oxide.

9. The display device according to claim 6, wherein the luminescence element is an organic electroluminescence (EL) element.

10. A method of driving a display device including a power supplier which outputs at least one of a high-side output potential and a low-side output potential, a display device in which a plurality of pixels are arranged and which receives power supply from the power supplier, a plurality of scanning lines connected to a corresponding one of the pixels, a plurality of data lines connected to a corresponding one of the pixels, and two or more detecting lines each of which has one end connected to a corresponding one of two or more pixels inside the display device, and transmits a high-side applied potential or a low-side applied potential applied to the corresponding one of the two or more pixels, the method comprising:

outputting, to one or more output lines, at least one applied potential out of the high-side applied potentials or at least one applied potential out of the low-side applied potentials, the one or more output lines being fewer in number than the two or more detecting lines, and the high-side and low-side applied potentials being transmitted by the two or more detecting lines; and regulating at least one of the high-side output potential and the low-side output potential such that any one of the following potential differences reaches a predetermined potential difference: a potential difference between a reference potential and the high-side applied potential outputted in the outputting; a potential difference between the reference potential and the low-side applied potential outputted in the outputting; and a potential difference between the high-side applied potential and the low-side applied potential, wherein each of the pixels includes a driver, a switching element, and a luminescence element, the driver including a source electrode and a drain electrode, the switching element including a gate electrode, a source electrode, and a drain electrode, the luminescence element including a first electrode and a second electrode, each of the plurality of scanning lines is connected to the gate electrode of the switching element of the corresponding one of the pixels, each of the plurality of data lines is connected to one of the source electrode and the drain electrode of the switching element of the corresponding one of the pixels, and the predetermined potential difference is determined based on VTFT, VEL, ΔV, and Vdrop, where VTFT is the voltage required by the driver, VEL is the voltage required by the luminescent element, ΔV is the potential difference between the potential outputted by the power supplier and the potential of the luminescent pixel measured by a voltage measurer, and Vdrop is the voltage margin corresponding to ΔV, which is determined by a voltage margin setter accessing a voltage margin conversion table that indicates a particular Vdrop that corresponds to a designated ΔV, and connecting one end of each of the detecting lines to any one of the source electrode of the driver, the drain electrode of the driver, the first electrode, and the second electrode.

11. A display device, comprising:

a power supplier configured to output at least one of a high-side output potential and a low-side output potential;

a display in which a plurality of pixels are arranged and which receives power supply from the power supplier, a plurality of scanning lines are connected to each of the plurality of pixels, and a plurality of data lines are connected to each of the plurality of pixels;

two or more detecting lines each of which has one end connected to a corresponding one of two or more pixels inside the display, and is for transmitting a high-side applied potential or a low-side applied potential that is applied to the corresponding one of the two or more pixels;

a relay connected to the other end of each of the two or more detecting lines and to one end of one or more output lines which are fewer in number than the two or more detecting lines, and configured to output, to the one or more output lines, at least one applied potential out of the two or more high-side applied potentials or at least one applied potential out of the two or more low-side applied potentials, the high-side and low-side applied potentials being transmitted by the two or more detecting lines, wherein utilizing a multi-bit select signal, the relay uses time-division multiplexing to transmit signals transmitted by a subset of the two or more detecting lines using a single output line; and a regulator connected to the relay via the one or more output lines and configured to regulate at least one of the high-side output potential and the low-side output potential to be outputted by the power supplier, such that any one of the following potential differences reaches a predetermined potential difference: a potential difference between a reference potential and the high-side applied potential outputted by the relay; a potential difference between the reference potential and the low-side applied potential outputted by the relay; and a potential difference between the high-side applied potential and the low-side applied potential, wherein the display and the relay are provided on the same substrate, and the predetermined potential difference is determined based on VTFT, VEL, ΔV, and Vdrop, where VTFT is the voltage required by the driver, VEL is the voltage required by the luminescent element, ΔV is the potential difference between the potential outputted by the power supplier and the potential of the luminescent pixel measured by a voltage measurer, and Vdrop is the voltage margin corresponding to ΔV, which is determined by a voltage margin setter accessing a voltage margin conversion table that indicates a particular Vdrop that corresponds to a designated ΔV.

12. The display device according to claim 11, wherein each of the pixels includes a driver, a switching element, and a luminescence element, the driver including a source electrode and a drain electrode, the switching element including a gate electrode, a source electrode, and a drain electrode, the luminescence element including a first electrode and a second electrode, each of the plurality scanning lies in connected to the gate electrode of the switching element of the corresponding one of the pixels, each of the plurality of the data lines is connected to one of the source electrode and the drain electrode of the switching element of the corresponding one of the pixels, and the one end of each of the detecting lines is connected to any one of the source electrode of the driver, the drain electrode of the driver, the first electrode, and the second electrode.

13. A display device, comprising:

a power supplier configured to output at least one of a high-side output potential and a low-side output potential;

a display in which a plurality of pixels are arranged and which receives power supply from the power supplier;

two or more detecting lines each of which has one end connected to a corresponding one of two or more pixels inside the display, and is for transmitting a high-side applied potential or a low-side applied potential that is applied to the corresponding one of the two or more pixels;

a relay connected to the other end of each of the two or more detecting lines and to one end of one or more output lines which are fewer in number than the two or more detecting lines, and configured to output, to the one or more output lines, at least one applied potential out of the two or more high-side applied potentials or at least one applied potential out of the two or more low-side applied potentials, the high-side and low-side applied potentials being transmitted by the two or more detecting lines; and a regulator connected to the relay via the one or more output lines and configured to regulate at least one of the high-side output potential and the low-side output potential to be outputted by the power supplier, such that any one of the following potential differences reaches a predetermined potential difference: a potential difference between a reference potential and the high-side applied potential outputted by the relay; a potential difference between the reference potential and the low-side applied potential outputted by the relay; and a potential difference between the high-side applied potential and the low-side applied potential, wherein the display and the relay are provided on the same substrate, each of the pixels includes a driver and a luminescent element, and the predetermined potential difference is determined based on VTFT, VEL, ΔV, and Vdrop, where VTFT is the voltage required by the driver, VEL is the voltage required by the luminescent element, ΔV is the potential difference between the potential outputted by the power supplier and the potential of the luminescent pixel measured by a voltage measurer, and Vdrop is the voltage margin corresponding to ΔV, which is determined by a voltage margin setter accessing a voltage margin conversion table that indicates a particular Vdrop that corresponds to a designated ΔV.

14. The display device according to claim 1, wherein the voltage margin setter determines an output voltage Vout to be output in each frame period.

15. The method according to claim 10, wherein the voltage margin setter determines an output voltage Vout to be output in each frame period.

16. The display device according to claim 11, wherein the voltage margin setter determines an output voltage Vout to be output in each frame period.

17. The display device according to claim 13, wherein the voltage margin setter determines an output voltage Vout to be output in each frame period.

* * * * *